US007171791B2

(12) United States Patent
Pervan

(10) Patent No.: US 7,171,791 B2
(45) **Date of Patent: *Feb. 6, 2007**

(54) FLOORBOARDS AND METHODS FOR PRODUCTION AND INSTALLATION THEREOF

(75) Inventor: Darko Pervan, Viken (SE)

(73) Assignee: Valinge Innovation AB, Viken (SE)

( * ) Notice: Subject to any disclaimer, the term of this patent is extended or adjusted under 35 U.S.C. 154(b) by 0 days.

This patent is subject to a terminal disclaimer.

(21) Appl. No.: 10/933,539

(22) Filed: Sep. 3, 2004

(65) Prior Publication Data

US 2005/0034405 A1 Feb. 17, 2005

Related U.S. Application Data

(63) Continuation of application No. 10/043,149, filed on Jan. 14, 2002, now Pat. No. 6,851,241.

(60) Provisional application No. 60/329,499, filed on Oct. 17, 2001, provisional application No. 60/329,519, filed on Oct. 17, 2001.

(30) Foreign Application Priority Data

Jan. 12, 2001 (SE) ..... 0100100
Jan. 12, 2001 (SE) ..... 0100101

(51) Int. Cl.
*E04B 1/38* (2006.01)
*E04B 5/00* (2006.01)
*E04C 2/30* (2006.01)

(52) U.S. Cl. ..... 52/592.1; 52/591.1; 52/589.1

(58) Field of Classification Search ..... 52/390, 52/592.1; 404/41, 46; 428/50
See application file for complete search history.

(56) References Cited

U.S. PATENT DOCUMENTS 213,740 A 4/1879 Conner (Continued)

FOREIGN PATENT DOCUMENTS

AU 713628 1/1998

(Continued)

OTHER PUBLICATIONS

Darko Pervan, U.S. Appl. No. 10/925,924 entitled "Locking System for Mechanical Joining of Floorboards and Methods for Production Thereof" filed Aug. 26, 2004.

(Continued)

*Primary Examiner*—Robert Garfield
(74) *Attorney, Agent, or Firm*—Buchanan Ingersoll & Rooney PC

(57) ABSTRACT

Floorboard and openable locking system therefor comprise an undercut groove on one long side and projecting tongue on an opposite long side of the floorboard. The undercut groove has a corresponding upwardly directed inner locking surface at a distance from its tip. Tongue and undercut groove are formed to be brought together and pulled apart by pivoting motion with a center close to the intersection between the surface planes and common joint plane of two adjoining floorboards. The undercut is produced by at least two disk-shaped cutting tools with rotary shafts inclined relative to each other to form first an inner part of the undercut portion of the groove and then a locking surface positioned closer to the opening of the groove. Installation method for a floor of such boards, manufacturing method for manufacturing the undercut groove and a wedge-shaped tool for laying of the floorboards is also disclosed.

38 Claims, 25 Drawing Sheets

U.S. PATENT DOCUMENTS

| | | | | |
|---|---|---|---|---|
| 714,987 | A | | 12/1902 | Wolfe |
| 753,791 | A | | 3/1904 | Fulghum |
| 1,124,228 | A | | 1/1915 | Houston |
| 1,194,636 | A | | 8/1916 | Joy |
| 1,371,856 | A | | 3/1921 | Cade |
| 1,407,679 | A | | 2/1922 | Ruthrauff |
| 1,454,250 | A | | 5/1923 | Parsons |
| 1,468,288 | A | | 9/1923 | Een |
| 1,477,813 | A | | 12/1923 | Daniels et al. |
| 1,510,924 | A | | 10/1924 | Daniels et al. |
| 1,540,128 | A | | 6/1925 | Houston |
| 1,575,821 | A | | 3/1926 | Daniels |
| 1,602,256 | A | | 10/1926 | Sellin |
| 1,602,267 | A | | 10/1926 | Karwisch |
| 1,615,096 | A | | 1/1927 | Meyers |
| 1,622,103 | A | | 3/1927 | Fulton |
| 1,622,104 | A | | 3/1927 | Fulton |
| 1,637,634 | A | | 8/1927 | Carter |
| 1,644,710 | A | | 10/1927 | Crooks |
| 1,660,480 | A | | 2/1928 | Daniels |
| 1,714,738 | A | | 5/1929 | Smith |
| 1,718,702 | A | | 6/1929 | Pfiester |
| 1,734,826 | A | | 11/1929 | Pick |
| 1,764,331 | A | | 6/1930 | Moratz |
| 1,778,069 | A | | 10/1930 | Fetz |
| 1,787,027 | A | | 12/1930 | Wasleff |
| 1,790,178 | A | | 1/1931 | Sutherland, Jr. |
| 1,823,039 | A | | 9/1931 | Gruner |
| 1,859,667 | A | | 5/1932 | Gruner |
| 1,898,364 | A | | 2/1933 | Gynn |
| 1,906,411 | A | | 5/1933 | Potvin |
| 1,929,871 | A | | 10/1933 | Jones |
| 1,940,377 | A | | 12/1933 | Storm |
| 1,953,306 | A | | 4/1934 | Moratz |
| 1,986,739 | A | | 1/1935 | Mitte |
| 1,988,201 | A | | 1/1935 | Hall |
| 2,044,216 | A | | 6/1936 | Klages |
| 2,266,464 | A | | 12/1941 | Kraft |
| 2,276,071 | A | | 3/1942 | Scull |
| 2,324,628 | A | | 7/1943 | Kähr |
| 2,398,632 | A | | 4/1946 | Frost et al. |
| 2,430,200 | A | | 11/1947 | Wilson |
| 2,495,862 | A | | 1/1950 | Osborn |
| 2,740,167 | A | | 4/1956 | Rowley |
| 2,780,253 | A | | 2/1957 | Joa |
| 2,851,740 | A | | 9/1958 | Baker |
| 2,894,292 | A | | 7/1959 | Gramelspacher |
| 2,947,040 | A | | 8/1960 | Schultz |
| 3,045,294 | A | | 7/1962 | Livezey, Jr. |
| 3,100,556 | A | | 8/1963 | De Ridder |
| 3,125,138 | A | | 3/1964 | Bolenbach |
| 3,182,769 | A | | 5/1965 | De Ridder |
| 3,200,553 | A | | 8/1965 | Frashour et al. |
| 3,203,149 | A | | 8/1965 | Soddy |
| 3,267,630 | A | | 8/1966 | Omholt |
| 3,282,010 | A | | 11/1966 | King, Jr. |
| 3,301,147 | A | * | 1/1967 | Clayton et al. ..... 404/35 |
| 3,310,919 | A | | 3/1967 | Bue et al. |
| 3,347,048 | A | | 10/1967 | Brown et al. |
| 3,387,422 | A | | 6/1968 | Wanzer |
| 3,460,304 | A | | 8/1969 | Braeuninger et al. |
| 3,481,810 | A | | 12/1969 | Waite |
| 3,526,420 | A | | 9/1970 | Brancalcone |
| 3,538,665 | A | | 11/1970 | Gohner |
| 3,548,559 | A | | 12/1970 | Levine |
| 3,553,919 | A | | 1/1971 | Ohmolt |
| 3,555,762 | A | | 1/1971 | Costanzo, Jr. |
| 3,694,983 | A | | 10/1972 | Couquet |
| 3,714,747 | A | | 2/1973 | Curran |
| 3,731,445 | A | | 5/1973 | Hoffmann et al. |
| 3,759,007 | A | | 9/1973 | Thiele |
| 3,768,846 | A | | 10/1973 | Hensley et al. |
| 3,786,608 | A | | 1/1974 | Boettcher |
| 3,859,000 | A | | 1/1975 | Webster |
| 3,902,293 | A | | 9/1975 | Witt et al. |
| 3,908,053 | A | | 9/1975 | Hettich |
| 3,936,551 | A | | 2/1976 | Elmendorf et al. |
| 3,988,187 | A | | 10/1976 | Witt et al. |
| 4,037,377 | A | | 7/1977 | Howell et al. |
| 4,084,996 | A | | 4/1978 | Wheeler |
| 4,090,338 | A | | 5/1978 | Bourgade |
| 4,099,358 | A | | 7/1978 | Compaan |
| 4,100,710 | A | | 7/1978 | Kowallik |
| 4,169,688 | A | | 10/1979 | Toshio |
| 4,242,390 | A | | 12/1980 | Nemeth |
| 4,299,070 | A | | 11/1981 | Oltmanns et al. |
| 4,304,083 | A | | 12/1981 | Anderson |
| 4,426,820 | A | | 1/1984 | Terbrack et al. |
| 4,471,012 | A | | 9/1984 | Maxwell |
| 4,489,115 | A | | 12/1984 | Layman et al. |
| 4,501,102 | A | | 2/1985 | Knowles |
| 4,561,233 | A | | 12/1985 | Harter et al. |
| 4,567,706 | A | | 2/1986 | Wendt |
| 4,612,074 | A | | 9/1986 | Smith et al. |
| 4,612,745 | A | | 9/1986 | Hovde |
| 4,641,469 | A | | 2/1987 | Wood |
| 4,643,237 | A | | 2/1987 | Rosa |
| 4,646,494 | A | | 3/1987 | Saarinen et al. |
| 4,653,242 | A | | 3/1987 | Ezard |
| 4,703,597 | A | | 11/1987 | Eggemar |
| 4,715,162 | A | | 12/1987 | Brightwell |
| 4,716,700 | A | | 1/1988 | Hagemeyer |
| 4,738,071 | A | | 4/1988 | Ezard |
| 4,769,963 | A | | 9/1988 | Meyerson |
| 4,819,932 | A | | 4/1989 | Trotter, Jr. |
| 4,831,806 | A | | 5/1989 | Niese et al. |
| 4,845,907 | A | | 7/1989 | Meek |
| 4,905,442 | A | | 3/1990 | Daniels |
| 5,029,425 | A | | 7/1991 | Bogataj |
| 5,113,632 | A | | 5/1992 | Hanson |
| 5,117,603 | A | | 6/1992 | Weintraub |
| 5,148,850 | A | | 9/1992 | Urbanick |
| 5,165,816 | A | | 11/1992 | Parasin |
| 5,179,812 | A | | 1/1993 | Hill |
| 5,216,861 | A | | 6/1993 | Meyerson |
| 5,253,464 | A | | 10/1993 | Nilsen |
| 5,271,564 | A | | 12/1993 | Smith |
| 5,295,341 | A | | 3/1994 | Kajiwara |
| 5,349,796 | A | | 9/1994 | Meyerson |
| 5,390,457 | A | | 2/1995 | Sjölander |
| 5,433,806 | A | | 7/1995 | Pasquali et al. |
| 5,474,831 | A | | 12/1995 | Nystrom |
| 5,497,589 | A | | 3/1996 | Porter |
| 5,502,939 | A | | 4/1996 | Zadok et al. |
| 5,540,025 | A | | 7/1996 | Takehara et al. |
| 5,560,569 | A | | 10/1996 | Schmidt |
| 5,567,497 | A | | 10/1996 | Zegler et al. |
| 5,570,554 | A | | 11/1996 | Searer |
| 5,597,024 | A | | 1/1997 | Bolyard et al. |
| 5,618,602 | A | | 4/1997 | Nelson |
| 5,630,304 | A | | 5/1997 | Austin |
| 5,653,099 | A | | 8/1997 | MacKenzie |
| 5,671,575 | A | | 9/1997 | Wu |
| 5,695,875 | A | | 12/1997 | Larsson et al. |
| 5,706,621 | A | | 1/1998 | Pervan |
| 5,755,068 | A | | 5/1998 | Ormiston |
| 5,768,850 | A | | 6/1998 | Chen |
| 5,797,237 | A | | 8/1998 | Finkell, Jr. |
| 5,823,240 | A | | 10/1998 | Bolyard et al. |
| 5,827,592 | A | | 10/1998 | Van Gulik et al. |
| 5,860,267 | A | | 1/1999 | Pervan |
| 5,899,038 | A | | 5/1999 | Stroppiana |
| 5,900,099 | A | | 5/1999 | Sweet et al. |
| 5,935,668 | A | | 8/1999 | Smith |

| | | | | |
|---|---|---|---|---|
| 5,943,239 | A | 8/1999 | Shamblin et al. | |
| 5,968,625 | A | 10/1999 | Hudson | |
| 5,987,839 | A | 11/1999 | Hamar et al. | |
| 6,006,486 | A | 12/1999 | Moriau et al. | |
| 6,023,907 | A | 2/2000 | Pervan | |
| 6,029,416 | A | 2/2000 | Andersson | |
| 6,094,882 | A | 8/2000 | Pervan | |
| 6,101,778 | A | 8/2000 | Martensson | |
| 6,119,423 | A | 9/2000 | Costantino | |
| 6,134,854 | A | 10/2000 | Stanchfield | |
| 6,148,884 | A | 11/2000 | Bolyard et al. | |
| 6,173,548 | B1 | 1/2001 | Hamar et al. | |
| 6,182,410 | B1 | 2/2001 | Pervan | |
| 6,203,653 | B1 | 3/2001 | Seidner | |
| 6,205,639 | B1 | 3/2001 | Pervan | |
| 6,209,278 | B1 | 4/2001 | Tychsen | |
| 6,216,403 | B1 | 4/2001 | Belbeoc'h | |
| 6,216,409 | B1 | 4/2001 | Roy et al. | |
| 6,247,285 | B1 | 6/2001 | Mobeus | |
| 6,314,701 | B1 | 11/2001 | Meyerson | |
| 6,324,803 | B1 | 12/2001 | Pervan | |
| 6,332,733 | B1 | 12/2001 | Hamberger et al. | |
| 6,339,908 | B1 | 1/2002 | Chuang | |
| 6,345,481 | B1 | 2/2002 | Nelson | |
| 6,363,677 | B1 | 4/2002 | Chen et al. | |
| 6,385,936 | B1 | 5/2002 | Schneider | |
| 6,397,547 | B1 | 6/2002 | Martensson | |
| 6,421,970 | B1 | 7/2002 | Martensson et al. | |
| 6,438,919 | B1 | 8/2002 | Knauseder | |
| 6,446,405 | B1 | 9/2002 | Pervan | |
| 6,490,836 | B1 | 12/2002 | Moriau et al. | |
| 6,505,452 | B1 | 1/2003 | Hannig et al. | |
| 6,510,665 | B2 | 1/2003 | Pervan | |
| 6,516,579 | B1 | 2/2003 | Pervan | |
| 6,526,719 | B2 | 3/2003 | Pletzer et al. | |
| 6,532,709 | B2 | 3/2003 | Pervan | |
| 6,536,178 | B1 | 3/2003 | Palsson et al. | |
| 6,584,747 | B2 * | 7/2003 | Kettler et al. | 52/592.2 |
| 6,601,359 | B2 * | 8/2003 | Olofsson | 52/588.1 |
| 6,606,834 | B2 | 8/2003 | Martensson et al. | |
| 6,715,253 | B2 | 4/2004 | Pervan | |
| 6,722,809 | B2 | 4/2004 | Hamberger et al. | |
| 6,769,218 | B2 * | 8/2004 | Pervan | 52/591.4 |
| 6,786,019 | B2 * | 9/2004 | Thiers | 52/589.1 |
| 6,851,241 | B2 * | 2/2005 | Pervan | 52/592.1 |
| 6,874,292 | B2 * | 4/2005 | Moriau et al. | 52/590.2 |
| 2001/0029720 | A1 | 10/2001 | Pervan | |
| 2002/0014047 | A1 | 2/2002 | Thiers | |
| 2002/0020127 | A1 | 2/2002 | Thiers et al. | |
| 2002/0031646 | A1 | 3/2002 | Chen et al. | |
| 2002/0046528 | A1 | 4/2002 | Pervan et al. | |
| 2002/0069611 | A1 | 6/2002 | Leopolder | |
| 2002/0083673 | A1 * | 7/2002 | Kettler et al. | 52/578 |
| 2002/0100231 | A1 | 8/2002 | Miller et al. | |
| 2002/0112433 | A1 | 8/2002 | Pervan | |
| 2002/0178673 | A1 | 12/2002 | Pervan | |
| 2002/0178674 | A1 | 12/2002 | Pervan | |
| 2002/0178682 | A1 | 12/2002 | Pervan | |
| 2003/0009972 | A1 | 1/2003 | Pervan et al. | |
| 2003/0024199 | A1 | 2/2003 | Pervan | |
| 2003/0024200 | A1 * | 2/2003 | Moriau et al. | 52/592.1 |
| 2003/0033784 | A1 | 2/2003 | Pervan | |
| 2003/0041545 | A1 | 3/2003 | Stanchfield | |
| 2003/0084636 | A1 | 5/2003 | Pervan | |
| 2003/0101674 | A1 | 6/2003 | Pervan et al. | |
| 2003/0115812 | A1 | 6/2003 | Pervan | |
| 2003/0115821 | A1 | 6/2003 | Pervan | |
| 2003/0196405 | A1 | 10/2003 | Pervan | |
| 2003/0233809 | A1 | 12/2003 | Pervan | |
| 2004/0016196 | A1 | 1/2004 | Pervan | |
| 2004/0035078 | A1 | 2/2004 | Pervan | |
| 2004/0068954 | A1 * | 4/2004 | Martensson | 52/592.1 |
| 2004/0139678 | A1 | 7/2004 | Pervan | |
| 2004/0177584 | A1 | 9/2004 | Pervan | |
| 2004/0206036 | A1 | 10/2004 | Pervan | |
| 2004/0241374 | A1 * | 12/2004 | Thiers et al. | 428/53 |
| 2004/0255541 | A1 | 12/2004 | Thiers et al. | |
| 2005/0193677 | A1 * | 9/2005 | Vogel | 52/592.1 |
| 2005/0208255 | A1 * | 9/2005 | Pervan | 428/60 |

FOREIGN PATENT DOCUMENTS

| | | | |
|---|---|---|---|
| AU | 200020703 | A1 | 6/2000 |
| BE | 417526 | | 9/1936 |
| BE | 0557844 | | 6/1957 |
| BE | 1010339 | A3 | 6/1998 |
| BE | 1010487 | A6 | 10/1998 |
| CA | 0991373 | | 6/1976 |
| CA | 2226286 | | 12/1997 |
| CA | 2252791 | | 5/1999 |
| CA | 2289309 | | 7/2000 |
| CH | 200949 | | 1/1939 |
| CH | 211877 | | 1/1941 |
| CH | 690242 | A5 | 6/2000 |
| DE | 1 212 275 | | 3/1966 |
| DE | 7102476 | | 1/1971 |
| DE | 1 534 278 | | 11/1971 |
| DE | 2 159 042 | | 11/1971 |
| DE | 2 205 232 | | 8/1973 |
| DE | 7402354 | | 1/1974 |
| DE | 2 238 660 | | 2/1974 |
| DE | 2 252 643 | | 5/1974 |
| DE | 2 502 992 | | 7/1976 |
| DE | 2 616 077 | | 10/1977 |
| DE | 2 917 025 | | 11/1980 |
| DE | 30 41781 | A1 | 6/1982 |
| DE | 32 14 207 | A1 | 11/1982 |
| DE | 32 46 376 | C2 | 6/1984 |
| DE | 33 43 601 | A1 | 6/1985 |
| DE | 35 38 538 | A1 | 10/1985 |
| DE | 86 04 004 | | 6/1986 |
| DE | 35 12 204 | A1 | 10/1986 |
| DE | 35 44 845 | A1 | 6/1987 |
| DE | 36 31 390 | A1 | 12/1987 |
| DE | 40 02 547 | A1 | 8/1991 |
| DE | 41 30 115 | A1 | 9/1991 |
| DE | 41 34 452 | A1 | 4/1993 |
| DE | 42 15 273 | A1 | 11/1993 |
| DE | 42 42 530 | A1 | 6/1994 |
| DE | 43 13 037 | C1 | 8/1994 |
| DE | 93 17 191 | U1 | 3/1995 |
| DE | 296 10 462 | U1 | 10/1996 |
| DE | 196 01 322 | A1 | 5/1997 |
| DE | 296 18 318 | U1 | 5/1997 |
| DE | 297 10 175 | U1 | 9/1997 |
| DE | 196 51 149 | A1 | 6/1998 |
| DE | 197 09 641 | A1 | 9/1998 |
| DE | 197 18 319 | A1 | 11/1998 |
| DE | 197 18 812 | A1 | 11/1998 |
| DE | 200 01 225 | U1 | 8/2000 |
| DE | 200 02 744 | U1 | 9/2000 |
| DE | 199 25 248 | A1 | 12/2000 |
| DE | 200 13 380 | U1 | 12/2000 |
| DE | 200 17 461 | U1 | 3/2001 |
| DE | 200 18 284 | U1 | 3/2001 |
| DE | 100 01 248 | | 7/2001 |
| DE | 100 01 248 | A1 | 7/2001 |
| DE | 100 32 204 | C1 | 7/2001 |
| EP | 0 248 127 | A1 | 12/1987 |
| EP | 0 623 724 | A1 | 11/1994 |
| EP | 0 620 340 | A1 | 5/1995 |
| EP | 0 665 347 | A1 | 8/1995 |
| EP | 0 690 185 | A1 | 1/1996 |
| EP | 0 698 162 | B1 | 2/1996 |
| EP | 0 843 763 | B1 | 5/1998 |
| EP | 0 849 416 | A2 | 6/1998 |

| | | | |
|---|---|---|---|
| EP | 0 855 482 | B1 | 7/1998 |
| EP | 0 877 130 | B1 | 11/1998 |
| EP | 0 958 441 | | 11/1998 |
| EP | 0 903 451 | A2 | 3/1999 |
| EP | 0 969 163 | A2 | 1/2000 |
| EP | 0 969 164 | A2 | 1/2000 |
| EP | 0 974 713 | A1 | 1/2000 |
| EP | 0 976 889 | A1 | 2/2000 |
| EP | 1 048 423 | A2 | 11/2000 |
| EP | 1 120 515 | A1 | 8/2001 |
| EP | 1 146 182 | A2 | 10/2001 |
| EP | 1 223 265 | A2 | 7/2002 |
| EP | 1 251 219 | A1 | 10/2002 |
| EP | 1 262 609 | A1 | 12/2002 |
| FI | 843060 | | 8/1984 |
| FR | 1 293 043 | | 4/1962 |
| FR | 2 568 295 | | 1/1986 |
| FR | 2 630 149 | | 10/1989 |
| FR | 2 637 932 | A1 | 4/1990 |
| FR | 2 675 174 | | 10/1992 |
| FR | 2 691 491 | | 11/1993 |
| FR | 2 697 275 | | 4/1994 |
| FR | 2 712 329 | A1 | 5/1995 |
| FR | 2 781 513 | A1 | 1/2000 |
| FR | 2 785 633 | A1 | 5/2000 |
| GB | 240629 | | 10/1925 |
| GB | 424057 | | 2/1935 |
| GB | 585205 | | 1/1947 |
| GB | 599793 | | 3/1948 |
| GB | 636423 | | 4/1950 |
| GB | 812671 | | 4/1959 |
| GB | 1127915 | | 10/1968 |
| GB | 1171337 | | 11/1969 |
| GB | 1237744 | | 6/1971 |
| GB | 1275511 | | 5/1972 |
| GB | 1430423 | | 3/1976 |
| GB | 2117813 | A | 10/1983 |
| GB | 2126106 | A | 3/1984 |
| GB | 2243381 | A | 10/1991 |
| GB | 2256023 | A | 11/1992 |
| JP | 54-65528 | | 5/1979 |
| JP | 57-119056 | | 7/1982 |
| JP | 57-185110 | | 11/1982 |
| JP | 59-186336 | | 11/1984 |
| JP | 3-169967 | | 7/1991 |
| JP | 4-106264 | | 4/1992 |
| JP | 4-191001 | | 7/1992 |
| JP | 5-148984 | | 6/1993 |
| JP | 6-56310 | | 5/1994 |
| JP | 6-146553 | | 5/1994 |
| JP | 6-320510 | | 11/1994 |
| JP | 7-076923 | | 3/1995 |
| JP | 7-180333 | | 7/1995 |
| JP | 7-300979 | | 11/1995 |
| JP | 7-310426 | | 11/1995 |
| JP | 8-109734 | | 4/1996 |
| JP | 9-38906 | | 2/1997 |
| JP | 9-88315 | | 3/1997 |
| JP | 2000 179137 | | 6/2000 |
| JP | P2000 226932 | | 8/2000 |
| JP | 2001 173213 | | 6/2001 |
| JP | 2001 179710 | | 7/2001 |
| JP | 2001 254503 | | 9/2001 |
| JP | 2001 260107 | | 9/2001 |
| NL | 7601773 | | 8/1976 |
| NO | 157871 | | 7/1984 |
| NO | 305614 | | 5/1995 |
| PL | 24931 (U) | | 11/1974 |
| SE | 372 051 | | 5/1973 |
| SE | 450 141 | | 6/1984 |
| SE | 501 014 | C2 | 10/1994 |
| SE | 502 994 | | 3/1996 |
| SE | 506 254 | C2 | 11/1997 |
| SE | 509 059 | | 6/1998 |
| SE | 509 060 | | 6/1998 |
| SE | 512 290 | | 12/1999 |
| SE | 512 313 | | 12/1999 |
| SE | 0000200-6 | | 7/2001 |
| SU | 363795 | | 11/1973 |
| WO | WO 84/02155 | | 6/1984 |
| WO | WO 87/03839 | A1 | 7/1987 |
| WO | WO 92/17657 | | 10/1992 |
| WO | WO 93/13280 | | 7/1993 |
| WO | WO 94/01628 | | 1/1994 |
| WO | WO 94/26999 | | 11/1994 |
| WO | WO 96/27719 | | 9/1996 |
| WO | WO 96/27721 | | 9/1996 |
| WO | WO 96/30177 | A1 | 10/1996 |
| WO | WO 97/19232 | A1 | 5/1997 |
| WO | WO 97/47834 | | 12/1997 |
| WO | WO 98/22677 | A1 | 5/1998 |
| WO | WO 98/24994 | | 6/1998 |
| WO | WO 98/24995 | | 6/1998 |
| WO | WO 98/38401 | A1 | 9/1998 |
| WO | WO 99/40273 | A1 | 8/1999 |
| WO | WO 99/66151 | | 12/1999 |
| WO | WO 99/66152 | | 12/1999 |
| WO | WO 00/06854 | | 1/2000 |
| WO | WO 00/20705 | A1 | 4/2000 |
| WO | WO 00/20706 | A1 | 4/2000 |
| WO | WO 00/66856 | A1 | 11/2000 |
| WO | WO 01/02669 | A1 | 1/2001 |
| WO | WO 01/07729 | A1 | 2/2001 |
| WO | WO 01/66876 | A1 | 9/2001 |
| WO | WO 01/66877 | A1 | 9/2001 |
| WO | WO 01/75247 | A1 | 10/2001 |
| WO | WO 01/77461 | A1 | 10/2001 |
| WO | WO 01/96688 | A1 | 12/2001 |
| WO | WO 01/98603 | A2 | 12/2001 |
| WO | WO 02/060691 | A1 | 8/2002 |

OTHER PUBLICATIONS

Darko Pervan et al., U.S. Appl. No. 10/508,198 entitled "Floorboards with Decorative Grooves" filed Sep. 20, 2004.

Darko Pervan, U.S. Appl. No. 10/509,885 entitled "Mechanical Locking System for Floorboards" filed Oct. 4, 2004.

Darko Pervan, U.S. Appl. No. 10/958,233 entitled "Locking System for Floorboards" filed Oct. 6, 2004.

Darko Pervan, U.S. Appl. No. 10/510,580 entitled "Floorboards for Floorings" filed Oct. 8, 2004.

Darko Pervan, U.S. Appl. No. 10/970,282 entitled "Mechanical Locking System for Floor Panels" filed Oct. 22, 2004.

Darko Pervan, U.S. Appl. No. 10/908,658 entitled "Mechanical Locking System for Floor Panels" filed May 20, 2005.

Darko Pervan et al, U.S. Appl. No. 11/161,520 entitled "Method of Making a Floorboard and Mehtod of Making a Floor with the Floorboard" filed Aug. 6, 2005.

Darko Pervan et al, U.S. Appl. No. 11/163,085 entitled "Appliance and Method for Surface Treatment of a Board Shaped Material and Floorboard" filed Oct. 4, 2005.

Darko Pervan, U.S. Appl. No. 10/975,923 entitled "Flooring Systems and Methods for Installation" filed Oct. 29, 2004.

Darko Pervan, U.S. Appl. No. 11/000,912 entitled "Floorboard, System and Method for Forming a Flooring, and Flooring Formed Thereof" filed Dec. 2, 2004.

Darko Pervan, U.S. Appl. No. 11/008,213 entitled "Metal Strip for Interlocking Floorboard and a Floorboard Using Same" filed Dec. 10, 2004.

Darko Pervan, U.S. Appl. No. 11/034,059 entitled "Floor Covering and Locking System" filed Jan. 13, 2005.

Darko Pervan, U.S. Appl. No. 11/034,060 entitled "Floor Covering and Locking System" filed Jan. 13, 2005.

Darko Pervan, U.S. Appl. No. 10/906,109 entitled "Locking System and Flooring Board" filed Feb. 3, 2005.

Darko Pervan, U.S. Appl. No. 10/906,356 entitled "Building Panel With Compressed Edges and Method of Making Same" filed Feb. 15, 2005.
Darko Pervan, U.S. Appl. No. 11/092,748 entitled "Mechanical Locking System for Panels and Method of Installing Same" filed Mar. 30, 2005.
Webster's Dictionary, Random House: New York (1987), p. 862.
Knight's American Mechanical Dictionary, Hurd and Houghton: New York (1876), p. 2051.
Opposition EP 0.698,162 B1—Facts-Grounds-Arguments, dated Apr. 1, 1999, pp. 1-56.
Opposition II EP 0.698,162 B1—Facts-Grounds-Arguments, dated Apr. 30, 1999, (17 pages)—with translation (11 pages).
Opposition I: Unilin Decor N.V./Välinge Aluminum AB, communication dated Jun. 8, 1999 to European Patent Office, pp. 1-2.
Opposition I: Unilin Decor N.V./Välinge Aluminum AB, communicated dated Jun. 16, 1999 to European Patent Office, pp. 1-2.
FI Office Action dated Mar. 19, 1998.
NO Office Action dated Dec. 22, 1997.
NO Office Action dated Sep. 21, 1998.
Opposition EP 0.877.130 B1—Facts—Arguments, dated Jun. 28, 2000, pp. 1-13.
RU Application Examiner Letter dated Sep. 26, 1997.
NZ Application Examiner Letter dated Oct. 21, 1999.
European prosecution file history to grant, European Patent No. 94915725.9—2303/0698162, grant date Sep. 16, 1998.
European prosecution file history to grant, European Patent No. 98106535.2-2303/0855482, grant date Dec. 1, 1999.
European prosecution file history to grant, European Patent No. 98201555.4-2303/0877130, grant date Jan. 26, 2000.
Communication of Notices of Intervention by E.F.P. Floor Products dated Mar. 17, 2000 in European Patent Application 0698162, pp. 1-11 with annex pp. 1-21.
Response to the E.F.P. Floor Products intervention dated Jun. 28, 2000, pp. 1-5.
Letters from the Opponent dated Jul. 26, 2001 and Jul. 30, 2001 including Annexes 1 to 3.
Communication from European Patent Office dated Sep. 20, 2001 in European Patent No. 0698162, pp. 1-2 with Facts and Submissions Annex pp. 1-18, Minutes Annex pp. 1-11, and Annex I to VI.
Communication from Swedish Patent Office dated Sep. 21, 2001 in Swedish Patent No. 9801986-2, pp. 1-3 in Swedish with forwarding letter dated Sep. 24, 2001 in English.
Välinge, "Fibo-Trespo" Brochure, Distributed at the Domotex Fair In Hannover, Germany, Jan. 1996.
Träindustrins Handbook "Snickeriarbete", 2nd Edition, Malmö 1952, pp. 826, 827, 854, and 855, published by Teknografriska Aktiebolaget, Sweden.
"Träbearbetning", Anders Grönlund, 1986, ISBN 91-970513-2-2, pp. 357-360, published by Institutet for Trateknisk Forskning, Stockholm, Sweden.
Drawing Figure 25/6107 from Buetec Gmbh dated Dec. 16, 1985.
Pamphlet from Serexhe for Compact-Praxis, entitled "Selbst Teppichböden, PVC und Parkett verlegen", Published by Compact Verlag, München, Germany 1985, pp. 84-87.
Pamphlet from Junckers Industrser A/S entitled"Bøjlesystemet til Junckers boliggulve" Oct. 1994, , Published by Junckers Industrser A/S, Denmark.
Pamphlet from Junckers Industrser A/S entitled "The Clip System for Junckers Sports Floors", Annex 7, 1994, Published by Junckers Industrser A/S, Denmark.
Pamphlet from Junckers Industrser A/S entitled "The Clip System for Junckers Domestic Floors", Annex 8, 1994, Published by Junckers Industrser A/S, Denmark.
Fibo-Trespo Alloc System Brochure entitled "Opplæring OG Autorisasjon", pp. 1-29, Fibo-Trespo.
"Revolution bei der Laminatboden-Verl", boden wand decke, vol. No. 11 of 14, Jan. 10, 1997, p. 166.
Kährs Focus Extra dated Jan. 2001, pp. 1-9.
Brochure for CLIC Laminate Flooring, Art.-Nr. 110 11 640.
Brochure for Laminat-Boden "Clever-Click", Parador® Wohnsysteme.
Brochure for PERGO®, CLIC Laminate Flooring, and Prime Laminate Flooring from Bauhaus, The Home Store, Malmö, Sweden.
Darko Pervan, U.S. Appl. No. 09/714,514 entitled "Locking System and Flooring Board" filed Nov. 17, 2000.
Darko Pervan, U.S. Appl. No. 10/768,677 entitled "Mechanical Locking System for Floorboards" filed Feb. 2, 2004.

* cited by examiner

PRIOR ART

PRIOR ART

PRIOR ART

PRIOR ART

PRIOR ART 30
32
38
36
34

Section C1-C2

Section C3-C4

FLOORBOARDS AND METHODS FOR PRODUCTION AND INSTALLATION THEREOF

RELATED APPLICATION DATA

This application is a continuation application of U.S. patent application Ser. No. 10/043,149, filed on Jan. 14, 2002 now U.S. Pat. No. 6,851,241, which claims the priority of SE 0100100-7 filed on Jan. 12, 2001 and SE 0100101-5 filed on Jan. 12, 2001 and also claims the benefit of U.S. Provisional Application No. 60/329,499, filed Oct. 17, 2001, and U.S. Provisional Application No. 60/329,519, filed Oct. 17, 2001. The contents of U.S. patent application Ser. No. 10/043,149; SE 0100100-7, SE 0100101-5; U.S. Ser. No. 60/329,499 and U.S. Ser. No. 60/329,519 are hereby incorporated herein by reference.

FIELD OF THE DISCLOSURE

The present invention relates to a locking system for mechanical joining of floorboards, floorboards having such a locking system, a method of installing these floorboards, a method of producing them, a tool as well as use of such a tool for installation of floorboards.

The invention is particularly suited for floorboards which are based on wood material and in the normal case have a core of wood and which are intended to be mechanically joined. The following description of prior-art technique and the objects and features of the invention will therefore be directed at this field of application and, above all, rectangular parquet floors which are joined on long side as well as short side. The invention is particularly suited for floating floors, i.e. floors that can move in relation to the base. However, it should be emphasized that the invention can be used on all types of existing hard floors, such as homogeneous wooden floors, wooden floors with a lamellar core or plywood core, floors with a surface of veneer and a core of wood fiber, thin laminate floors, floors with a plastic core and the like. The invention can, of course, also be used in other types of floorboards which can be machined with cutting tools, such as subfloors of plywood or particle board. Even if it is not preferred, the floorboards can after installation be fixed to the base.

TECHNICAL BACKGROUND OF THE INVENTION

Mechanical joints have in a short time taken great market shares mainly owing to their superior laying properties, joint strength and joint quality. Even if the floor according to WO 9426999 as described in more detail below and the floor marketed under the trademark Alloc© have great advantages compared with traditional, glued floors, further improvements are, however, desirable.

Mechanical joint systems are very convenient for joining not only of laminate floors but also wooden floors and composite floors. Such floorboards may consist of a large number of different materials in the surface, core and rear side. As will be described below, these materials can also be included in the different parts of the joint system, such as strip, locking element and tongue. A solution involving an integrated strip which is formed according to, for example, WO 9426999 or WO 9747834 and which provides the horizontal joint, and also involving a tongue which provides the vertical joint, results, however, in costs in the form of material waste in connection with the forming of the mechanical joint by machining of the board material.

For optimal function, for instance a 15-mm-thick parquet floor should have a strip which is of a width which is approximately the same as the thickness of the floor, i.e. about 15 mm. With a tongue of about 3 mm, the amount of waste will be 18 mm. The floorboard has a normal width of about 200 mm. Therefore the amount of material waste will be about 9%. In general, the cost of material waste will be great if the floorboards consist of expensive materials, if they are thick or if their format is small, so that the number of running meters of joint per square meter of floor will be great.

Certainly the amount of material waste can be reduced if a strip is used which is in the form of a separately manufactured aluminum strip which is already fixed to the floorboard at the factory. Moreover, the aluminum strip can in a number of applications result in a better and also more inexpensive joint system than a strip machined and formed from the core. However, the aluminum strip is disadvantageous since the investment cost can be considerable and extensive reconstruction of the factory may be necessary to convert an existing traditional production line so that floorboards with such a mechanical joint system can be produced. An advantage of the prior-art aluminum strip is, however, that the starting format of the floorboards need not be changed.

When a strip produced by machining of the floorboard material is involved, the reverse is the case. Thus, the format of the floorboards must be adjusted so that there is enough material for forming the strip and the tongue. For laminate floors, it is often necessary to change also the width of the decorative paper used. All these adjustments and changes also require costly modifications of production equipment and great product adaptations.

In addition to the above problems relating to undesirable material waste and costs of production and product adaptation, the strip has disadvantages in the form of its being sensitive to damage during transport and installation.

To sum up, there is a great need of providing a mechanical joint at a lower production cost while at the same time the aim is to maintain the present excellent properties as regards laying, taking-up, joint quality and strength. With prior-art solutions, it is not possible to obtain a low cost without also having to lower the standards of strength and/or laying function. An object of the invention therefore is to indicate solutions which aim at reducing the cost while at the same time strength and function are retained.

The invention starts from known floorboards which have a core, a front side, a rear side and opposite joint edge portions, of which one is formed as a tongue groove defined by upper and lower lips and having a bottom end, and the other is formed as a tongue with an upwardly directed portion at its free outer end. The tongue groove has the shape of an undercut groove with an opening, an inner portion and an inner locking surface. At least parts of the lower lip are formed integrally with the core of the floorboard and the tongue has a locking surface which is designed to coact with the inner locking surface in the tongue groove of an adjoining floorboard, when two such floorboards are mechanically joined, so that their front sides are located in the same surface plane (HP) and meet at a joint plane (VP) directed perpendicular thereto. This technique is disclosed in, inter alia DE-A-3041781, which will be discussed in more detail below.

Before that, however, the general-technique regarding floorboards and locking systems for mechanical locking-together of floorboards will be described as a background of the present invention.

DESCRIPTION OF PRIOR ART

To facilitate the understanding and description of the present invention as well as the knowledge of the problems behind the invention, here follows a description of both the basic construction and the function of floorboards according to WO 9426999 and WO 9966151, with reference to FIGS. 1–17 in the accompanying drawings. In applicable parts, the following description of the prior-art technique also applies to the embodiments of the present invention as described below.

FIGS. 3*a* and 3*b* show a floorboard 1 according to WO 9426999 from above and from below, respectively. The board 1 is rectangular with an upper side 2, an underside 3, two opposite long sides with joint edge portions 4*a* and 4*b*, and two opposite short sides with joint edge portions 5*a* and 5*b*.

The joint edge portions 4*a*, 4*b* of the long sides as well as the joint edge portions 5*a*, 5*b* of the short sides can be joined mechanically without glue in a direction D2 in FIG. 1*c*, so as to meet in a joint plane VP (marked in FIG. 2*c*) and so as to have, in their laid state, their upper sides in a common surface plane HP (marked in FIG. 2*c*).

In the shown embodiment, which is an example of floorboards according to WO 9426999 (FIGS. 1–3 in the accompanying drawings), the board 1 has a factory-mounted plane strip 6 which extends along the entire long side 4*a* and which is made of a flexible, resilient aluminum sheet. The strip 6 extends outwards beyond the joint plane VP at the joint edge portion 4*a*. The strip 6 can be attached mechanically according to the shown embodiment or else by glue or in some other manner. As stated in said documents, it is possible to use as material for a strip that is attached to the floorboard at the factory, also other strip materials, such as sheet of some other metal, aluminum or plastic sections. As is also stated in WO 9426999 and as described and shown in WO 9966151, the strip 6 can instead be formed integrally with the board 1, for instance by suitable machining of the core of the board 1.

The present invention is usable for floorboards where the strip or at least part thereof is integrally formed with the core, and the invention solves special problems that arise in such floorboards and the production thereof. The core of the floorboard need not, but is preferably, made of a uniform material. The strip 6, however, is always integrated with the board 1, i.e. it should be formed on the board or be factory-mounted.

In known embodiments according to the above-mentioned WO 9426999 and WO 9966151, the width of the strip 6 can be about 30 mm and the thickness about 0.5 mm.

A similar, although shorter strip 6' is arranged along one short side 5*a* of the board 1. The part of the strip 6 projecting beyond the joint plane VP is formed with a locking element 8 which extends along the entire strip 6. The locking element 8 has in its lower part an operative locking surface 10 facing the joint plane VP and having a height of, for instance, 0.5 mm. In laying, this locking surface 10 coacts with a locking groove 14 which is made in the underside 3 of the joint edge portion 4*b* of the opposite long side of an adjoining board 1'. The strip 6' along the short side is provided with a corresponding locking element 8', and the joint edge portion 5*b* of the opposite short side has a corresponding locking groove 14'. The edge of the locking grooves 14, 14' facing away from the joint plane VP forms an operative locking surface 10' for coaction with the operative locking surface 10 of the locking element.

For mechanical joining of long sides as well as short sides also in the vertical direction (direction D1 in FIG. 1*c*), the board 1 is also along its one long side (joint edge portion 4*a*) and its one short side (joint edge portion 5*a*) formed with a laterally open recess or tongue groove 16. This is defined upwards by an upper lip at the joint edge portion 4*a*, 5*a* and downwards by the respective strips 6, 6'. At the opposite edge portions 4*b*, 5*b*, there is an upper recess 18 which defines a locking tongue 20 coacting with the recess or tongue groove 16 (see FIG. 2*a*).

FIGS. 1*a*–1*c* show how two long sides 4*a*, 4*b* of two such boards 1, 1' on a base U can be joined with each other by downward angling by pivoting about a center C close to the intersection between the surface plane HP and the joint plane VP, while the boards are held essentially in contact with each other.

FIGS. 2*a*–2*c* show how the short sides 5*a*, 5*b* of the boards 1, 1' can be joined together by snap action. The long sides 4*a*, 4*b* can be joined by means of both methods, whereas the joining of the short sides 5*a*, 5*b*—after laying of the first row of floorboards—is normally carried out merely by snap action after the long sides 4*a*, 4*b* have first been joined.

When a new board 1' and a previously laid board 1 are to be joined along their long side edge portions 4*a*, 4*b* according to FIGS. 1*a*–1*c*, the long side edge portion 4*b* of the new board 1' is pressed against the long side edge portion 4*a* of the previously laid board 1 according to FIG. 1*a*, so that the locking tongue 20 is inserted into the recess or tongue groove 16. The board 1' is then angled down towards the subfloor U according to FIG. 1*b*. The locking tongue 20 enters completely the recess or tongue groove 16 while at the same time the locking element 8 of the strip 6 snaps into the locking groove 14. During this downward angling, the upper part 9 of the locking element 8 can be operative and perform guiding of the new board 1' towards the previously laid board 1.

In their joined position according to FIG. 1*c*, the boards 1, 1' are certainly locked in the D1 direction as well as the D2 direction along their long side edge portions 4*a*, 4*b*, but the boards 1, 1' can be displaced relative to each other in the longitudinal direction of the joint along the long sides (i.e. direction D3).

FIGS. 2*a*–2*c* show how the short side edge portions 5*a* and 5*b* of the boards 1, 1' can be joined mechanically in the D1 as well as the D2 direction by the new board 1' being displaced essentially horizontally towards the previously laid board 1. This can in particular be carried out after the long side of the new board 1' has been joined, by inward angling according to FIGS. 1*a*–*c*, with a previously laid board 1 in an adjoining row. In the first step in FIG. 2*a*, beveled surfaces of the recess 16 and the locking tongue 20 cooperate so that the strip 6' is forced downwards as a direct consequence of the bringing-together of the short side edge portions 5*a*, 5*b*. During the final bringing-together, the strip 6' snaps up when the locking element 8' enters the locking groove 14', so that the operative locking surfaces 10, 10' on the locking element 8' and in the locking groove 14' engage each other.

By repeating the operations shown in FIGS. 1*a*–*c* and 2*a*–*c*, the entire floor can be laid without glue and along all joint edges. Thus, prior-art floorboards of the above type can be joined mechanically by first, as a rule, being angled downwards on the long side and by the short sides, when the long side has been locked, being snapped together by horizontal displacement of the new board 1' along the long side of the previously laid board 1 (direction D3). The boards 1, 1' can, without the joint being damaged, be taken up again in reverse order of laying and then be laid once more. Parts of these laying principles are applicable also in connection with the present invention.

To function optimally and to allow easy laying and taking-up again, the prior-art boards should, after being joined, along their long sides be able to take a position where there is a possibility of a minor play between the operative locking surface 10 of the locking element and the operative locking surface 10' of the locking groove 14. However, no play is necessary in the actual butt joint between the boards in the joint plane VP close to the upper side of the boards (i.e. in the surface plane HP). For such a position to be taken, it may be necessary to press one board against the other. A more detailed description of this play is to be found in WO 9426999. Such a play can be in the order of 0.01–0.05 mm between the operative locking surfaces 10, 10' when pressing the long sides of adjoining boards against each other. This play facilitates entering of the locking element 8 in the locking groove 14, 14' and its leaving the same. As mentioned, however, no play is required in the joint between the boards, where the surface plane HP and the joint plane VP intersect at the upper side of the floorboards.

The joint system enables displacement along the joint edge in the locked position after joining of an optional side. Therefore laying can take place in many different ways which are all variants of the three basic methods:

Angling of long side and snapping in of short side.

Snapping in of long side—snapping in of short side

Angling of short side, upward angling of two boards, displacement of the new board along the short side edge of the previous board and, finally, downward angling of two boards.

The most common and safest laying method is that the long side is first angled downwards and locked against another floorboard. Subsequently, a displacement in the locked position takes place towards the short side of a third floorboard, so that the snapping-in of the short side can take place. Laying can also be made by one side, long side or short side, being snapped together with another board. Then a displacement in the locked position takes place until the other side snaps together with a third board. These two methods require snapping-in of at least one side. However, laying can also take place without snap action. The third alternative is that the short side of a first board is angled inwards first towards the short side of a second board, which is already joined on its long side with a third board. After this joining-together, the first and the second board are slightly angled upwards. The first board is displaced in the upwardly angled position along its short side until the upper joint edges of the first and the third board are in contact with each other, after which the two boards are jointly angled downwards.

The above-described floorboard and its locking system have been very successful on the market in connection with laminate floors which have a thickness of about 7 mm and an aluminum strip 6 having a thickness of about 0.6 mm. Similarly, commercial variants of the floorboards according to WO 9966151 shown in FIGS. 4*a* and 4*b* have been successful. However, it has been found that this technique is not particularly suited for floorboards that are made of wood-fiber-based material, especially massive wood material or glued laminated wooden material, to form parquet floors. One reason why this known technique is not suited for this type of products is the large amount of material waste that arises owing to the machining of the edge portions to form a tongue groove having the necessary depth.

To partly cope with this problem, it would be possible to use the technique which is shown in FIGS. 5*a* and 5*b* in the accompanying drawings and which is described and shown in DE-A-3343601, i.e. it would be possible to form both joint edge portions of separate elements which are attached to the long side edges. Also this technique results in high costs of aluminum sections and of the considerable machining that is required. Moreover, it is difficult to attach the sectional elements along the edges in a cost-efficient manner. However, the shown geometry does not allow mounting and dismounting without considerable play by downward and upward angling, respectively, since the components do not go clear of each other during these movements if they are manufactured with a close fit (see FIG. 5*b*).

Another known design of floorboards with a mechanical locking system is shown in FIGS. 6*a–d* in the accompanying drawings and is described and shown in CA-A-0991373. When using this mechanical locking system, all forces striving to pull the long sides of the boards apart are taken up by the locking element at the outer end of the strip (see FIG. 6*a*). When laying and taking up the floor, the material must be flexible to allow the tongue to be released by rotation about two centers at the same time. A tight fit between all surfaces makes rational manufacture and displacement in the locked position impossible. The short side 6*c* has no horizontal lock. This type of mechanical lock, however, causes a large amount of material waste owing to the design of the large locking elements.

One more known design of mechanical locking systems for boards is shown in GB-A-1430429 and FIGS. 7*a–*7*b* in the accompanying drawings. This system is basically a tongue-and-groove joint which is provided with an extra holding hook on an extended lip on one side of the tongue groove and which has a corresponding holding ridge formed on the upper side of the tongue. The system requires considerable elasticity of the lip provided with the hook, and dismounting cannot take place without destroying the joint edges of the boards. A tight fit makes manufacture difficult and the geometry of the joint causes a large amount of material waste.

Another known design of mechanical locking systems for floorboards is disclosed in DE-A-4242530. Such a locking system is also shown in FIGS. 8*a–b* in the accompanying drawings. This known locking system suffers from several drawbacks. Not only does it cause a large amount of material waste in manufacture, it is also difficult to produce in an efficient manner if high-quality joints in a high-quality floor are desired. The undercut groove forming the tongue groove can only be made by using a shank-end mill which is moved along the joint edge. It is thus not possible to use large disk-shaped cutting tools to machine the board from the side edge.

For mechanical joining of different types of boards, in particular floorboards, there are many suggestions, in which the amount of material waste is small and in which production can take place in an efficient manner also when using wood-fiber- and wood-based board materials. Thus, WO 9627721 (FIGS. 9*a–b* in the accompanying drawings) and JP 3169967 (FIGS. 10*a–b* in the accompanying drawings) disclose two types of snap joints which produce a small amount of waste but which have the drawback that they do not allow dismounting of the floorboards by upward angling. It is true that these joint systems can be made in an efficient manner using large disk-shaped cutting tools, but they have the serious drawback that dismounting by upward angling would cause so serious damage to the locking system that the boards could not be laid once more by mechanical locking.

Another known system is disclosed in DE-A-1212275 and shown in FIGS. 11*a–b* in the accompanying drawings. This known system is suited for sports floors of plastic material and cannot be manufactured by means of large disk-shaped cutting tools for forming the sharply undercut groove. Also this known system cannot be dismounted by upward angling without the material having so great elasticity that the upper and lower lips round the undercut groove are greatly deformed while being pulled apart. This type of joint is therefore not suited for floorboards that are based on wood-fiber-based material, if high-quality joints are desired.

Tongue-and-groove joints having an inclined groove and tongue have also been suggested according to U.S. Pat. No. 1,124,228. The type of joint which is shown in FIGS. 12*c–d* in the accompanying drawings, makes it possible to mount a new board by pushing it down over the obliquely upwardly directed tongue on the previously laid board. To secure the newly laid board, use is made of nails which are driven obliquely down through the board above the obliquely upwardly directed tongue. In the embodiment according to FIGS. 12*a–b*, this technique cannot be used since a dovetail joint is used. This technique certainly causes a small amount of material waste but is not at all suitable if a floating floor is to be provided, with individual floorboards which, without being damaged, are to be mounted and dismounted in a simple manner and which have high-quality joints.

DE-A-3041781 discloses and shows a locking system for joining of boards, especially for making roller-skating rings and bowling alleys of plastic material. Such a joint system is also shown in FIGS. 13*a–d* in the accompanying drawings. This system comprises an undercut longitudinal groove along one edge of the board and a projecting upwardly bent tongue along the opposite edge of the board. In cross-section, the undercut groove has a first portion which is defined by parallel surface portions and is parallel with the principal plane of the board, and a second interior portion which is trapezoidal or semi-trapezoidal (FIGS. 13*a–b* and FIGS. 13*c–d*, respectively, in the accompanying drawings). In cross-section, the tongue has two plane-parallel portions angled relative to each other, where the portion closest to the center of the board is parallel with the principal plane of the board and where the outer free portion is angled in the upward direction in correspondence with the corresponding surface portion within the trapezoidal part of the undercut groove.

The design of the tongue and groove as well as the edge portions of the board is such that when two such boards are mechanically joined, engagement is obtained between on the one hand the surface portions of the tongue and corresponding surface portions of the undercut groove along the entire upper side and outer end of the tongue as well as along the underside of the inner plane-parallel portion of the tongue and, on the other hand, between the edge surfaces of the joined boards above and below the tongue and the groove, respectively. When a new board is to be joined with a previously laid board, the new board is angled upwards at a suitable angle for insertion of the angled outer portion of the tongue into the outer plane-parallel part of the groove in the previously laid board. Subsequently the tongue is inserted into the groove while the new board is being angled downwards. Owing to the angular shape of the tongue, a considerable amount of play is necessary in the first part of the groove to allow this insertion and inward angling to be carried out. Alternatively, a considerable degree of elasticity of the floor material is necessary, which according to the document should consist of plastic material. In the laid joined position, there is engagement between the major part of the surfaces of the tongue and the undercut groove except below the upwardly angled outer portion of the tongue.

A serious drawback of the mechanical locking system according to DE-A-3041781 is that it is difficult to produce. As production method, it is suggested to use a mushroom-type shank end mill with an outer portion which generates the cross-sectionally trapezoidal inner part of the tongue groove. Such a production method is not particularly rational and besides causes great tolerance problems if the production method should be used for producing floorboards or other boards of wood material for forming wall panels or parquet floorboards having high-quality joints.

As mentioned above, a drawback of this prior-art mechanical locking system is that the insertion of the angled tongue into the groove requires a considerable amount of play between tongue and groove (see FIG. 5 in DE-A-3041781 and FIG. 13*b* in the accompanying drawings) for downward angling to take place, if there is not a considerable degree of elasticity in the board material. Moreover, such downward angling cannot be carried out while the new board and the previously laid board are brought together in such manner that they touch each other close to the upper edge of the boards above the tongue and groove respectively, so that the pivoting center of the downward angling motion is positioned at this point.

One more drawback of this prior-art mechanical locking system according to DE-A-3041781 in connection with fairly thick boards of wood material is that a displacement of the new board along the previously laid board in the laid or partly raised position is made much more difficult by the boards engaging with each other along large surface portions. Even if the machining of wooden boards or boards based on wood fiber would be carried out very accurately, these surface portions are for natural reasons not quite smooth but have projecting fibers, which significantly increase friction. When laying parquet floors or the like, long boards (frequently 2–2.4-m-long and 0.2–0.4-m-wide boards) and essentially natural materials are involved. This type of long boards warp and will therefore often deviate from a completely float shape (they have "banana" shape). In those cases, it will be still more difficult to displace a newly laid board along a previously laid board, if a mechanical locking-together of the boards also at the short sides is desired.

A further drawback of the mechanical locking system according to DE-A-3041781 is that it is not very suited in connection with high-quality floors which are made of wood materials or wood-fiber-based materials and which therefore require a tight fit in the vertical direction between tongue and groove in order to prevent creaking.

WO 9747834 discloses floorboards with different types of mechanical locking systems. The locking systems which are intended for locking together the long sides of the boards (FIGS. 2–4, 11 and 22–25 in the document) are designed so as to be mounted and dismounted by a connecting and angling movement, while most of those intended for locking together the short sides of the boards (FIGS. 5–10) are designed so as to be connected to each other by being translatorily pushed towards each other for connection by means of a snap lock, but these locking systems at the short sides of the boards cannot be dismounted without being destroyed or, in any case, damaged.

Some of the boards that are disclosed in WO 9747834 and that have been designed for connection and dismounting by an angular motion (FIGS. 2–4 in WO 9747834 and FIGS. 14*a–c* in the accompanying drawings), have at their one edge a groove and a strip projecting below the groove and extending beyond a joint plane where the upper sides of two joined boards meet. The strip is designed to coact with an essentially complementarily formed portion on the opposite edge of the board, so that two similar boards can be joined. A common feature of these floorboards is that the upper side of the tongue of the boards and the corresponding upper boundary surface of the groove are plane and parallel with the upper side or surface of the floorboards. The connection of the boards to prevent them from being pulled apart transversely of the joint plane is obtained exclusively by means of locking surfaces on the one hand on the underside of the tongue and, on the other hand, on the upper side of the lower lip or strip below the groove. These locking systems also suffer from the drawback that they require a strip portion which extends beyond the joint plane, which causes material waste also within the joint edge portion where the groove is formed.

WO 9747834 also discloses mechanical joint systems which comprise a circular-arc-shaped tongue and a correspondingly formed groove in the opposite side edge of the floorboard (cf. FIGS. 14*d*–14*e* in the accompanying drawings). When connecting such locking systems, the tip of the tongue is put towards the opening of the arcuate groove, after which downward angling is begun. In this downward angling, there is a large surface contact between all the arcuate surfaces of tongue and groove. If this type of joint system would be used for long boards of wood or wood-based material, it would be very difficult to obtain a smooth and simple bringing together. Moreover, the friction between the arcuate surfaces and between the tip of the tongue and the bottom of the groove would require considerable forces for displacement of one board along another board in their joined state. This prior-art technique is certainly better than the one disclosed in the above-mentioned DE-A-3041781, but it suffers from many drawbacks of that technique.

U.S. Pat. No. 2,740,167 (see also FIGS. 15*a–b* in the accompanying drawings) discloses parquet boards or squares which are made of wood and which at their opposite edges are formed with edge portions which are hooked into each other when laying several parquet squares in a row. One edge portion has a downwardly directed hook, and the opposite edge portion has an upwardly directed hook. To allow insertion of a new parquet board under a previously laid parquet board, the underside of the upwardly directed hook is beveled. The parquet boards that are joined at a vertical joint plane are secured merely in the horizontal direction transversely of the joint plane. To secure the boards also perpendicular to the upper side of the parquet boards, use is made of a glue layer which has been spread in advance on the base on which the parquet floor is to be arranged. A previously laid parquet board can therefore be raised again merely before the glue layer has bound. In practice this parquet floor is therefore permanently secured to the base after being laid.

CA-A-2252791 shows and describes floorboards which are formed with a specially designed groove along one long side and a complementarily formed tongue along the other long side. As shown in the patent specification and also in FIGS. 16*a–b* in the accompanying drawings, the tongue and groove are rounded and angled obliquely upwards to enable joining of one board with another by the new board being placed close to the laid one and then being simultaneously raised and angled, after which the groove is pulled down over the obliquely upwardly directed tongue during simultaneous bringing together and downward angling. Since tongue and groove are complementarily formed, it is difficult to connect and, optionally, once more pull adjoining floorboards apart. A deviation from the plane form, i.e. the existence of "banana shape", results in a further obstacle to the connecting of two such boards. The risk of damage to the tongue is therefore great, and the design also causes great frictional forces between the surfaces of the tongue and groove.

U.S. Pat. No. 5,797,237 discloses a snap lock system for joining parquet boards. In the accompanying drawings, FIG. 17*a* is a section through two joined boards, while FIG. 17*b* shows that such a known floorboard cannot be dismounted by the board being angled upwards relative to the remaining, lying floorboard. Instead, as shown in FIG. 4B in the patent specification, both the board that is to be removed and the board to which it is connected and which is to remain, must be lifted up to pull out the tongue from the groove. The system bears great resemblance with that disclosed in the above-mentioned U.S. Pat. No. 2,740,167 (FIGS. 15*a–b* in the accompanying drawings) but with the difference that a short lower lip is formed below the upper hook-shaped projection or lip. This short lower lip, however, has no joining effect since there is a gap between the underside of the tongue and the upper side of this short lip when two boards are joined. Besides, this play is necessary for the dismounting method as shown in FIG. 17*c*. Certainly, it is stated that the joint system is a snap joint, but probably the laid board is angled slightly upwards to let in the tongue under the hook-shaped lip of this board. This mechanical locking system can, as also shown in the patent specification, be manufactured with the aid of large disk-shaped cutting tools. There is no undercut groove, whose upper and lower lips abut against the inserted tongue and lock this both vertically and horizontally, in this locking system. Thus the groove has a larger vertical extent than the corresponding parts of the tongue. The laid floor will therefore be able to move towards and away from the base, which will cause creaking in the joints and unacceptable vertical displacements. Owing to the insufficient locking, a high-quality joint cannot be obtained either.

FR-A-2675174 discloses a mechanical joint system for ceramic tiles which have complementarily formed opposite edge portions, in which case use is made of separate spring clips which are mounted at a distance from each other and which are formed to grasp a bead on the edge portion of an adjoining tile. The joint system is not designed for dismounting by pivoting, which is obvious from FIG. 18*a* and, in particular, FIG. 18*b* in the accompanying drawings.

FIGS. 19*a* and 19*b* show floorboards which are formed according to JP 7180333 and are made by extrusion of metal material. After mounting, it is practically impossible to dismount such floorboards owing to the joint geometry, which is evident from FIG. 19*b*.

Finally, FIGS. 20*a* and 20*b* show another known joint system which is disclosed in GB-A-2117813 and which is intended for large insulated wall panels. This system bears great resemblance with the above-mentioned system according to CA-A-2252791 and the system from WO 9747834 as shown in FIGS. 14*d* and 14*e* in the accompanying drawings. The system suffers from the same drawbacks as these last-mentioned two systems and is not suited for efficient production of floorboards based on wood material or wood fiber material, especially if high-quality joints in a high-quality floor are desired. The construction according to this GB publication uses metal sections as connecting elements and is not openable by upward angling.

Other prior-art systems are disclosed in, for instance, DE 20013380U1, JP 2000179137A, DE 3041781, DE 19925248, DE 20001225, EP 0623724, EP 0976889, EP 1045083.

As is evident from that stated above, prior-art systems have both drawbacks and advantages. However, no locking system is quite suited for rational production of floorboards with a locking system which is optimal as regards production technique, waste of material, laying and taking-up function and which besides can be used for floors which are to have high quality, strength and function in their laid state.

An object of the present invention is to satisfy this need and provide such an optimal locking system for floorboards and such optimal floorboards. Another object of the invention is to provide a rational method of producing floorboards with such a locking system. One more object of the invention is to provide a new installation method, which allows easier and more rational laying than does prior art. Another object of the invention is to provide a tool to facilitate the laying of floorboards by upward angling and joining of floorboards. Yet another object of the invention is to provide use of such a tool for laying of floorboards. Further objects of the invention are evident from that stated above as well as from the following description.

SUMMARY OF THE INVENTION

A floorboard and an openable locking system therefor comprise an undercut groove on one long side of the floorboard and a projecting tongue on the opposite long side of the floorboard. The undercut groove has a corresponding upwardly directed inner locking surface at a distance from its tip. The tongue and the undercut groove are formed to be brought together and pulled apart by a pivoting motion, which has its center close to the intersection between the surface planes and the common joint plane of two adjoining floorboards. The undercut in the groove of such a locking system is made by means of disk-shaped cutting tools, whose rotary shafts are inclined relative to each other to form first an inner part of the undercut portion of the groove and then a locking surface positioned closer to the opening of the groove. A laying method for a floor of such boards comprises the steps of laying a new board adjacent to a previously laid board, moving the tongue of the new board into the opening of the undercut groove of the previously laid board, angling the new board upwards during simultaneous insertion of the tongue into the undercut groove and simultaneously angling down the new board to the final position.

What characterizes the locking system, the floorboard and the laying method, according to the invention is, however, stated in the independent claims. The dependent claims define particularly preferred embodiments according to the invention. Further advantages and features of the invention are also evident from the following description.

Before specific and preferred embodiments of the invention will be described with reference to the accompanying drawings, the basic concept of the invention and the strength and function requirements will be described.

The invention is applicable to rectangular floorboards having a first pair of parallel sides and a second pair of parallel sides. With a view to simplifying the description, the first pair is below referred to as long sides and the second pair as short sides. It should, however, be pointed that the invention is also applicable to boards that can be square.

High Joint Quality

By high joint quality is meant a tight fit in the locked position between the floorboards both vertically and horizontally. It should be possible to join the floorboards without very large visible gaps or differences in level between the joint edges in the unloaded as well as in the normally loaded state. In a high-quality floor, joint gaps and differences in level should not be greater than 0.2 and 0.1 mm respectively.

Downward Angling with Rotation at Joint Edge and Guiding

As will be evident from the following description, it should be possible to lock at least one side, preferably the long side, by downward angling. The downward angling should be able to take place with a rotation about a center close to the intersection between the surface planes of the floorboards and the joint plane to be made, i.e. close to the "upper joint edges" of the boards when contacting each other. Otherwise, it is not possible to make a joint which in the locked position has tight joint edges.

It should be possible to terminate the rotation in a horizontal position, in which the floorboards are locked vertically without any play, since a play may cause undesirable differences in level between the joint edges. Inward angling should also take place in a manner that simultaneously guides the floorboards towards each other with tight joint edges and straightens out any banana shape (i.e. deviation from a straight flat shape of the floorboard). The locking element and the locking groove should have guiding means which coact with each other during inward angling. The downward angling should take place with great safety without the boards getting stuck and pinching each other so as to cause a risk of the locking system being damaged.

Upward Angling about Joint Edge

It should be possible to angle the long side upwards so that the floorboards can be released. Since the boards in the starting position are joined with tight joint edges, this upward angling must thus also be able to take place with upper joint edges in contact with each other and with rotation at the joint edge. This possibility of upward angling is very important not only when changing floorboards or moving a floor. Many floorboards are trial-laid or laid incorrectly adjacent to doors, in corners etc. during installation. It is a serious drawback if the floorboard cannot be easily released without the joint system being damaged. Nor is it always the case that a board that can be angled inwards can also be angled up again. In connection with the downward angling, a slight downwards bending of the strip usually takes place, so that the locking element is bent backwards and downwards and opens. If the joint system is not formed with suitable angles and radii, the board can after laying be locked in such manner that taking up is not possible. The short side can, after the joint of the long side has been opened by upward angling, usually be pulled out along the joint edge, but it is advantageous if also the short side can be opened by upward angling. This is particularly advantageous when the boards are long, for instance 2.4 m, which makes pulling out of short sides difficult. The upward angling should take place with great safety without the boards getting stuck and pinching each other so as to cause a risk of the locking system being damaged.

Snaping-in

It should possible to lock the short sides by horizontal snapping-in. This requires that parts of the joint system be flexible and bendable. Even if inward angling of long sides is much easier and quicker than snapping-in, it is an advantage if also the long side can be snapped in, since certain laying operations, for instance round doors, require that the boards be joined horizontally.

Cost of Material at Long and Short Side

If the floorboard is, for instance, 1.2*0.2 m, each square meter of floor surface will have about six times more long side joints than short side joints. A large amount of material waste and expensive joint materials are therefore of less importance on short side than on long side.

Horizontal Strength

For high strength to be achieved, the locking element must as a rule have a high locking angle, so that the locking element does not snap out. The locking element must be high and wide so that it does not break when subjected to high tensile load as the floor shrinks in winter owing to the low relative humidity at this time of the year. This also applies to the material closest to the locking groove in the other board. The short side joint should have higher strength than the long side joint since the tensile load during shrinking in winter is distributed over a shorter joint length along the short side than along the long side.

Vertical Strength

It should be possible to keep the boards plane when subjected to vertical loads. Moreover, motion in the joint should be avoided since surfaces that are subjected to pressure and that move relative to each other, for instance upper joint edges, may cause creaking.

Displaceability

To make it possible to lock all four sides, it must be possible for a newly laid board to be displaced in the locked position along a previously laid board. This should take place using a reasonable amount of force, for instance by driving together using a block and hammer, without the joint edges being damaged and without the joint system having to be formed with visible play horizontally and vertically. Displaceability is more important on long side than on short side since the friction is there essentially greater owing to a longer joint.

Production

It should be possible to produce the joint system rationally using large rotating cutting tools having extremely good accuracy and capacity.

Measuring

A good function, production tolerance and quality require that the joint profile can be measured continuously and checked. The critical parts in a mechanical joint system should be designed in such manner that production and measurement are facilitated. It should be possible to produce them with tolerances of a few hundredths of a millimeter, and it should therefore be possible to measure them with great accuracy, for instance in a so-called profile projector. If the joint system is produced with linear cutting machining, the joint system will, except for certain production tolerances, have the same profile over the entire edge portion. Therefore the joint system can be measured with great accuracy by cutting out some samples by sawing from the floorboards and measuring them in the profile projector or a measuring microscope. Rational production, however, requires that the joint system can also be measured quickly and easily without destructive methods, for instance using gages. This is facilitated if the critical parts in the locking system are as few as possible.

Optimization of Long and Short Side

For a floorboard to be manufactured optimally at a minimum cost, long and short side should be optimized in view of their different properties as stated above. For instance, the long side should be optimized for downward angling, upward angling, positioning and displaceability, while the short side should be optimized for snapping-in and high strength. An optimally designed floorboard should thus have different joint systems on long and short side.

Possibility of Moving Transversely of Joint Edge

Wood-based floorboards and floorboards in general which contain wood fiber swell and shrink as the relative humidity changes. Swelling and shrinking usually start from above, and the surface layers can therefore move to a greater extent than the core, i.e. the part of which the joint system is formed. To prevent the upper joint edges from rising or being crushed in case of a high degree of swelling, or joint gaps from arising when drying up, the joint system should be constructed so as to allow motion that compensates for swelling and shrinking.

Drawbacks of Prior-Art Systems

FIGS. 4*a* and 4*b* show prior-art systems of the type Alloc© original and Alloc© Home with a projecting strip that can be angled and snapped together.

Prior-art joint systems according to FIGS. 9–16 can produce a mechanical joint with less waste than mechanical locking systems having a projecting and machined strip. However, all of them do not satisfy the above-mentioned requirements and do not solve the problems that the present invention intends to solve.

The snap joints according to FIGS. 7, 9, 10, 11, 12, 18, 19 cannot be locked or opened by a pivoting motion round the upper part of the joint edge, and the joints according to FIGS. 8, 11, 19 cannot be produced rationally by machining of board materials with a rotating cutting tool that has a large tool diameter.

Floorboards according to FIGS. 12*a*–*b* cannot be angled or snapped but must first be inserted by being pushed in parallel with the joint edge. The joint according to FIGS. 12*c*–*d* cannot be snapped. It may possibly be angled inward, but in that case it must be produced with too great a play in the joint system. The strength in the vertical direction is low since upper and lower engaging surfaces are parallel. The joint is also difficult to produce and to displace in the locked position since it does not contain any free surfaces. Moreover, nailing to the base is suggested, using nails which are driven obliquely into the floorboard above the tongue directed obliquely upwards.

The joint systems according to FIGS. 6*c–d*, 15*a–b* and 17*a–b* are examples of joints that have no vertical lock, i.e. allow movements perpendicular to the upper side of the boards.

The inward angling joint according to FIGS. 14*d–e* has a number of drawbacks because it is manufactured and constructed according to the principle that it should have a tight fit and that upper and lower parts of the tongue and groove follow circular arcs having their center at the upper joint edge, i.e. in the intersection between the joint and surface planes. This joint does not have the necessary guiding parts, and the joint is difficult to angle together since it has an incorrect design and too large engaging surfaces. As a result, it pinches and suffers from the so-called drawer effect during inward angling. The strength in the horizontal direction is too low, which depends on a low upper locking angle and too small angular difference between the upper and lower engaging surfaces. Moreover, the front and upper upwardly angled part of the tongue groove is too small to manage the forces that are required for a high-quality joint system. The too large contact surfaces between tongue and groove, the absence of the necessary free surfaces without contact and the requirement for a tight fit in the entire joint make lateral displacement of the floorboard along the joint edge considerably more difficult and also renders rational production with the possibility of achieving good tolerances difficult. Nor can it be snapped together horizontally.

The joint system according to FIGS. 16*a–b* has a design that does not allow it to be angled together without a considerable degree of material deformation, which is difficult to achieve in normal board materials that are suitable for floors. Also in this case, all parts of the tongue and groove are in contact with each other. This makes lateral displacement of a board in the locked position difficult or impossible. Nor is rational machining possible owing to the fact all surfaces are in contact with each other. Snapping cannot be carried out either.

The joint system according to FIGS. 6*a–b* cannot be angled together since it is constructed to move about two pivoting centers simultaneously. It has no horizontal lock in the tongue groove. All surfaces are in contact with each other with a tight fit. In practice, the joint system cannot be displaced and manufactured rationally. It is intended for use with a locking system which is shown in FIGS. 6*c–d* and is formed on the adjoining perpendicularly set edge of the board and which does not require lateral displacement for connecting purposes.

The joint system according to FIGS. 8*a–b* have a tongue groove which cannot be manufactured with rotating cutting tools having a large tool diameter. It cannot snap and is constructed to prevent, by initial stress and a tight fit adjacent to the outer vertical part of the strip, lateral displacement.

The joint system according to FIGS. 5*a–b* comprises two aluminum sections. Production with rotating cutting tools with a large tool diameter for forming the tongue groove is not feasible. The joint system is formed so that it is impossible to angle a new board inwards by its upper joint edge being held in contact with the upper joint edge of the previously laid board, so that the inward angling takes place about a pivoting center at the intersection between joint plane and surface plane. To allow inward angling when using this prior-art system, it is necessary to have a considerable play that exceeds what is acceptable in normal floorboards where high-quality, esthetically good joints are required. The joint system according to FIGS. 13*a–d* is difficult to manufacture since it requires contact over a large surface part of the outer part of the tongue and the tongue groove. This also makes lateral displacement in the locked position difficult. The joint geometry makes upward angling about the upper joint edge impossible.

The Invention

The invention is based on a first understanding that by using suitable production methods, essentially by machining and using tools whose tool diameter significantly exceeds the thickness of the board, it is possible to form advanced shapes rationally with great accuracy of wood materials, wood-based boards and plastic materials, and that this type of machining can be made in a tongue groove at a distance from the joint plane. Thus, the shape of the joint system should be adapted to rational production which should be able to take place with very narrow tolerances. Such an adaptation, however, is not allowed to take place at the expense of other important properties of the floorboard and the locking system.

The invention is also based on a second understanding, which is based on the knowledge of the requirements that must be satisfied by a mechanical joint system for optimal function. This understanding has made it possible to satisfy these requirements in a manner that has previously not been known, viz. by a combination of a) the design of the joint system with, for instance, specific angles, radii, play, free surfaces and ratios between the different parts of the system, and b) optimal utilization of the material properties of the core or core, such as compression, elongation, bending, tensile strength and compressive strength.

The invention is further based on a third understanding that it is possible to provide a joint system at a lower production cost while at the same time function and strength can be retained or even, in some cases, be improved by a combination of manufacturing technique, joint design, choice of materials and optimization of long and short sides.

The invention is based on a fourth understanding that the joint system, the manufacturing technique and the measuring technique must be developed and adjusted so that the critical parts requiring narrow tolerances should, to the greatest possible extent, be as few as possible and also be designed so as to allow measuring and checking in continuous production.

According to a first aspect of the invention, there are thus provided a locking system and a floorboard with such a locking system for mechanical joining of all four sides of this floorboard in a first vertical direction D1, a second horizontal direction D2 and a third direction D3 perpendicular to the second horizontal direction, with corresponding sides of other floorboards with identical locking systems.

The floorboards can on two sides have a disconnectible mechanical joint system, which is of a known type and which can be laterally displaced in the locked position and locked by inward angling about the upper joint edges or by horizontal snapping. The floorboards have, on the other two sides, a locking system according to the invention. The floorboards can also have a locking system according to the invention on all four sides.

At least two opposite sides of the floorboard thus have a joint system which is designed according to the invention and which comprises a tongue and a tongue groove defined by upper and lower lips, where the tongue in its outer and upper part has an upwardly directed part and where the tongue groove in its inner and upper part has an undercut. The upwardly directed part of the tongue and the undercut of the tongue groove in the upper lip have locking surfaces that counteract and prevent horizontal separation in a direction D2 transversely of the joint plane. The tongue and the tongue groove also have coacting supporting surfaces which prevent vertical separation in a direction D1 parallel with the joint plane. Such supporting surfaces are to be found at least in the bottom part of the tongue and on the lower lip of the tongue groove. In the upper part, the coacting locking surfaces can serve as upper supporting surfaces, but the upper lip of the tongue groove and the tongue can advantageously also have separate upper supporting surfaces. The tongue, the tongue groove, the locking element and the undercut are designed so that they can be manufactured by machining using tools which have a greater tool diameter than the thickness of the floorboard. The tongue can with its upwardly directed portion be inserted into the tongue groove and its undercut by an inward angling motion with its center of rotation close to the intersection between the joint plane and the surface plane, and the tongue can also leave the tongue groove if the floorboard is pivoted or angled upwards with its upper joint edge in contact with the upper joint edge of an adjoining floorboard. For the purpose of facilitating production, measurement, inward angling, upward angling and lateral displacement in the longitudinal direction of the joint and counteracting creaking and reducing any problems owing to swelling/shrinking of the floor material, the joint system is formed with surfaces which are not in contact with each other both during inward angling and in the locked position.

According to a second aspect of the invention, the floorboard has two edge portions with a joint system according to the invention, where the tongue with its upwardly directed portion both can be inserted into the tongue groove and its undercut and can leave the tongue groove by downward angling and upward angling, respectively, by the boards being kept in contact with each other with their upper joint edges close to the intersection between joint plane and surface plane, so that the pivoting takes place about a pivoting center close to this point. Moreover, the locking system can be snapped together by horizontal displacement, essentially the lower part of the tongue groove being bent and the locking element of the tongue snapping into the locking groove. Alternatively or furthermore, the tongue can be made flexible to facilitate such snapping-in at the short side after the long sides of the floorboards have been joined. Thus, the invention also relates to a snap joint which can be released by upward angling with upper joint edges in contact with each other.

According to a third aspect of the invention, the floorboard has two edge portions with a joint system which is formed according to the invention, where the tongue, while the board is held in an upwardly angled position, can be snapped into the tongue groove and then be angled down by a pivoting motion about the upper joint edge. In the upwardly angled position, the tongue can be partially inserted into the tongue groove by the board in this position being moved in a translatory movement to the tongue groove until the upper joint edges have come into contact with each other, after which downward angling takes place for final joining of tongue and tongue groove and for obtaining a locking-together. The lower lip can be shorter than the upper lip so as to enable greater degrees of freedom when designing the undercut of the upper lip.

A plurality of aspects of the invention are also applicable to the known systems without these aspects being combined with the preferred locking systems described here.

The invention also describes the basic principles that should be satisfied for a tongue-and-groove joint which is to be angled inwards with upper joint edges in contact with each other and which is to be snapped in with a minimum bending of joint components. The invention also describes how material properties can be used to achieve great strength and low cost in combination with angling and snapping as well as laying methods.

Different aspects of the invention will now be described in more detail with reference to the accompanying drawings which show different embodiments of the invention. The parts of the inventive board that are equivalent to those of the prior-art board in FIGS. 1–2 have throughout been given the same reference numerals.

BRIEF DESCRIPTION OF THE DRAWINGS

FIGS. 43*a–c* show how the joint system should be designed to facilitate snapping in.

DETAILED DESCRIPTION OF PREFERRED EMBODIMENTS

A first preferred embodiment of a floorboard 1, 1', which is provided with a mechanical locking system according to the invention, will now be described with reference to FIGS. 21*a* and 21*b*. To facilitate the understanding, the joint system is shown schematically. It should be emphasized that a better function can be achieved with other preferred embodiments that will be described below.

Figure 21A:
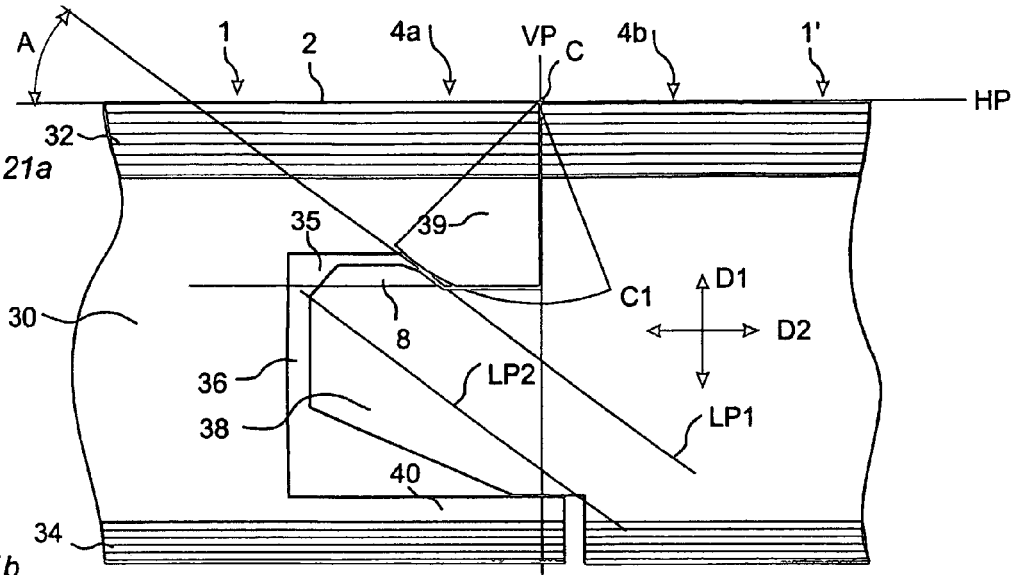
FIGS. 21*a–b* show schematically to parallel joint edge portions of a first preferred embodiment of a floorboard according to the present invention.
Figure 21B:
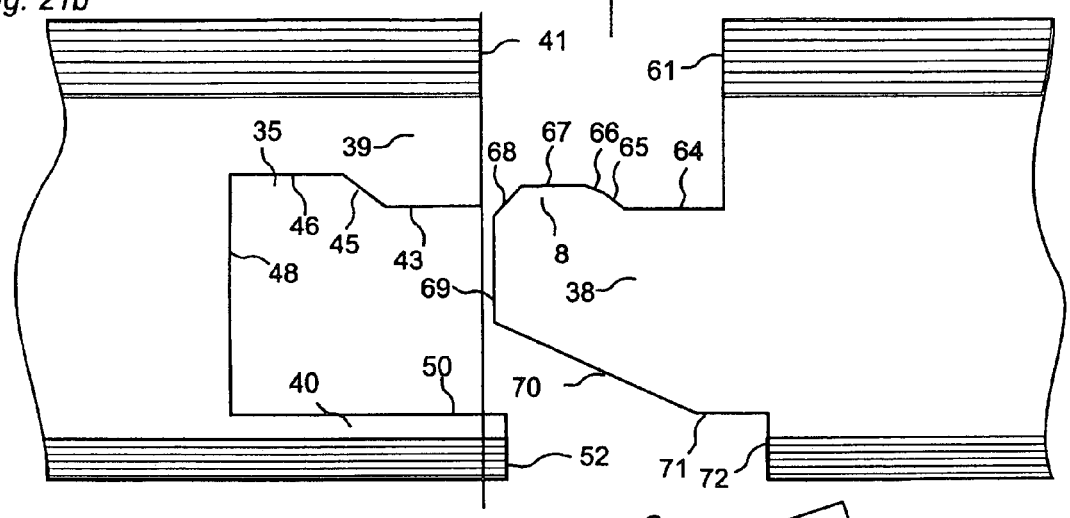

FIGS. 21*a*, 21*b* show schematically a section through a joint between a long side edge portion 4*a* of a board 1 and an opposite long side edge portion 4*b* of another board 1'.

Figure 3A:
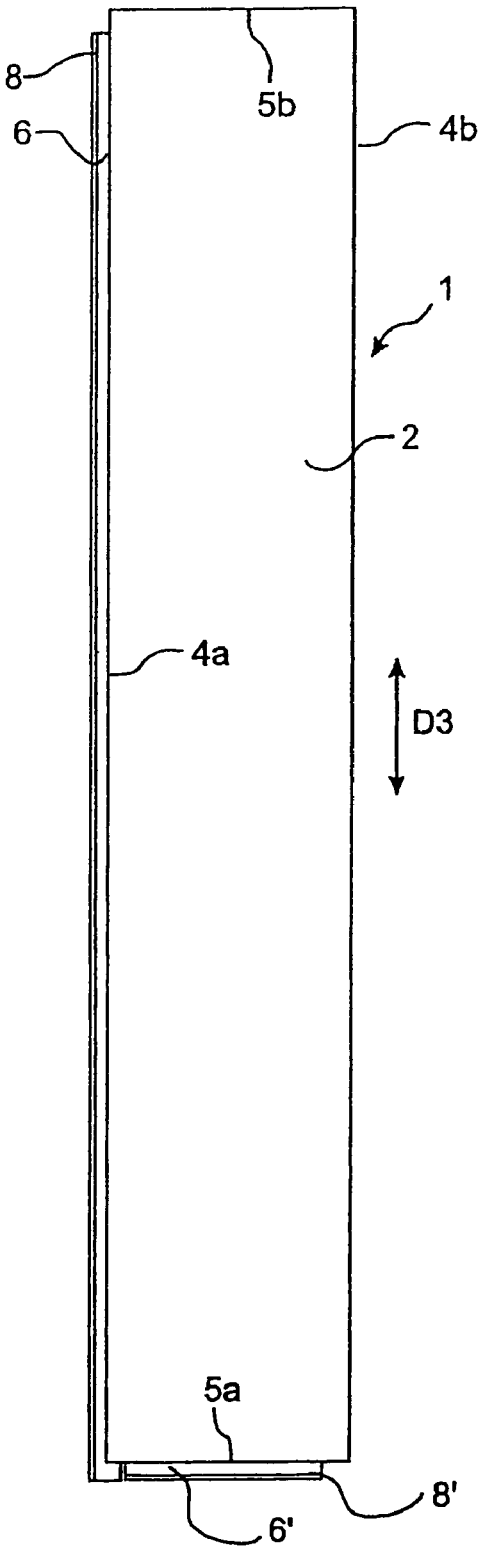
FIGS. 3*a–b* show a floorboard according to WO 9426999 seen from above and from below respectively.
Figure 3B:
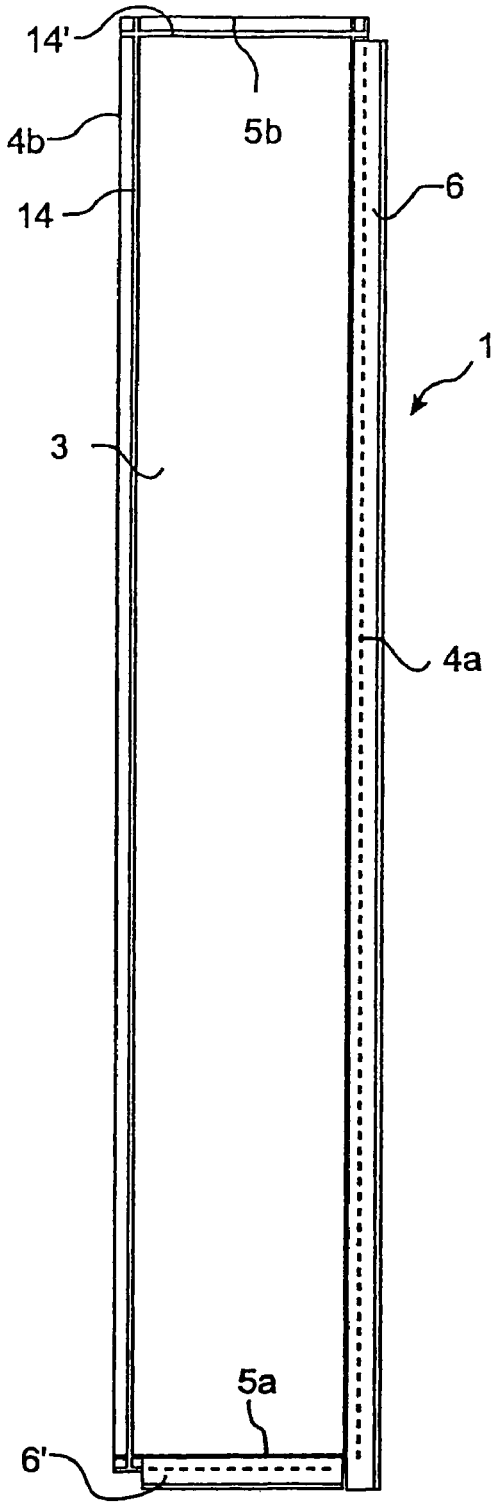
PRIOR ART Fig. 3b
Figure 4A:
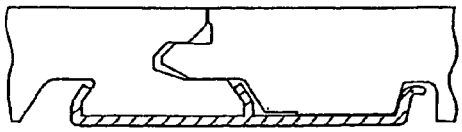
FIGS. 4*a–b* show two different embodiments of floorboards according to WO 9966151.
Figure 4B:
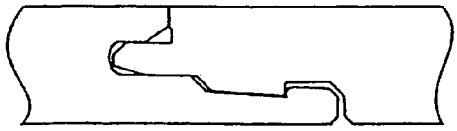
PRIOR ART Fig. 4b
Figure 5A:
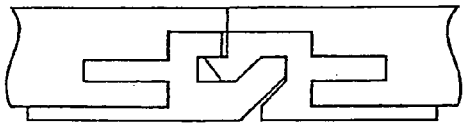
PRIOR ART Fig. 5a
FIGS. 5*a–b* show floorboards according to DE-A-3343601.
Figure 5B:
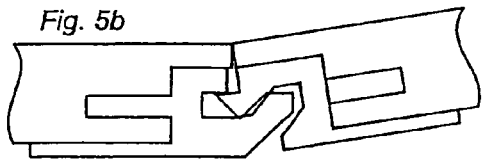
PRIOR ART Fig. 5b
Figure 6A:
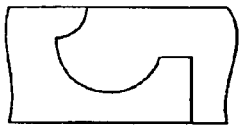
PRIOR ART Fig. 6a
FIGS. 6*a–d* show mechanical locking systems for the long side and the short side respectively of floorboards according to CA-A-0991373.
Figure 6B:
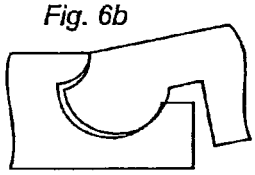
PRIOR ART Fig. 6b
Figure 6C:
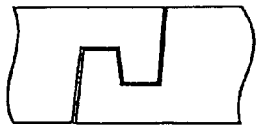
PRIOR ART Fig. 6c
Figure 6D:
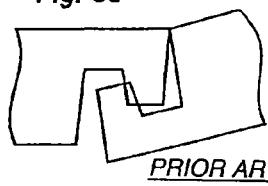
PRIOR ART Fig. 6d
Figure 7A:
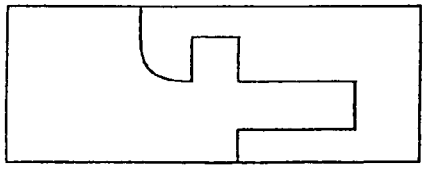
PRIOR ART Fig. 7a
FIGS. 7*a–b* show a mechanical locking system according to GB-A-1430429.
Figure 7B:
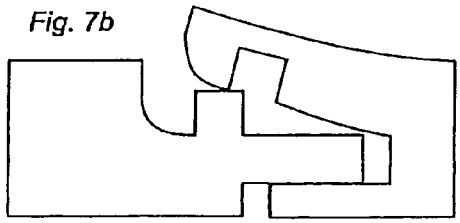
PRIOR ART Fig. 7b
Figure 8A:
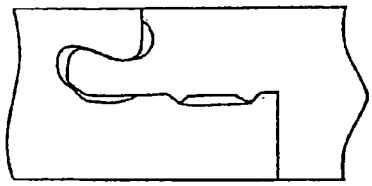
PRIOR ART Fig. 8a
FIGS. 8*a–b* show boards according to DE-A-4242530.
Figure 8B:
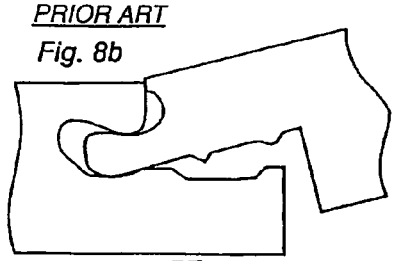
PRIOR ART Fig. 8b
Figure 9A:
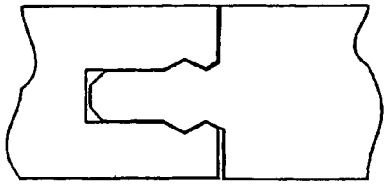
PRIOR ART Fig. 9a
FIGS. 9*a–b* show a snap joint according to WO 9627721.
Figure 9B:
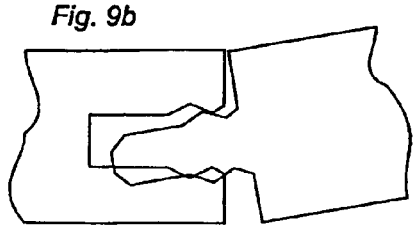
PRIOR ART Fig. 9b
Figure 10A:
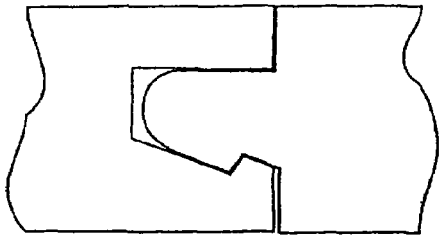
FIGS. 10*a–b* show a snap joint according to JP 3169967.
Figure 10B:
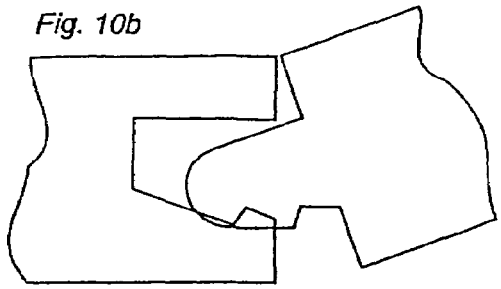
PRIOR ART Fig. 10b
Figure 11A:
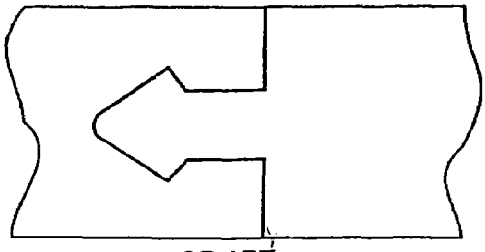
PRIOR ART Fig. 11a
FIGS. 11*a–b* show a snap joint according to DE-A-1212275.
Figure 11B:
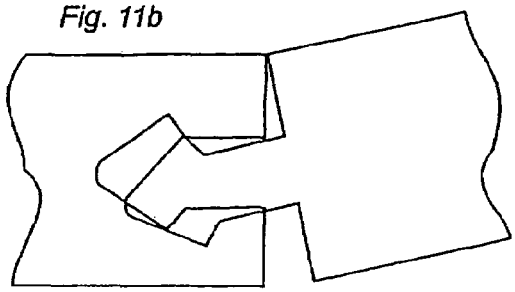
PRIOR ART Fig. 11b
Figure 12A:
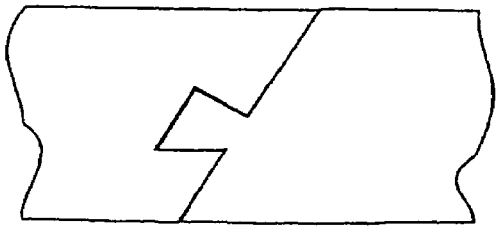
PRIOR ART Fig. 12a
FIGS. 12*a–d* show different embodiments of locking systems based on tongue and groove according to U.S. Pat. No. 1,124,228.
Figure 12B:
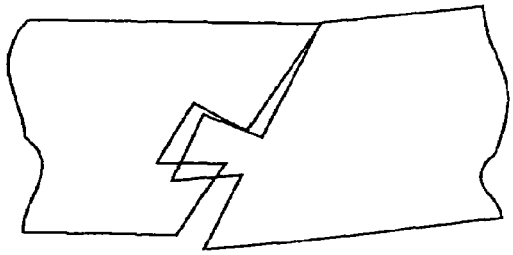
PRIOR ART Fig. 12b
Figure 12C:
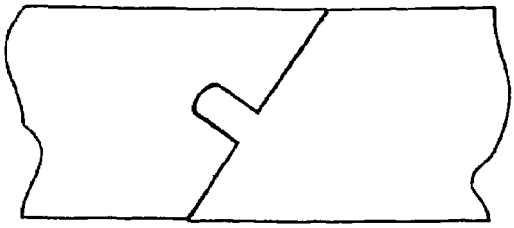
PRIOR ART Fig. 12c
Figure 12D:
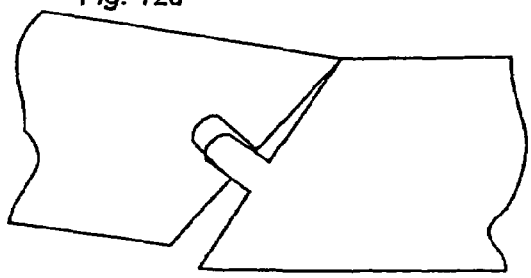
PRIOR ART Fig. 12d
Figure 13A:
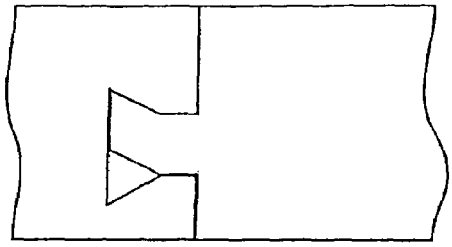
FIGS. 13*a–d* show a mechanical joint system for sport floors according to DE-A-3041781.
Figure 13B:
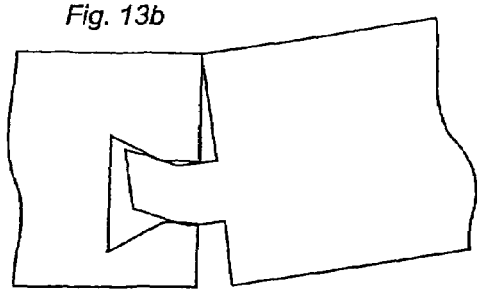
PRIOR ART Fig. 13b
Figure 13C:
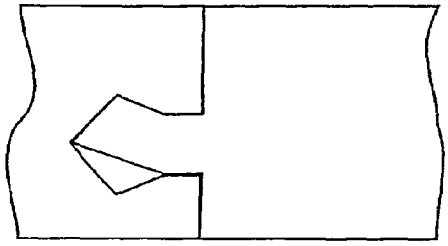
PRIOR ART Fig. 13c
Figure 13D:
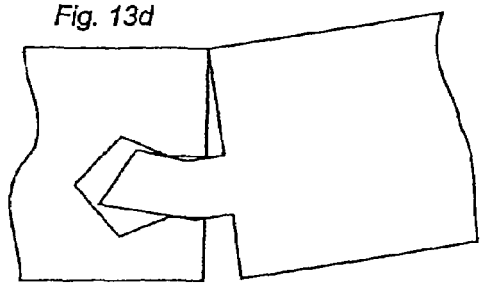
PRIOR ART Fig. 13d
Figure 14A:
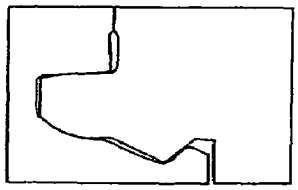
PRIOR ART Fig. 14a
FIGS. 14*a–e* show one of the locking systems as shown in WO 9747834.
Figure 14B:
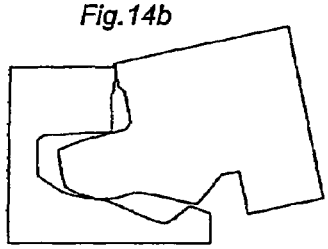
PRIOR ART Fig.14b
Figure 14C:
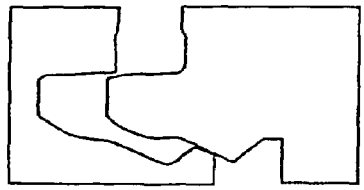
PRIOR ART Fig. 14c
Figure 14D:
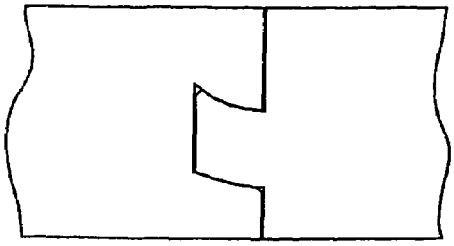
PRIOR ART Fig. 14d
Figure 14E:
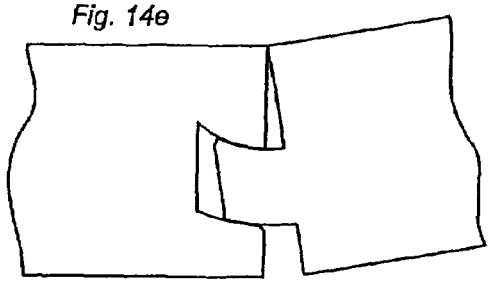
PRIOR ART Fig. 14e
Figure 15A:
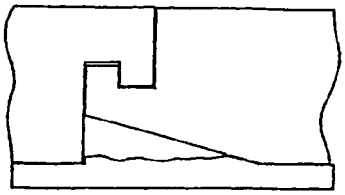
FIGS. 15*a–b* show a parquet floor according to U.S. Pat. No. 2,740,167.
Figure 15B:
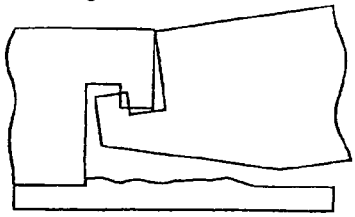
PRIOR ART Fig. 15b
Figure 16A:
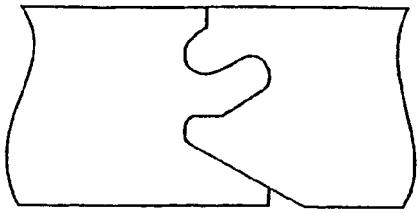
PRIOR ART Fig. 16a
FIGS. 16*a–b* show a mechanical locking system for floorboards according CA-A-2252791.
Figure 16B:
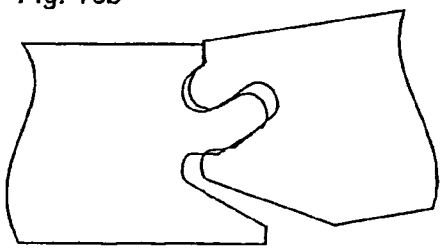
PRIOR ART Fig. 16b
Figure 17A:
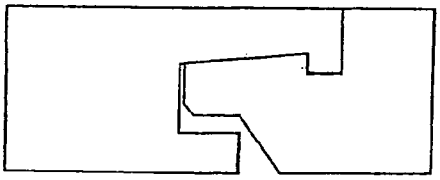
PRIOR ART Fig. 17a
FIGS. 17*a–b* show a snap-lock system for parquet floors according to U.S. Pat. No. 5,797,237.
Figure 17B:
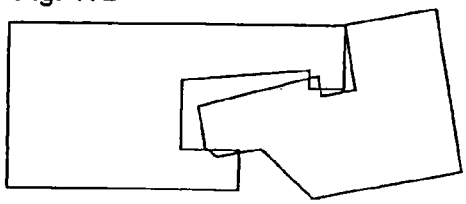
PRIOR ART Fig. 17b
Figure 18A:
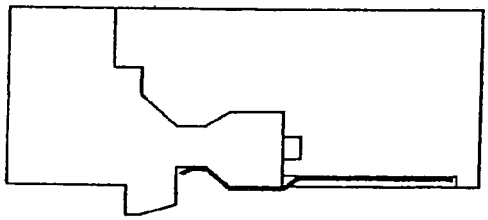
PRIOR ART Fig. 18a
FIGS. 18*a–b* show a joint system for ceramic tiles according to FR-A-2675174.
Figure 18B:
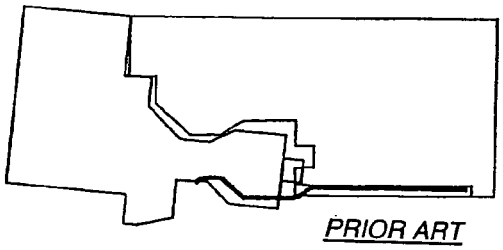
PRIOR ART Fig. 18b
Figure 19A:
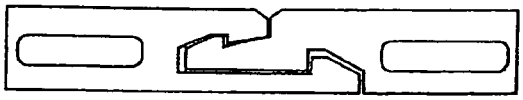
PRIOR ART Fig. 19a
FIGS. 19*a–b* show a joint system for floorboards which are described in JP 7180333 and are made by extrusion of metal material.
Figure 19B:
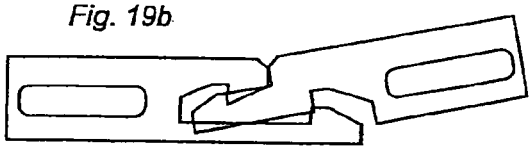
PRIOR ART Fig. 19b
Figure 20A:
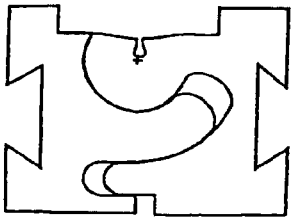
PRIOR ART Fig. 20a
FIGS. 20*a–b* show a joint system for large wall panels according to GB-A-2117813.
Figure 20B:
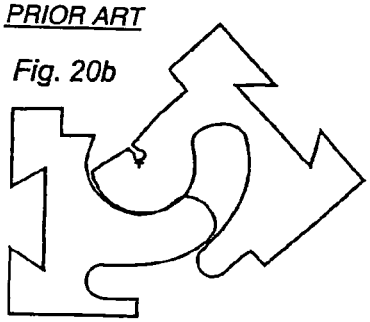
PRIOR ART Fig. 20b

The upper sides of the boards are essentially positioned in a common surface plane HP and the upper parts of the joint edge portions 4*a*, 4*b* engage each other in a vertical joint plane VP. The mechanical locking system results in locking of the boards relative to each other in both the vertical direction D1 and the horizontal direction D2 which extends perpendicular to the joint plane VP. During the laying of a floor with juxtaposed rows of boards, one board (1'), however, can be displaced along the other board (1) in a direction D3 (see FIG. 3*a*) along the joint plane VP. Such a displacement can be used, for instance, to provide locking-together of floor-boards that are positioned in the same row.

To provide joining of the two joint edge portions perpendicular to the vertical plane VP and parallel with the horizontal plane HP, the edges of the floorboard have in a manner known per se a tongue groove 36 in one edge portion 4*a* of the floorboard inside the joint plane VP, and a tongue 38 formed in the other joint edge portion 4*b* and projecting beyond the joint plane VP.

In this embodiment the board 1 has a core or core 30 of wood which supports a surface layer of wood 32 on its front side and a balancing layer 34 on its rear side. The board 1 is rectangular and has a second mechanical locking system also on the two parallel short sides. In some embodiments, this second locking system can have the same design as the locking system of the long sides, but the locking system on the short sides can also be of a different design according to the invention or be a previously known mechanical locking system.

As an illustrative, non-limiting example, the floorboard can be of parquet type with a thickness of 15 mm, a length of 2.4 m and a width of 0.2 m. The invention, however, can also be used for parquet squares or boards of a different size.

The core 30 can be of lamella type and consist of narrow wooden blocks of an inexpensive kind of wood. The surface layer 32 may have a thickness of 3–4 mm and consist of a decorative kind of hardwood and be varnished. The balancing layer 34 of the rear side may consist of a 2 mm veneer layer. In some cases, it may be advantageous to use different types of wood materials in different parts of the floorboard for optimal properties within the individual parts of the floorboard.

As mentioned above, the mechanical locking system according to the invention comprises a tongue groove 36 in one joint edge portion 4*a* of the floorboard, and a tongue 38 on the opposite joint edge portion 4*b* of the floorboard.

The tongue groove 36 is defined by upper and lower lips 39, 40 and has the form of an undercut groove with an opening between the two lips 39, 40.

The different parts of the tongue groove 36 are best seen in FIG. 21*b*. The tongue groove is formed in the core or core 30 and extends from the edge of the floorboard. Above the tongue groove, there is an upper edge portion or joint edge surface 41 which extends up to the surface plane HP. Inside the opening of the tongue groove, there is an upper engaging or supporting surface 43 which in this case is parallel with the surface plane HP. This engaging or supporting surface passes into an inclined locking surface 45 which has a locking angle A to the horizontal plane HP. Inside the locking surface, there is surface portion 46 which forms the upper boundary surface of the undercut portion 35 of the tongue groove. The tongue groove further has a bottom end 48 which extends down to the lower lip 40. On the upper side of this lip there is an engaging or supporting surface 50. The outer end of the lower lip has a joint edge surface 52 and extends in this case slightly beyond the joint plane VP.

The shape of the tongue is also best seen in FIG. 21*b*. The tongue is made of the material of the core or core 30 and extends beyond the joint plane VP when this joint edge portion 4*b* is mechanically joined with the joint edge portion 4*a* of an adjoining floorboard. The joint edge portion 4*b* also has an upper edge portion or upper joint edge surface 61 which extends along the joint plane VP down to the root of the tongue 38. The upper side of the root of the tongue has an upper engaging or supporting surface 64 which in this case extends to an inclined locking surface 65 of an upwardly directed portion 8 close to the tip of the tongue. The locking surface 65 passes into a guiding surface portion 66 which ends in an upper surface 67 of the upwardly directed portion 8 of the tongue. After the surface 67 follows a bevel which may serve as a guiding surface 68. This extends to the tip 69 of the tongue. At the lower end of the tip 69 there is a further guiding surface 70 which extends obliquely downwards to the lower edge of the tongue and an engaging or supporting surface 71. The supporting surface 71 is intended to coact with the supporting surface 50 of the lower lip when two such floorboards are mechanically joined, so that their upper sides are positioned in the same surface plane HP and meet at a joint plane VP directed perpendicular thereto, so that the upper joint edge surface 41, 61 of the boards engage each other. The tongue has a lower joint edge surface 72 which extends to the underside.

In this embodiment there are separate engaging or supporting surface 43, 64 in the tongue groove and on the tongue, respectively, which in the locked state engage each other and coact with the lower supporting surfaces 50, 71 on the lower lip and on the tongue, respectively, to provide the locking in the direction D1 perpendicular to the surface plane HP. In other embodiments, which will be described below, use is made of the locking surfaces 45, 65 both as locking surfaces for locking together in the direction D2 parallel with the surface plane HP and as supporting surfaces for counteracting movements in the direction D2 perpendicular to the surface plane. In the embodiment according to FIGS. 21*a*, 2*b*, the locking surfaces 45, 65 and the engaging surfaces 43, 64 coact as upper supporting surfaces in the system.

As is apparent from the drawing, the tongue 38 extends beyond the joint plane VP and has an upwardly directed portion 8 at its free outer end or tip 69. The tongue has also a locking surface 65 which is formed to coact with the inner locking surface 45 in the tongue groove 36 of an adjoining floorboard when two such floorboards are mechanically joined, so that their front sides are positioned in the same surface plane HP and meet at a joint plane VP directed perpendicular thereto.

As is evident from FIG. 21*b*, the tongue 38 has a surface portion 52 between the locking surface 51 and the joint plane VP. When two floorboards are joined, the surface portion 52 engages the surface portion 45 of the upper lip 8. To facilitate insertion of the tongue into the undercut groove by inward angling or snapping-in, the tongue can, as shown in FIGS. 21*a*, 21*b*, have a bevel 66 between the locking surface 65 and the surface portion 57. Moreover, a bevel 68 can be positioned between the surface portion 57 and the tip 69 of the tongue. The bevel 66 may serve as a guiding part by having a lower angle of inclination to the surface plane than the angle of inclination A of the locking surfaces 43, 51.

The supporting surface 71 of the tongue is in this embodiment essentially parallel with the surface plane HP. The tongue has a bevel 70 between this supporting surface and the tip 69 of the tongue.

According to the invention, the lower lip 40 has a supporting surface 50 for coaction with the corresponding supporting surface 71 on the tongue 36 at a distance from the bottom end 48 of the undercut groove. When two floorboards are joined with each other, there is engagement both between the supporting surfaces 50, 71 and between the engaging or supporting surface 43 of the upper lip 39 and the corresponding engaging or supporting surface 64 of the tongue. In this way, locking of the boards in the direction D1 perpendicular to the surface plane HP is obtained.

According to the invention, at least the major part of the bottom end 48 of the undercut groove, seen parallel with the surface plane HP, is located further away from the joint plane VP than is the outer end or tip 69 of the tongue 36. By this design, manufacture is simplified to a considerable extent, and displacement of one floorboard relative to another along the joint plane is facilitated.

Another important feature of a mechanical locking system according to the invention is that all parts of the portions of the lower lip 40 which are connected with the core 30, seen from the point C, where the surface plane HP and the joint plane VP intersect, are located outside a plane LP2. This plane is located further away from said point C than a locking plane LP1 which is parallel with the plane LP2 and which is tangent to the coacting locking surfaces 45, 65 of the undercut groove 36 and the tongue 38, where these locking surfaces are most inclined relative to the surface plane HP. Owing to this design, the undercut groove can, as will be described in more detail below, be made by using large disk-shaped rotating cutting tools for machining of the edge portions of the floorboards.

A further important feature of a locking system according to the present invention is that the upper and lower lips 39, 40 and tongue 38 of the joint edge portions 4*a*, 4*b* are designed to enable disconnection of two mechanically joined floorboards by one floorboard being pivoted upwards relative to the other about a pivoting center close to the point of intersection C between the surface plane HP and the joint plane VP, so that the tongue of this floorboard is pivoted out of the undercut groove of the other floorboard.

In the embodiment according to FIGS. 21*a*, 21*b*, such disconnection is made possible by a slight downward bending of the lower lip 40. In other more preferred embodiments of the invention, no downward bending of the lower lip, however, is required in conjunction with connection and disconnection of the floorboards.

In the embodiment according to FIGS. 21*a*, 21*b*, the joining of two floorboards according to the invention can be carried out in three different ways.

One way involves that the board 1' is placed on the base and moved towards the previously laid board 1' until the narrow tip 69 of the tongue 38 has been inserted into the opening of the undercut groove 36. Then the floorboard 1' is angled upwards so that the upper parts 41, 61 of the boards on both sides of the joint plane VP contact each other. While maintaining this contact, the board is angled downwards by pivoting about the center of pivoting C. The insertion takes place by the bevel 66 of the tongue sliding along the locking surface 45 of the upper lip 39 while at the same time the bevel 70 of the tongue 38 slides against the outer edge of the upper side of the lower lip 40. The locking system can then be opened by the floorboard 1' being angled upwards by pivoting about the center of pivoting C close to the intersection between the surface plane HP and the joint plane VP.

The second way of locking-together is provided by moving the new board with its joint edge portion 4*a* formed with a tongue groove towards the joint edge portion 4*b*, provided with a tongue, of the previously laid board. Then the new board is pivoted upwards until contact is obtained between the upper parts 41, 61 of the boards close to the intersection between surface plane and joint plane, after which the board is pivoted downwards to bring tongue and groove together until the final locked position is achieved. According to the following description, the floorboards can also be joined by one board being moved in an upwardly angled position towards the other.

A third way of providing joining of the floorboards in this embodiment of floorboards according to the invention involves that the new board 1' is displaced horizontally towards the previously laid board 1, so that the tongue 38 with its locking element or upwardly directed portion 8 is inserted into the tongue groove 36, the lower flexible lip 40 being bent slightly downwards for the locking element 8 to snap into the undercut portion 35 of the tongue groove. Also in this case, disconnection takes place by upward angling as described above.

In connection with snapping-in, also a small degree of upward bending of the upper lip 39 can take place as can also a certain degree of compression of all the parts in the groove 36 and the tongue 38 which during snapping-in are in contact with each other. This facilitates snapping-in and can be used to form an optimal joint system.

To facilitate manufacture, inward angling, upward angling, snapping-in and displaceability in the locked position and to minimize the risk of creaking, all surfaces that are not operative to form a joint with tight upper joint edges and to form the vertical and horizontal joint so as not to be in contact with each other in the locked position and preferably also during locking and unlocking. This allows manufacture without requiring high tolerances in these joint portions and reduces the friction in lateral displacement along the joint edge. Examples of surfaces or parts of the joint system that should not be in contact with each other in the locked position are 46–67, 48–69, 50–70 and 52–72.

The joint system according to the preferred embodiment may consist of several combinations of materials. The upper lip 39 can be made of a rigid and hard upper surface layer 32 and a softer lower part which is part of the core 30. The lower lip 40 can consist of the same softer upper part 30 and also a lower soft part 34 which can be another kind of wood. The directions of the fibers in the three kinds of wood may vary. This can be used to provide a joint system which utilizes these material properties. The locking element is therefore according to the invention positioned closer to the upper hard and rigid part, which thus is flexible and compressible to a limited extent only, while the snap function is formed in the softer lower and flexible part. It should be pointed that the joint system can also be made in a homogeneous floorboard.

Figure 22:
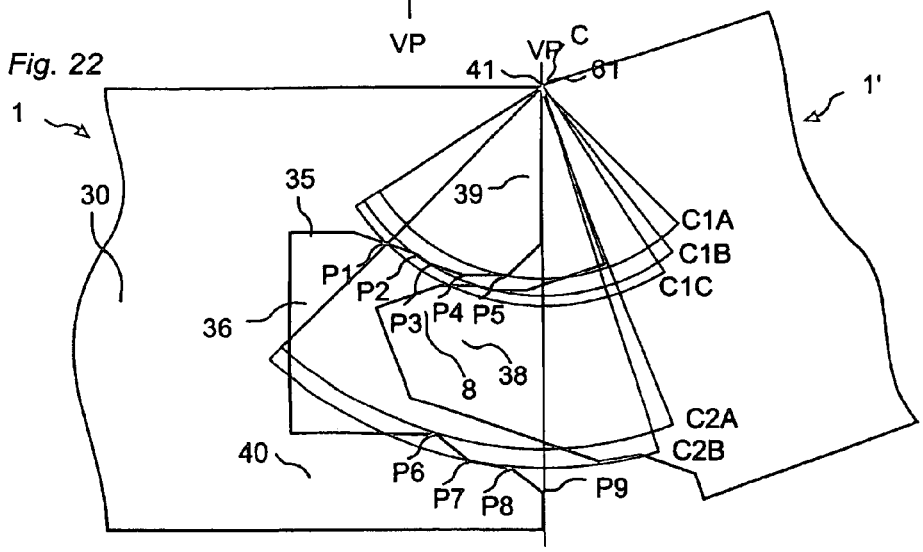
FIG. 22 shows schematically the basic principles of inward angling about upper joint edges when using the present invention.

FIG. 22 shows schematically the basic principles of inward angling about a point C (upper joint edges) when using the present invention. FIG. 22 shows schematically how a locking system should be designed to enable inward angling about the upper joint edges. In this inward angling, the parts of the joint system follow in prior-art manner a circular arc with is center C close to the intersection between the surface plane HP and the joint plane VP. If a great play between all parts of the joint system is allowed, or if essential deformation during inward angling is possible, the tongue and groove can be formed in many different ways. If, on the other hand, the joint system must have contact surfaces that prevent vertical and horizontal separation without any play between the engaging or supporting surfaces and if material deformation is not possible, the joint system should be constructed according to the following principles.

The upper part of the joint system is formed as follows. C1B is a circular arc which has it center C at the top at the upper joint edges 41, 61 and which in this preferred embodiment intersects a contact point between the upper lip 39 and the upper part of the tongue 38 at the point P2. All the other contact points between P2, P3, P4 and P5 between the upper lip 39 and the upper part 8 of the tongue 38 and between this point of intersection P2 and the vertical plane VP are positioned on or inside this circular arc C1B, whereas all other contact points from P2 to P1 between the upper lip 39 and the upper part of the tongue 38 and between this point of intersection P2 and the outer part of the tongue 38 are positioned on or outside this circular arc C1B. These conditions should be satisfied for all contact points. Regarding the contact point P5 with the circular arc C1A, the case is that all other contact points between P1 and P5 are positioned outside the circular arc C1A, and regarding the contact point P1, all other contact points between P1 and P5 are positioned inside the circular arc C1C.

The lower part of the joint system is formed according to the corresponding principles. C2B is a circular arc which is concentric with the circular arc C1A and which in this preferred embodiment intersects a contact point between the lower lip 40 and the lower part of the tongue 38 at the point P7. All the other contact points between P7, P8 and P9 between the lower lip 40 and the lower part of the tongue 38 and between this point of intersection P7 and the vertical plane are positioned on or outside the circular arc C2B, and all other contact points between P6, P7 and between the lower lip 40 and the lower part of the tongue 38 and between this point of intersection P7 and the outer part of the tongue 38 are positioned on or inside this circular arc C2B. The same applies to the contact point P6 with the circular arc C2A.

A joint system constructed according to this preferred embodiment may have good inward angling properties. It can easily be combined with upper engaging or supporting surfaces 43, 64 which can be parallel with the horizontal plane HP and which can thus provide excellent vertical locking.

Figure 1A:
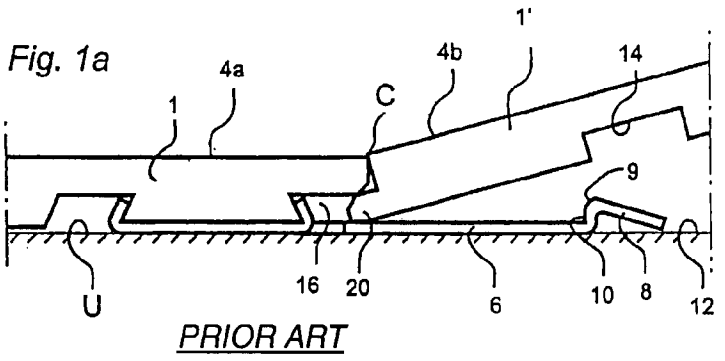
FIGS. 1*a–c* show in three steps a downward angling method for mechanical joining of long sides of floorboards according to WO 9426999.
Figure 1B:
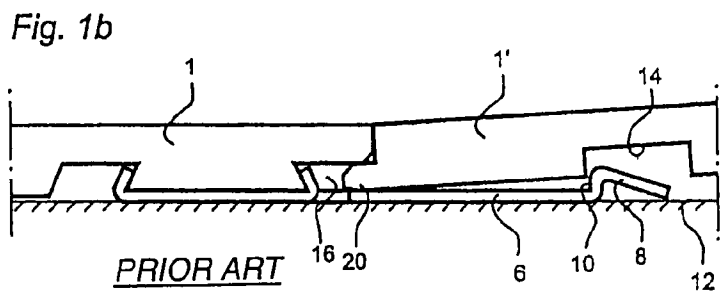
Figure 1C:
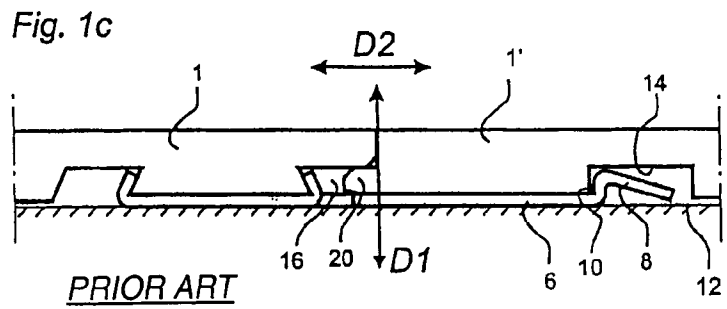
Figure 2A:
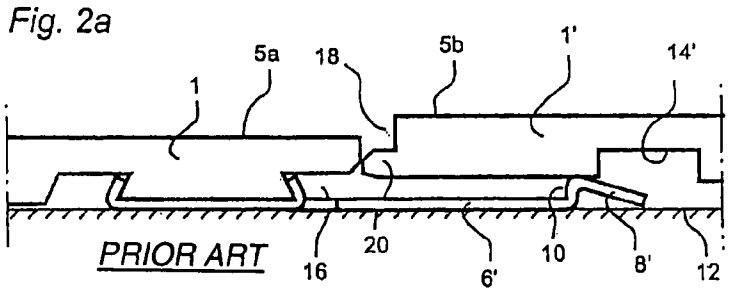
FIGS. 2*a–c* show in three steps a snapping-in method for mechanical joining of short sides of floorboards according to WO 9426999.
Figure 2B:
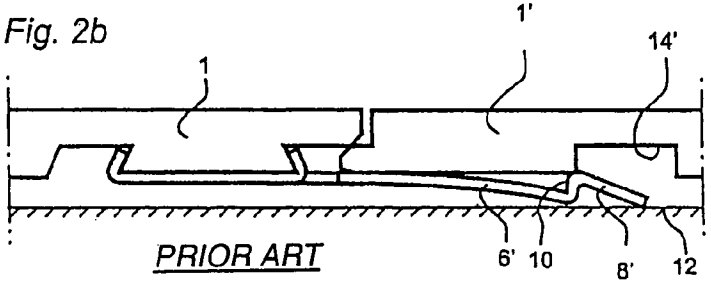
Figure 2C:
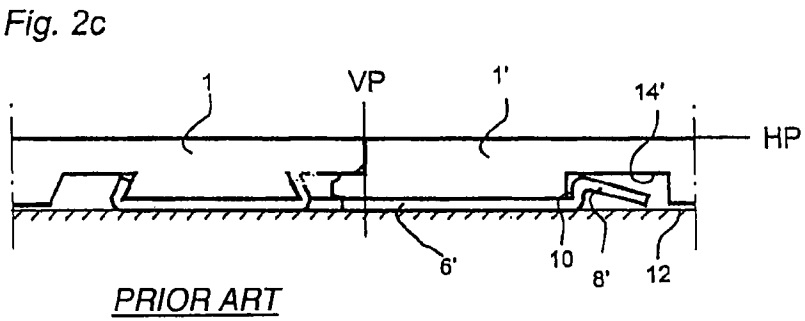
Figure 23A:
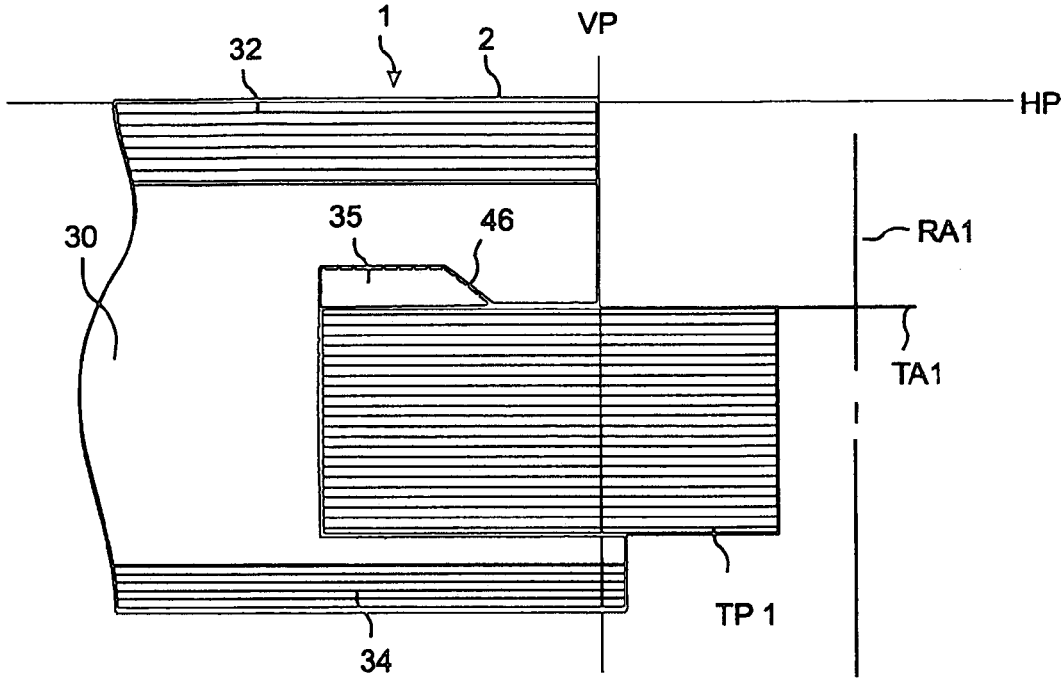
FIGS. 23*a–b* show schematically the production of a joint edge of a floorboard according to the invention.
Figure 23B:
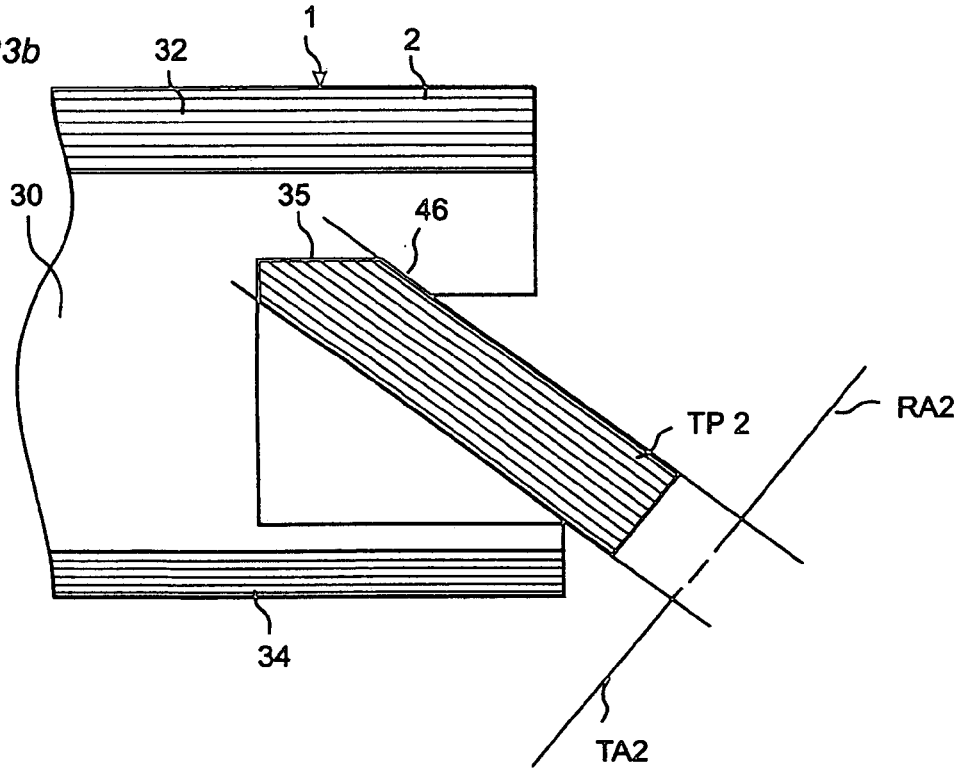

FIGS. 23*a*, 23*b* show how a joint system according to FIGS. 21*a*, 2*b* can be produced. Normally, the floorboard 1 according to prior art is positioned with its surface 2 downwards on a ball bearing chain in a milling machine which conveys the board with extremely great accuracy past a number of milling cutters which, for instance, have a tool diameter of 80–300 mm and which can be set at an optional angle to the horizontal plane of the board. To facilitate the understanding and the comparison with the other drawings figures, the floorboard, however, is shown with its surface plane HP directed upwards. FIG. 23*a* shows how the first tool with the tool position TP1 makes a traditional tongue groove. The tool operates in this case at a tool angle TA1 which is $0_C$, i.e. parallel with the horizontal plane. The axis of rotation RA1 is perpendicular to HP. The undercut is made by means of a second tool, where the position TP2 and the design of the tool are such that the undercut 35 can be formed without the tool affecting the shape of the lower lip 40. In this case, the tool has an angle TA2 which is equal to the angle of the locking surface 45 in the undercut 35. This manufacturing method is possible by the locking plane LP1 being located at such a distance from the joint plane that the tool can be inserted into the previously formed tongue groove. The thickness of the tool therefore cannot exceed the distance between the two planes LP1 and LP2, as discussed in connection with FIGS. 21*a* and 21*b*. This manufacturing method is prior-art technique and does not constitute part of the manufacturing method according to the present invention as will be described below.

Figure 24A:
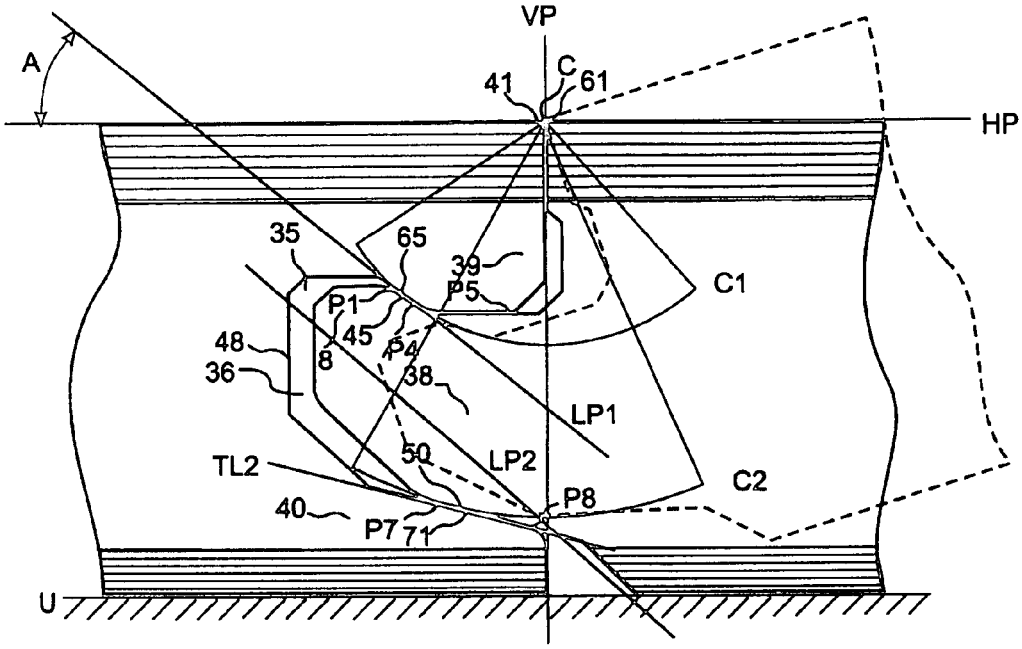
FIGS. 24*a–b* show a production-specific variant of the invention.
Figure 24B:
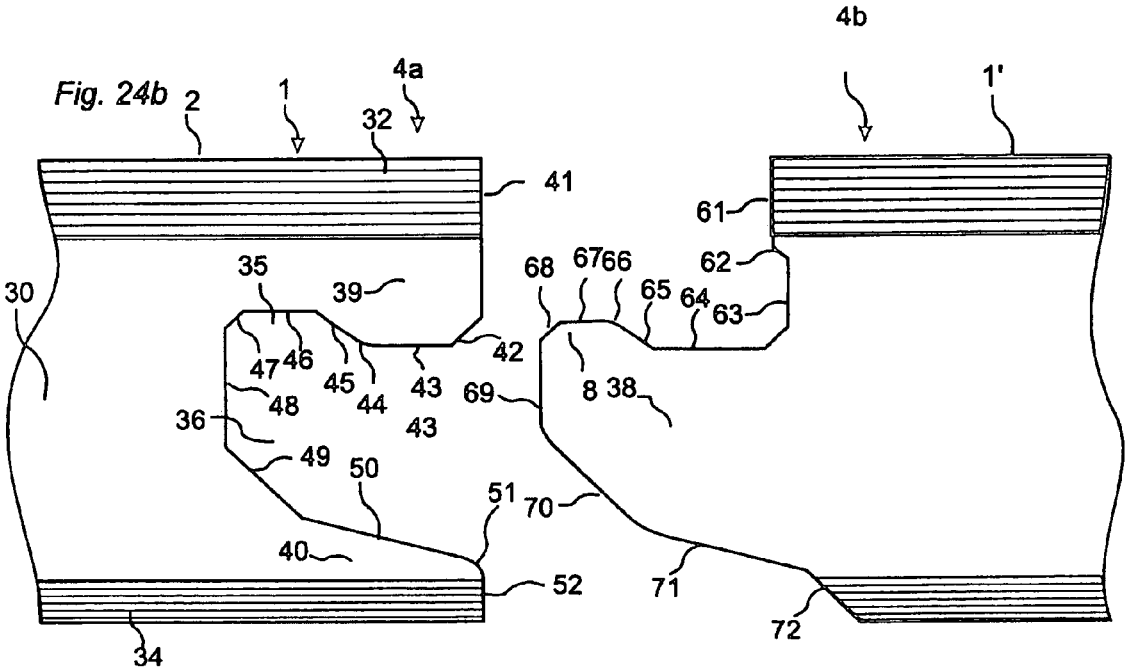

FIGS. 24*a*, 24*b* show another variant of the invention. This embodiment is characterized in that the joint system is formed completely according to the basic principle of inward angling about the upper joint edges as described above. The locking surfaces 45, 65 and the lower supporting surfaces 50, 71 are in this embodiment plane, but they can have a different shape. C1 and C2 are two circular arcs with their center C at the upper end of adjoining joint edges 41, 61. The smaller circular arc C1 is tangent to the lower contact point closest to the vertical plane between the locking surfaces 45, 65 at the point P4 which has the tangent TL1 corresponding to the locking plane LP1. The locking surfaces 45, 65 have the same inclination as this tangent. The greater circular arc 62 is tangent to the upper contact point between the lower supporting surfaces 50, 71 closest to the inner part 48 of the tongue groove at the point P7, which has the tangent TL2. The supporting surfaces 50, 71 have the same inclination as this tangent.

All the contact points between the tongue 38 and the upper lip 39 which are positioned between the point P4 and the vertical plane VP satisfy the condition that they are positioned inside or on the circular arc C1, while all contact points which are positioned between P4 and the inner part 48 of the tongue groove—in this embodiment only the locking surfaces 45, 65—satisfy the condition that they are positioned on or outside C1. The corresponding conditions are satisfied for the contact surfaces between the lower lip 40 and the tongue 38. All contact points between the tongue 38 and the lower lip 40 which are positioned between the point P7 and the vertical plane VP—in this case only the lower supporting surfaces 50, 71—are positioned on or outside the circular arc C2, while all contact points which are positioned between the point P7 and the inner part 48 of the tongue groove, are positioned on or inside the circular arc C2. In this embodiment there are no contact points between P7 and the inner part 48 of the tongue groove.

This embodiment is characterized in particular in that all contact surfaces between the contact point P4 and the joint plane VP, in this case the point P5, and the inner part 48 of the tongue groove, respectively, are positioned inside and outside, respectively, the circular arc C1 and thus not on the circular arc C1. The same applies to the contact point P7 where all contact points between P7 and the vertical plane VP, in this case the point P8, and the inner part 48 of the tongue groove, respectively, are positioned outside and inside, respectively, the circular arc C2 and thus not on the circular arc C2. As is evident from the part indicated by broken lines in FIG. 24*a*, the joint system can, if this condition is satisfied, be designed so that inward angling can take place with clearance during essentially the entire angular motion which can be terminated by the boards being locked with a tight fit or with a press fit when they have taken their final horizontal position. Thus, the invention enables a combination of an inward angling and upward angling without resistance and a locking with high joint quality. If the lower supporting surfaces 71, 50 are made with a somewhat lower angle, a joint system can be provided, where only the two above-mentioned points P4 on the upper lip and P7 on the lower part of the tongue are contact points between the tongue groove 36 and the tongue 38 during the entire inward angling until final locking takes place, and during the entire upward angling until the boards can be released from each other. Locking with clearance or with only line contact is a great advantage since the friction will be low and the boards can easily be angled inward and angled upward without parts of the system getting stuck and pinching each other with a risk of the joint system being damaged. A press fit especially in the vertical direction is very important for the strength. If there is play between the engaging or supporting surfaces, the boards will, when subjected to tensile load, slide along the locking surfaces until the lower engaging or supporting surfaces have taken a position with a press fit. Thus a play will result in both a joint gap and differences in level between upper joint edges. As an example, it may be mentioned that with a tight fit or press fit, high strength can be achieved if the locking surfaces have an angle of about $40_C$ to the surface plane HP and if the lower engaging or supporting surfaces have an angle of about $15_C$ to the surface plane HP.

The locking plane LP1 has in FIG. 24*a* a locking angle A to the horizontal plane HP of about $39_C$, while the supporting plane TL2 along the supporting surfaces 50, 71 has a supporting angle VLA of about $14_C$. The difference in angle between LP1 and the supporting plane TL2 is $25_C$. A high locking angle and a great difference in angle between locking angle and supporting angle should be strived for since this results in a great horizontal locking force. The locking surfaces and the supporting surfaces can be made arcuate, stepped, with several angles etc, but this makes manufacture difficult. As mentioned above, the locking surfaces may also constitute upper supporting surfaces or be complements to separate upper supporting surfaces.

Even if the locking surfaces and supporting surfaces have contact points that deviate somewhat from these basic principles, they can be angled inward at their upper joint edges if the joint system is adjusted so that its contact points or surfaces are small in relation to the floor thickness and so that the properties of the board material in the form of compression, elongation and bending are used maximally in combination with very small plays between the contact surfaces. This can be used to increase the locking angle and the difference in angle between locking angle and supporting angle.

The basic principle of inward angling thus shows that the critical parts are the locking surfaces 45, 65 and the lower supporting surfaces 50, 71. It also shows that the degree of freedom is great as regards designing of the other parts, for instance the upper supporting surfaces 43, 64, the guiding 44 of the locking groove, the guiding 66 and the top surface 67 of the locking element 8, the inner parts 48, 49 of the tongue groove 36 and the lower lip 40, the guiding and the outer part 51 of the lower lip as well as outer/lower parts 69, 70, 72 of the tongue. These should preferably deviate from the shape of the two circular arcs C1 and C2, and between all parts except the upper supporting surfaces 43, 64 there can be free spaces, so that these parts in the locked position as well as during inward angling and upward angling are not in contact with each other. This facilitates manufacture significantly since these parts can be formed without great tolerance requirements, and it contributes to safe inward angling and upward angling and also lower friction in connection with lateral displacement of joined boards along the joint plane VP (direction D3). By free spaces is meant joint parts that do not have any functional meaning to prevent vertical or horizontal displacement and displacement along the joint edge in the locked position. Thus, loose wood fibers and small deformable contact points should be considered equivalent to free surfaces.

Angling about the upper joint edge can, as mentioned above, be facilitated if the joint system is constructed so that there can be a small play between above all said locking surfaces 45, 65 if the joint edges of the boards are pressed together. The construction play also facilitates lateral displacement in the locked position, reduces the risk of creaking and gives greater degrees of freedom in manufacture, allows inward angling with locking surfaces that have a greater inclination than the tangent LP1 and contribute to compensating for swelling of upper joint edges. The play gives considerably smaller joint gaps at the upper side of the boards and considerably smaller vertical displacements than would a play between the engaging or supporting surfaces, above all owing to this play being small and also owing to the fact that a sliding in the tensile-loaded position will follow the angle of the lower supporting surface, i.e. an angle which is essentially smaller than the locking angle. This minimal play, if any, between the locking surfaces can be very small, for instance only 0.01 mm. In the normal joined position the play can be non-existent, i.e. 0, the joint system can be constructed so that a play appears only in maximal pressing together of the joint edges of the boards. It has been found that also a greater play of about 0.05 mm will result in a very high joint quality, since the joint gap which is to be found in the surface plane HP and which may arise in the tensile-loaded position is hardly visible.

It should be pointed out that the joint system can be constructed without any play between the locking surfaces.

Play and material compression between the locking surfaces and bending of joint parts at the locking surfaces can easily be measured indirectly by the joint system being subjected to tensile load and the joint gap at the upper joint edges 41, 61 being measured at a predetermined load which is less than the strength of the joint system. By strength is meant that the joint system is not broken or does not snap out. A suitable tensile load is about 50% of the strength. As a non-limiting standard value, it may be mentioned that a long side joint should normally have a strength exceeding 300 kg per running meter of joint. Short side joints should have still greater strength. A parquet floor with a suitable joint system according to the invention can withstand a tensile load of 1000 kg per running meter of joint. A high-quality joint system should have a joint gap at the upper joint edges 41, 61 of about 0.1–0.2 mm when subjected to tensile load with approximately half the maximum strength. The joint gap should decrease when the load ceases. By varying the tensile load, the relationship between construction play and material deformation can be determined. In case of lower tensile load, the joint gap is essentially a measure of the construction play. In case of a higher load, the joint gap increases owing to material deformation. The joint system can also be constructed with built-in initial stress and a press fit between locking surfaces and supporting surfaces, so that the above-mentioned joint gap is not visible in case of the above-mentioned load.

The geometry of the joint system, play between the locking surfaces in combination with compression of the material round the upper joint edges 41, 61 can also be measured by the joint being sawn up transversely of the joint edge. Since the joint system is manufactured with linear machining, it will have the same profile along its entire joint edge. The only exception is manufacturing tolerances in the form of lack of parallelism owing to the fact that the board can optionally be turned or displaced vertically or horizontally as it passes different milling tools in the machine. Normally seen, the two samples from each joint edge, however, give a very reliable picture of what the joint system looks like. After grinding the samples and cleaning them of loose fibers so that a sharp joint profile is to be seen, they can be analyzed as regards joint geometry, material compression, bending etc. The two joint parts can, for instance, be compressed by means of a force which is such as not to damage the joint system, above all the upper joint edges 41, 61. The play between the locking surfaces and the joint geometry can then be measured in a measuring microscope with an accuracy of 0.01 mm or less according to equipment. If stable and modem machines are used in manufacture, it is as a rule sufficient to measure the profile in two smaller areas of a floorboard to determine the average play, joint geometry etc.

All measuring should take place when the floorboards are conditioned at a normal relative humidity of about 45%.

Also in this case, the locking element or the upwardly directed portion 8 of the tongue has a guiding part 66. The guiding part of the locking element comprises parts having an inclination which is lower than the inclination of the locking surface and, in this case, also the inclination of the tangent TL1. A suitable degree of inclination of the tool that produces the locking surface 45 is indicated by TA2 which in this embodiment is equal to the tangent TL1.

Also the locking surface 45 of the tongue groove has a guiding part 44 which coacts with the guiding part 66 of the tongue during inward angling. Also this guiding part 44 comprises parts that have a smaller inclination than the locking surface.

In the front part of the lower lip 40, there is a rounded guiding part 51, which coacts with the radius in the lower part of the tongue in connection with the lower engaging surface 71 at the point P7 and which facilitates inward angling.

The lower lip 40 can be resilient. In connection with inward angling, a small degree of compression can also take place of the contact points between the lower parts of the tongue 38 and the lower lip 40. As a rule, this compression is significantly smaller than may be the case for the locking surfaces since the lower lip 40 can have considerably better resilience properties than the upper lip 39 and the tongue 38, respectively. In connection with inward angling and upward angling, the lip can thus be bent downwards. A bending capacity of merely one tenth of a millimeter or somewhat more gives, together with material compression and small contact surfaces, good chances of forming, for instance, the lower supporting surfaces 50, 71, so that they can have an inclination which is smaller than the tangent TL2 while at the same time inward angling can easily be made. A flexible lip should be combined with a relatively high locking angle.

If the locking angle is low, a large amount of the tensile load will press the lip downward, which results in undesirable joint gaps and differences in level between the joint edges.

Both the tongue groove 36 and the tongue 38 have guiding parts 42, 51 and 68, 70 which guide the tongue into the groove and facilitate snapping-in and inward angling.

Figure 25:
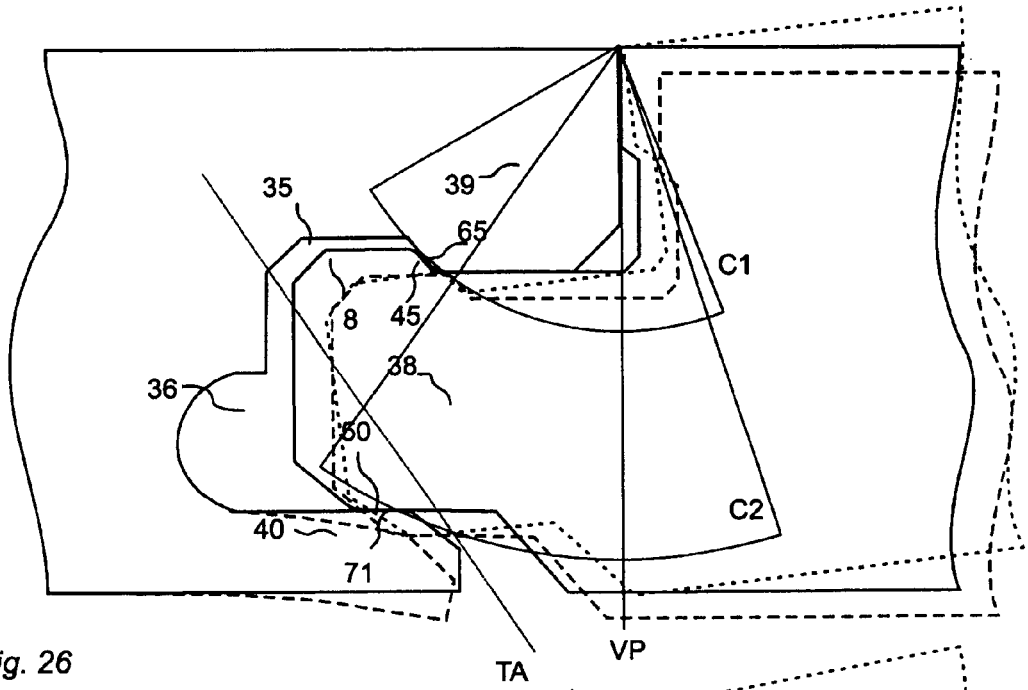
FIG. 25 shows a variant of the invention as well as snapping-in and upward angling in combination with bending of the lower lip.

FIG. 25 illustrates variants of the invention, where the lower lip 40 is shorter than the upper lip 39 and thus is positioned at a distance from the vertical plane VP. The advantage is that there will be greater degrees of freedom in designing the locking groove 45 with a high tool angle TA while at the same time relatively large tools can be used. To facilitate snapping-in by downward bending of the lower lip 40, the tongue groove 36 has been made deeper than is required by the space for the tip of the tongue 38. The dash-dotted joint edge portion 4*b* shows how the parts of the system are related to each other in connection with inward angling about the upper joint edge, while the dashed joint edge portion 4*b* shows how the parts of the system are related to each other in connection with snapping-in of the tongue into the tongue groove by displacement of the joint edge portion 4*b* straight towards the joint edge portion 4*a*.

Figure 26:
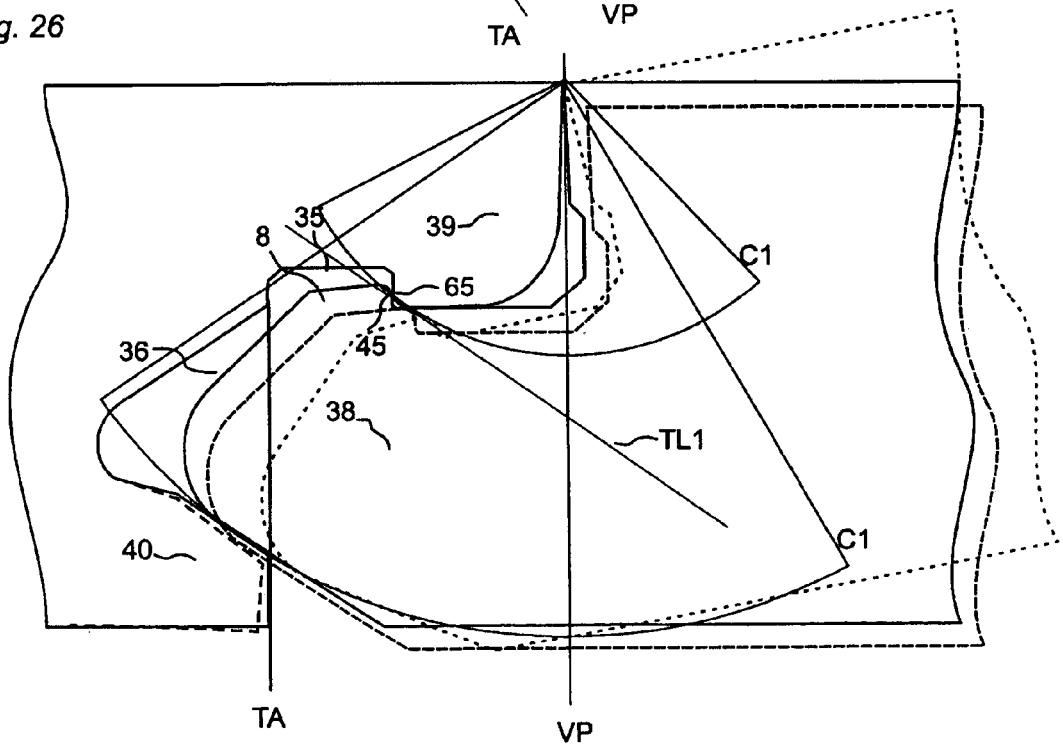
FIG. 26 shows a variant of the invention with a short lip.

FIG. 26 shows a further variant of the above-mentioned basic principles. The joint system is here formed with locking surfaces which are angled at $90_C$ to the surface plane HP and which are considerably more angled than the tangent TL1. Such a preferred locking system, however, is openable by upward angling by the locking surfaces being extremely small and by the joint locking essentially only by line contact. If the core is hard, such a locking system can give high strength. The design of the locking element and the locking surfaces allows snapping-in with only a small degree of downward bending of the lower lip, as indicated by means of dashed lines.

Figure 27A:
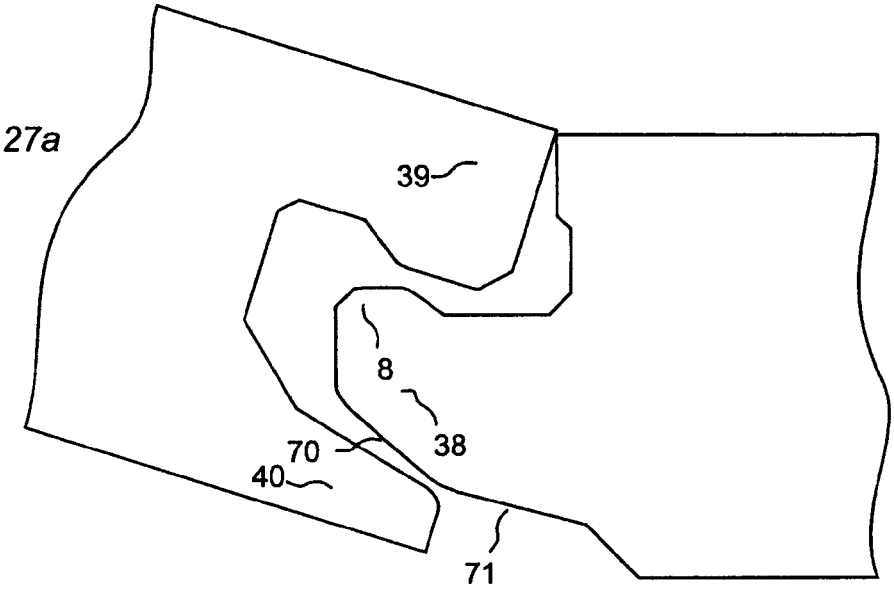
FIGS. 27*a–c* show a downward and upward angling method.
Figure 27B:
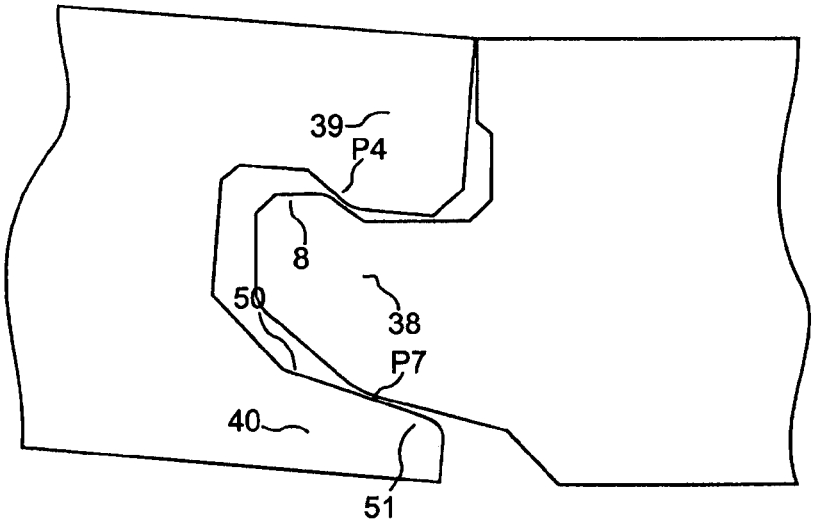
Figure 27C:
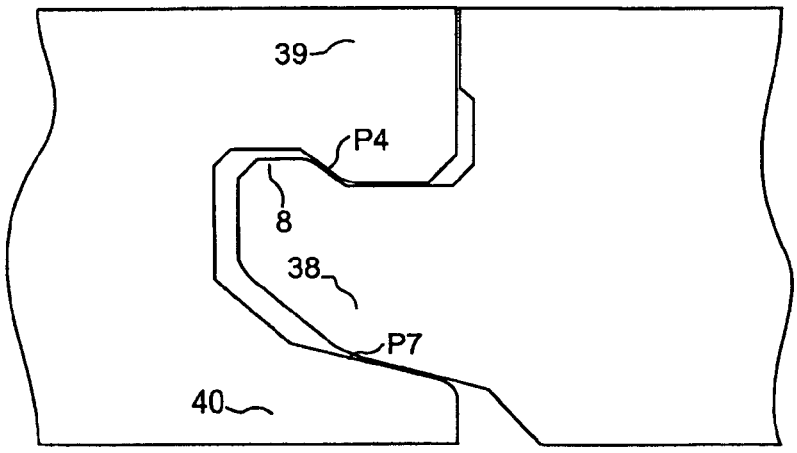

FIGS. 27*a–c* show a laying method by inward angling. To facilitate the description, one board is referred to as groove board and the other as tongue board. In practice, the boards are identical. A possible laying method involves that the tongue board lies flat on the subfloor either as a loose board or joined with other boards on one, two or three sides, depending on where in the laying sequence/row it is positioned. The groove board is placed with its upper lip 39 partly over the outer part of the tongue 38, so that the upper joint edges are in contact with each other. Then the groove board is turned down towards the subfloor while being pressed against the joint edge of the tongue board until final locking takes place according to FIG. 27*c*.

The sides of floorboards sometimes have a certain degree of bending. The groove board is then pressed and turned downwards until parts of the upper lip 39 are in contact with parts of the upwardly directed portion or locking element 8 of the tongue and parts of the lower lip 40 are in contact with parts of the lower part of the tongue. In this manner, any bending of the sides can be straightened, and then the boards can be angled to their final position and locked.

FIGS. 27*a–c* show that the inward angling can take place with clearance, or alternatively merely contact between the upper part of the tongue groove and the tongue or with line contact between the upper and lower parts of the tongue and the tongue groove. Line contact can in this embodiment arise at points P4 and P7. Inward angling can easily take place without considerable resistance and can be terminated with a very close fit that locks the floorboards in the final position with high joint quality vertically and horizontally.

Summing up, the downward angling can in practice be carried out as follows. The groove board is moved at an angle towards the tongue board, the tongue groove being passed over part of the tongue. The groove board is pressed towards the tongue board and angled gradually downwards using, for instance, compression in the center of the board and, after that, on both edges. When the upper joint edges over the entire board are close to each other or in contact with each other, and the board has taken a certain angle to the subfloor, the final downward angling can be made.

When the boards have been joined, they can be displaced in the locked position in the joint direction, i.e. parallel with the joint edge.

Figure 28A:
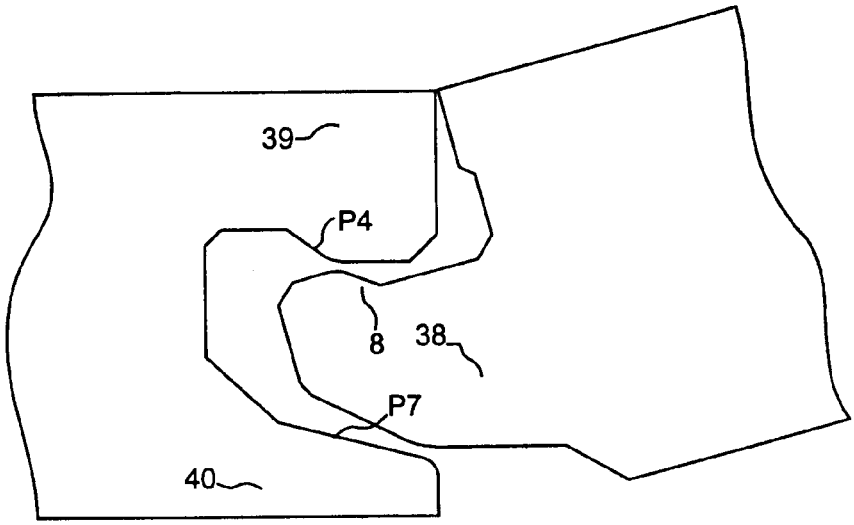
FIGS. 28*a–c* show an alternative angling method.
Figure 28B:
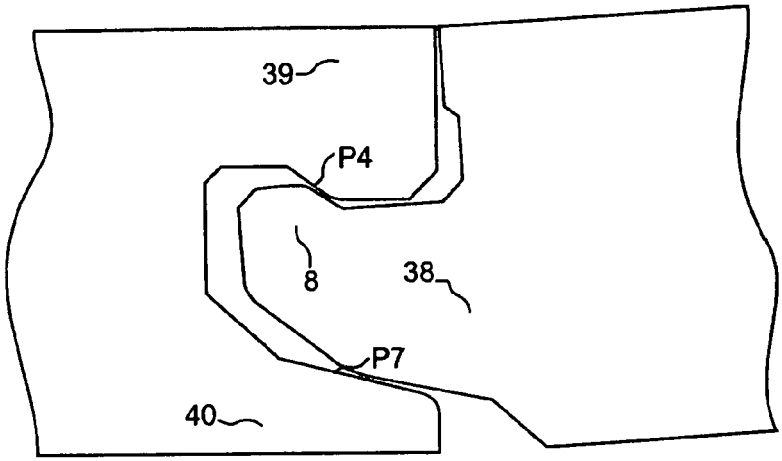
Figure 28C:
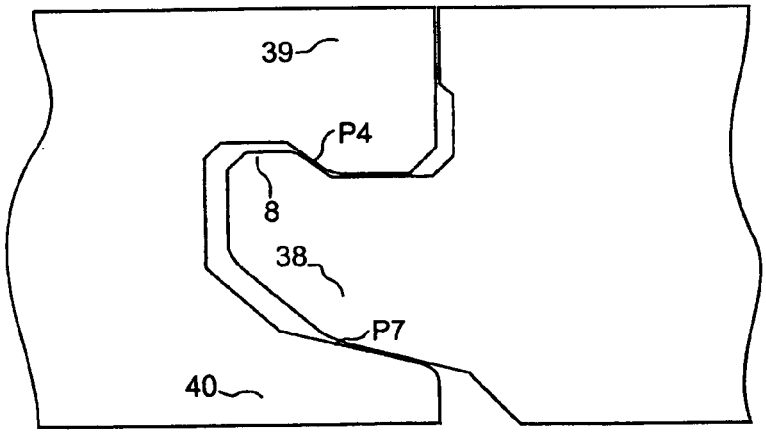

FIGS. 28*a–c* show how a corresponding laying can be carried out by the tongue board being angled into groove board.

Figure 29A:
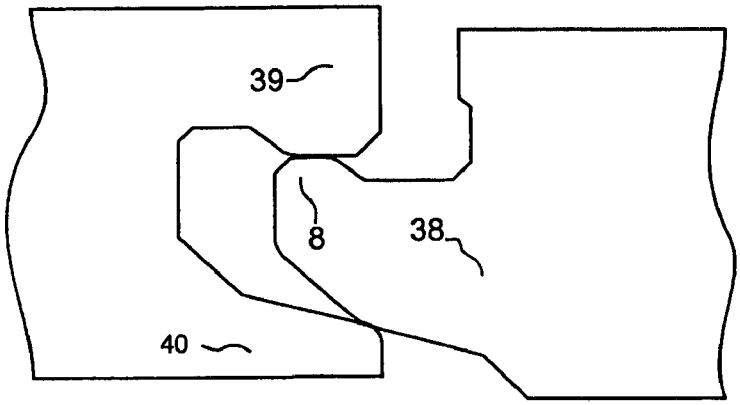
FIGS. 29*a–b* show a snapping-in method.
Figure 29B:
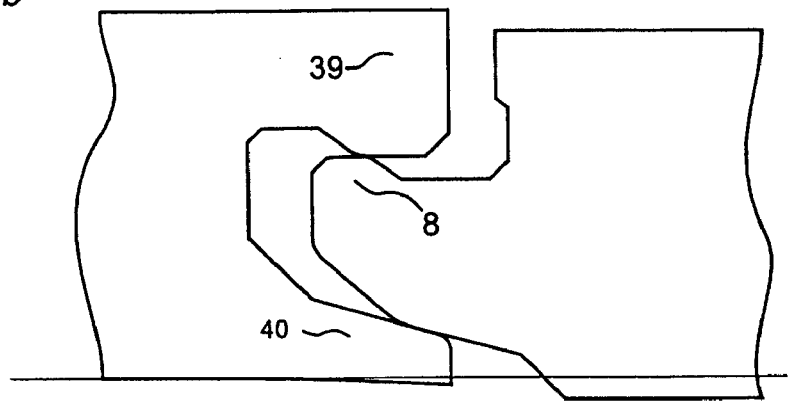

FIGS. 29*a–b* show joining by snapping-in. When the boards are moved towards each other horizontally, the tongue is guided into the groove. During continued compression, the lower lip 40 bends, and the locking element 8 snaps into the locking groove or the undercut 35. It should be emphasized that the preferred joint system shows the basic principles of snapping-in, where the lower lip is flexible. The joint system must, of course, be adjusted to the bending capacity of the material and the depth of the tongue groove 36, the height of the locking element 8 and the thickness of the lower lip 40 and should be dimensioned so that snapping-in is feasible. The basic principles of a joint system according to the invention which is more convenient for use in materials with a lower degree of flexibility and bendability will be evident from the following description and FIG. 34.

The described laying methods can be used optionally on all four sides and be combined with each other. After laying of one side, a lateral displacement usually takes place in the locked position.

Figure 30:
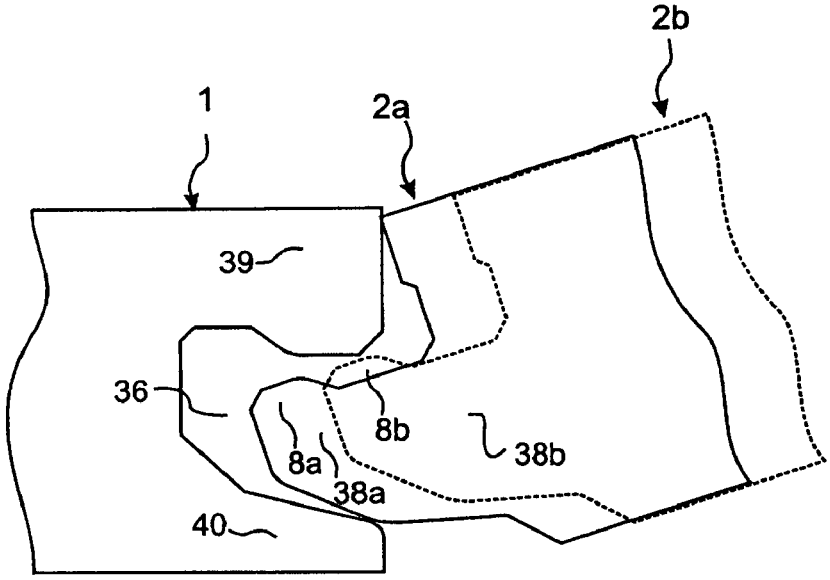
FIG. 30 shows how the long sides of two boards are joined with the long side of a third board when the two boards are already joined with each other on the short sides.

In some cases, for instance in connection with inward angling of the short side as a first operation, an upward angling of two boards usually takes place. FIG. 30 shows a first board 1, and an upwardly angled second board 2*a* and an upwardly angled new third board 2*b* which on its short side is already joined with the second board 2*b*. After the new board 2*b* has been laterally displaced along the short side of the second board 2*a* in the upwardly angled and short-side-locked position, the two boards 2*a* and 2*b* can be angled down jointly and locked on the long side to the first board 1. For this method to function, it is required that the new board 2*b* can be inserted with its tongue into the tongue groove when the board is displaced parallel with the second board 2*a* and when the second board 2*a* has a part of its tongue partially inserted into the tongue groove and when its upper joint edge is in contact with the upper joint edge of the first board 1. FIG. 30 shows that the joint system can be made with such a design of the tongue groove, tongue and locking element that this is possible.

All laying methods require displacement in the locked position. One exception to lateral displacement in the locked position is the case where several boards are joined on their short sides, after which a whole row is laid simultaneously. This is, however, not a rational laying method.

Figure 31A:
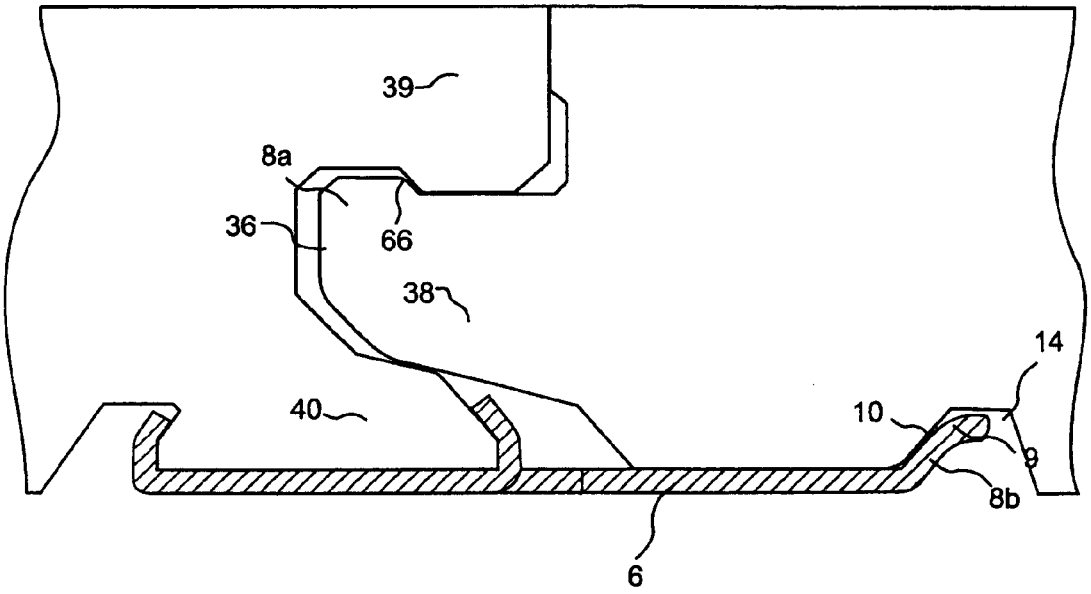
FIGS. 31*a–b* show two joined floorboards provided with a combination joint according to the invention.
Figure 31B:
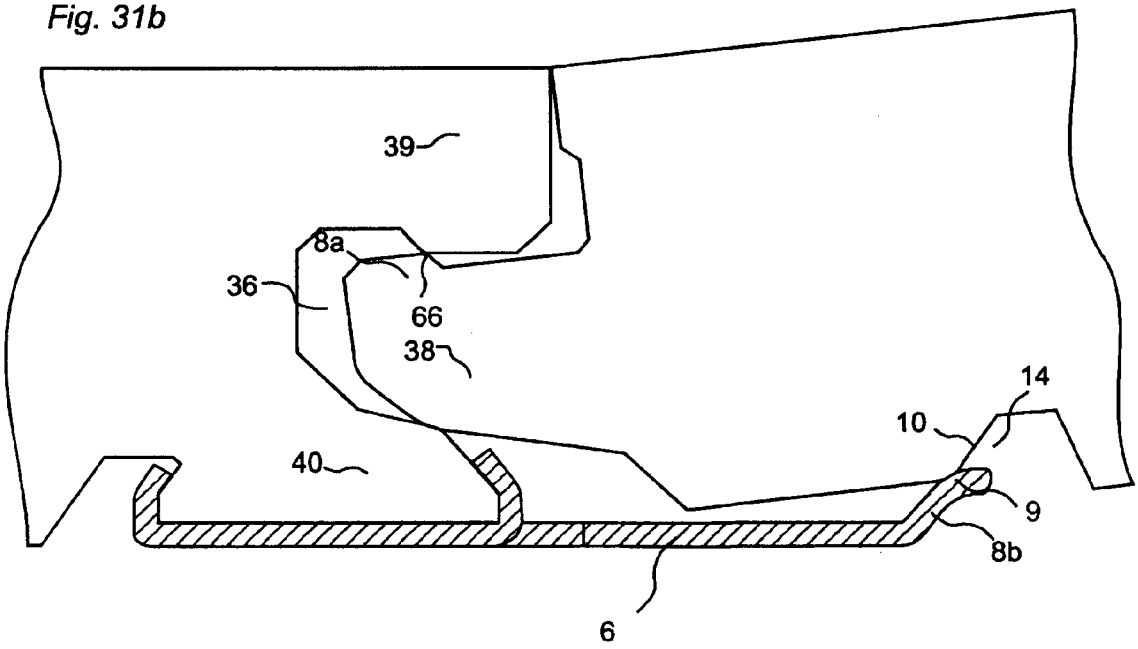
Figure 32A:
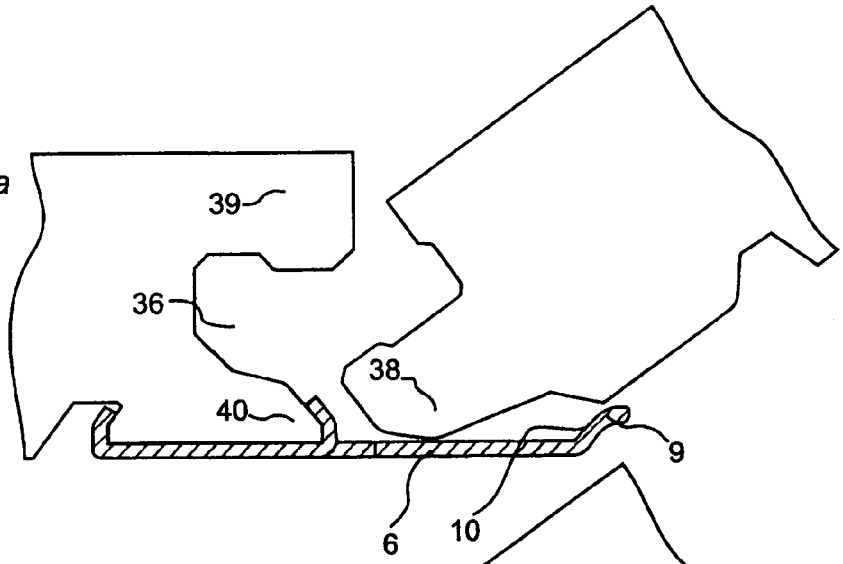
FIGS. 32*a–d* show inward angling of the combination joint.
Figure 32B:
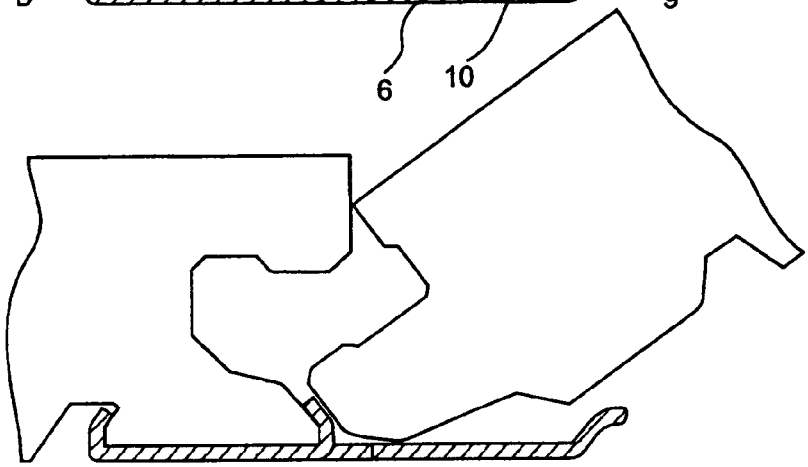
Figure 32C:
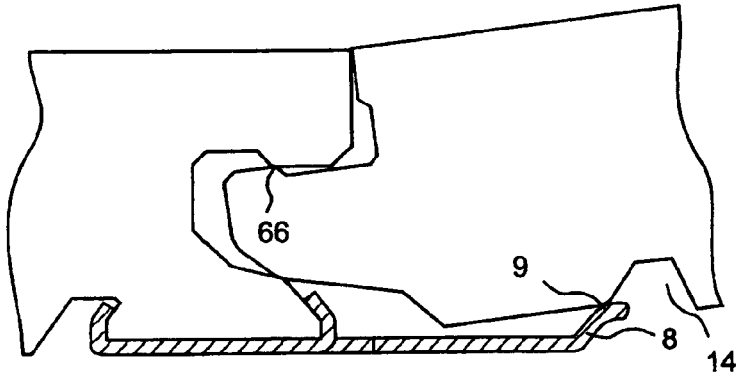
Figure 32D:
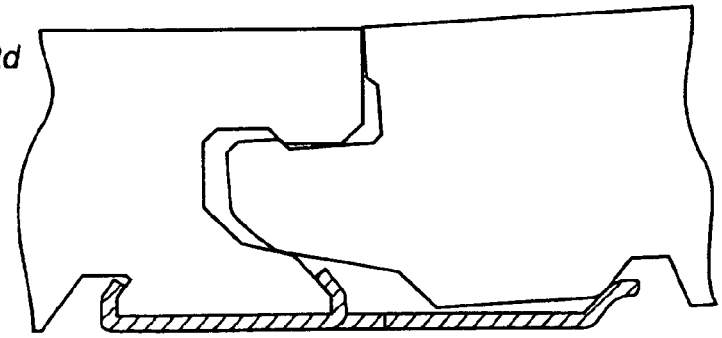

FIGS. 31*a*, 31*b* show part of a floorboard with a combination joint. The tongue groove 36 and the tongue 38 can be formed according to one of the embodiments above. The groove board has on its underside a known strip 6 with a locking element 8*b* and a locking surface 10. The tongue side has a locking groove 35 according to a known embodiment. In this embodiment, the locking element 8*b* with its relatively large guiding part 9 will function as an extra guiding during the first part of the inward angling and significantly facilitates this first part of the inward angling when positioning takes place and any banana shape is straightened out. The locking element 8*b* causes automatic positioning and compression of the floorboards until the guiding part of the tongue is engaged with the locking groove 35 and final locking can take place. The laying is facilitated to a considerable extent, and the joint will be very strong by coaction of the two locking systems. This joint is very convenient for joining of large floor surfaces particularly in public rooms. In the shown example, the strip 6 has been attached to the groove side, but it can also be attached to the tongue side. The positioning of the strip 6 thus is optional. Moreover, the joint can be both snapped in and angled upwards and be laterally displaced in the locked position.

Of course, this joint can be used optionally in different variants on both long and short side, and it can be optionally combined with all joint variants described here and with other known systems.

A convenient combination is a snap system on the short side without an aluminum strip. This may in some cases facilitate manufacture. A strip that is attached after manufacture also has the advantage that it may also constitute part of or even the entire lower lip 40. This gives very great degrees of freedom for forming, with cutting tools, for instance the upper lip 39 and forming locking surfaces with high locking angles. The locking system according to this embodiment can, of course, be made snappable, and it can also be manufactured with an optional width of the strip, for instance with a strip 6 that does not protrude outside the outer part of the upper lip 39, as is the case in the embodiment according to FIG. 50. The strip need not be continuous over the entire length of the joint but may consist of several small portions which are attached with space in between on both long side and short side.

The locking element 8*b* and its locking groove 35 can be formed with different angles, heights and radii which can be selected optionally, so that they either prevent separation and/or facilitate inward angling or snapping-in.

FIGS. 32*a–d* illustrate in four steps how inward angling can be made. The broad strip 6 makes it possible for the tongue 38 to be easily laid on the strip at the beginning of the inward angling. The tongue can then, in connection with downward angling, essentially automatically slide into the tongue groove 36. The corresponding laying can be made by the strip 6 being inserted under the tongue board. All laying functions that have been described above can also be used in floorboards with this preferred combination system.

Figure 33:
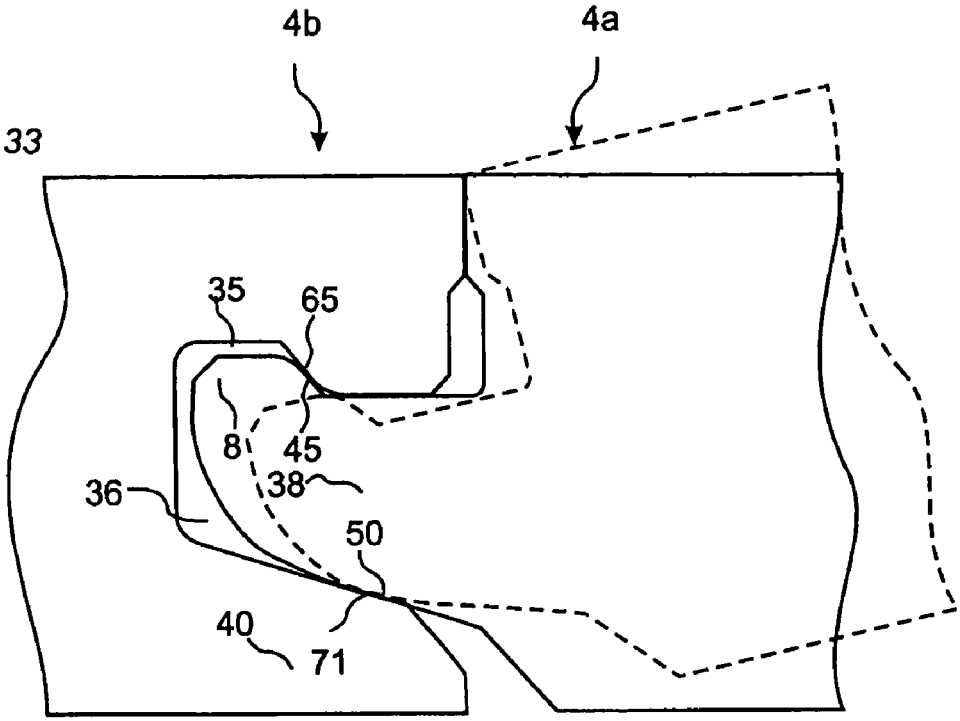
FIG. 33 shows an example of how a long side can be formed in a parquet floor.
Figure 34:
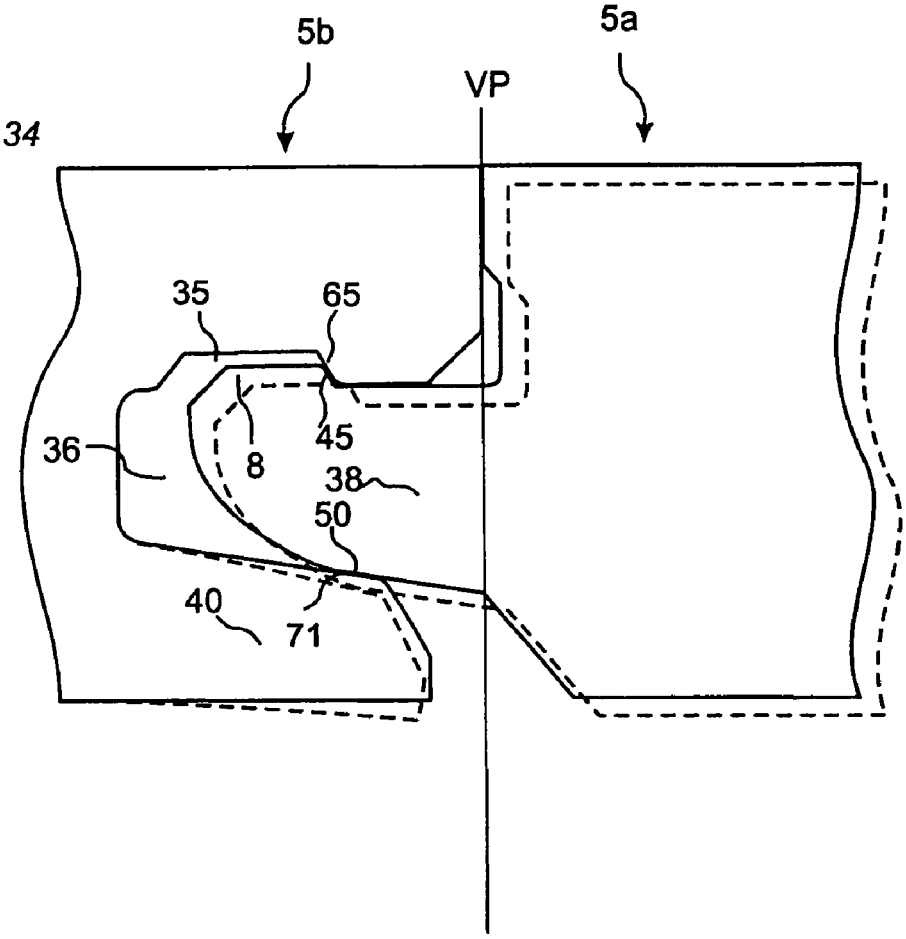
FIG. 34 shows an example of how a short side can be formed in a parquet floor.

FIGS. 33 and 34 show a production-specific and optimized joint system for above all a floorboard with a core of wood. FIG. 33 shows how the long side can be formed. In this case, the joint system is optimized with regard to, above all, inward angling, upward angling and a small amount of material waste. FIG. 34 shows how the short side can be formed. In this case, the joint system is optimized for snapping-in and high strength. The differences are as follows. The tongue 38 and the locking element of the short side 5*a* are longer, measured in the horizontal plane. This gives a higher shear strength in the locking element 8. The tongue groove 36 is deeper on the short side 5*b*, which helps the lower lip to be bent downwards to a greater extent. The locking element 8 is on the short side 5*a* lower in the vertical direction, which reduces the requirement for the downward bending of the lower lip in connection with the snapping. The locking surfaces 45, 65 have a higher locking angle and the lower engaging surfaces have a lower angle. The guiding parts of the long side 4*a*, 4*b* in the locking element and the locking groove are greater for optimal guiding, while at the same time the contact surface between the locking surfaces is smaller since the strength requirements are lower than for the short side. The joint systems on the long and short side can consist of different materials or material properties in upper lip, lower lip and tongue, and these properties can be adjusted so that they contribute to optimizing the different properties that are desired for long side and short side, respectively, with regard to function and strength.

Figure 35:
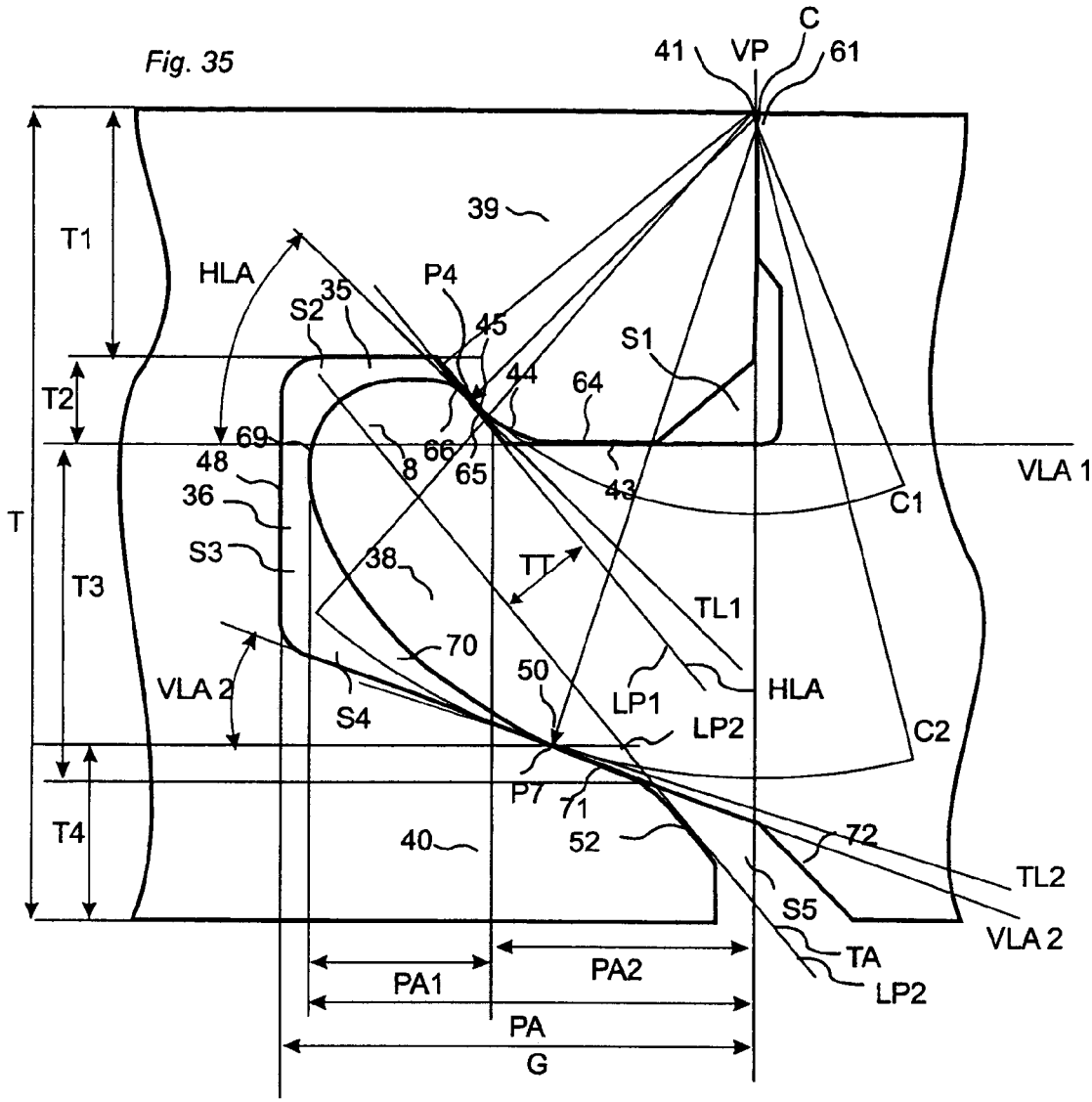
FIG. 35 shows a detailed example of how the joint system of the long side can be formed in a parquet floor.

FIG. 35 shows in detail how the joint system of the floorboard can be formed on the long side. The principles here described can, of course, be used on both long side and short side. Only the parts that have previously not been discussed in detail will now essentially be described.

The locking surfaces 45, 65 have an angle HLA which is greater than the tangent TL1. This gives a higher horizontal locking force. This overbending should be adjusted to the wood material of the core and optimized with regard to compression and flexural rigidity so that inward angling and upward angling can still take place. The contact surfaces of the locking surfaces should be minimized and adjusted to the properties of the core.

When the boards are joined, a small part, preferably less than half the extent of the locking element in the vertical direction, constitutes the contact surfaces of the locking element 8 and the locking groove 14. The major part constitutes rounded, inclined or bent guiding parts which in the joined position and during inward angling and upward angling are not in contact with each other.

The inventor has discovered that very small contact surfaces in relation to the floor thickness T between the locking surfaces 45, 65 of, for instance, a few tenths of a millimeter can result in a very high locking force and that this locking force can exceed the shear strength of the locking element in the horizontal plane (i.e. the surface plane HP). This can be used to provide locking surfaces with an angle exceeding the tangent TL1.

In this case, the locking surfaces 45, 65 are plane and parallel. This is advantageous especially as regards the locking surface 55 of the locking groove. If the tool is displaced parallel with the locking surface 45, this will not affect the vertical distance to the joint plane VP, and it is easier to provide a high joint quality. Of course, small deviations from the plane form may give equivalent results.

Correspondingly, the lower supporting surfaces 50, 71 have been made essentially plane and with an angle VLA2 which in this case is greater than the tangent line TL2 to the point P7 which is positioned on the supporting surface 71 closest to the bottom of the tongue groove. This causes inward angling with clearance during essentially the entire angular motion. Also the supporting surfaces 50, 71 are relatively small in relation to the floor thickness T. These supporting surfaces can also be made essentially plane. Plane supporting surfaces facilitate the manufacture according to the above described principles.

The supporting surfaces 50, 71 can also be made with angles that are smaller than the angle of inclination of the tangent TL2. In this case, angling can take place partly by means of a certain degree of material compression and downward bending of the lower lip 40. If the lower supporting surfaces 50, 71 are small in relation to the floor thickness T, the possibilities of forming the surfaces with angles that are greater and smaller, respectively, than the tangent TL1 and TL2, respectively, increase.

Figure 36:
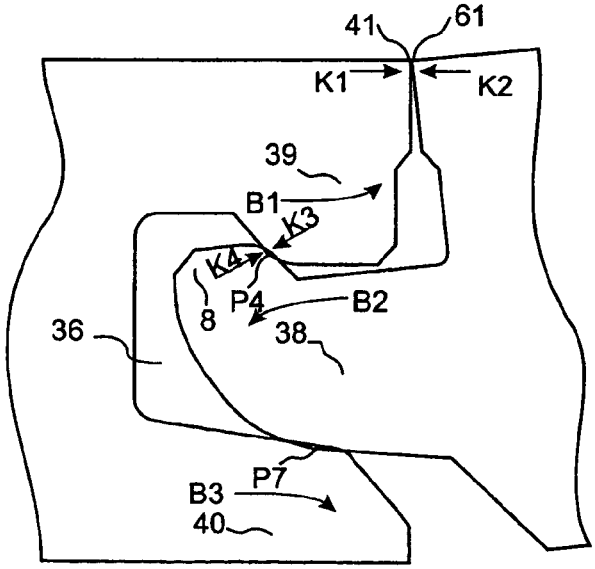
FIG. 36 shows an example of a floorboard according to the invention where the joint system is designed so that it can be angled by using bending and compression in the joint material.

FIG. 36 shows upward angling of a board which has a geometry according to FIG. 35 and whose locking surfaces thus have a greater inclination than the tangent TL1 and whose supporting surfaces have a smaller inclination than the tangent TL2 while at the same time these surfaces are relatively small. The overlap at the points P4 and P7 in connection with inward angling and upward angling will then be extremely small. The point P4 can be angled depending on a combination of the material being compressed at the upper joint edges K1, K2 and at the point P4, K3, K4 while at the same time the upper lip 39 and the tongue 38 can bend in the direction B1 and B2 from the contact point P4. The lower lip can bend downwards away from the contact point P7 in the direction B3.

The upper supporting surfaces 43, 64 are preferably perpendicular to the joint plane VP. The manufacture is facilitated significantly if the upper and lower supporting surfaces are plane-parallel and preferably horizontal.

Reference is once more made to FIG. 35. The circular arc C1 shows, for instance, that the upper supporting surfaces can be formed in many different ways inside this circular arc C1 without this interfering with the possibilities of angling and snapping. In the same way, the circular arc C2 shows that the inner parts of the tongue groove and the outer parts of the tongue according to the previously preferred principles can be formed in many different ways without this interfering with the possibilities of angling and snapping.

The upper lip 39 is over its entire extent thicker than the lower lip 40. This is advantageous from the viewpoint of strength. Moreover, this is advantageous in connection with parquet floors, which as a result can be formed with a thicker surface layer of a hard kind of wood.

S1–S5 indicate areas where joint surfaces on both sides should not be in contact with each other at least in the joined position, but preferably also during inward angling. A contact between the tongue and the tongue groove in these areas S1–S5 contributes only marginally to improving the locking in D1 direction and hardly at all to improving the locking in the D2 direction. However, a contact prevents inwardly angling and lateral displacement, causes unnecessary tolerance problems in connection with manufacture and increases the risk of creaking and undesired effects as the boards swell.

Figure 38A:
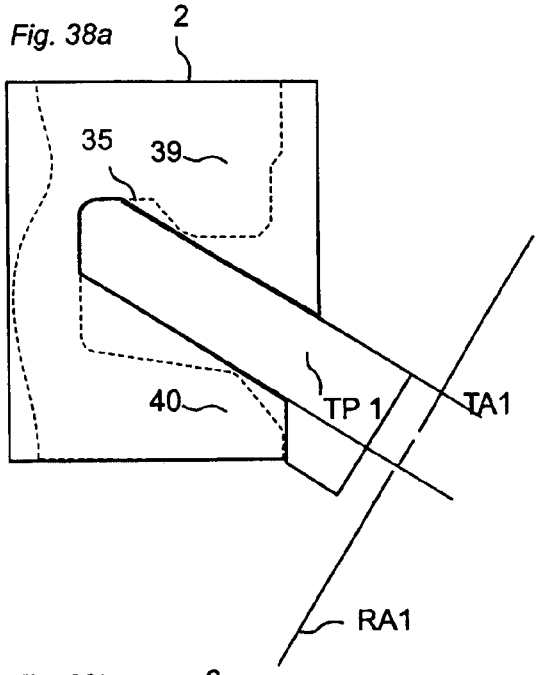
FIGS. 38*a–b* show a manufacturing method in four steps which uses a manufacturing method according to the invention.
Figure 38C:
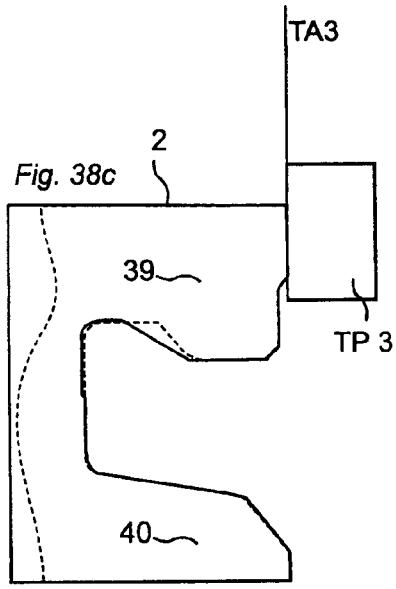
Figure 38B:
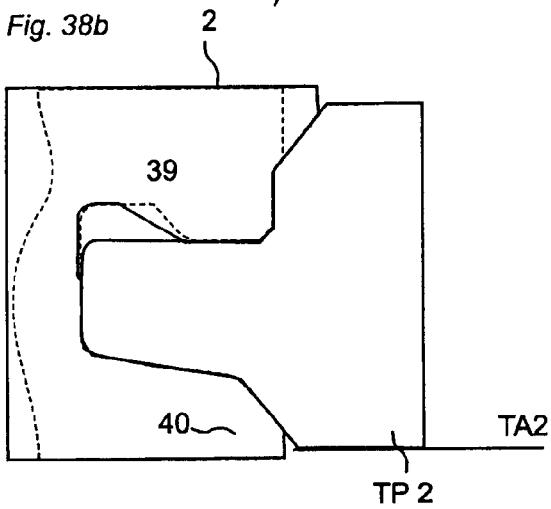
Figure 38D:
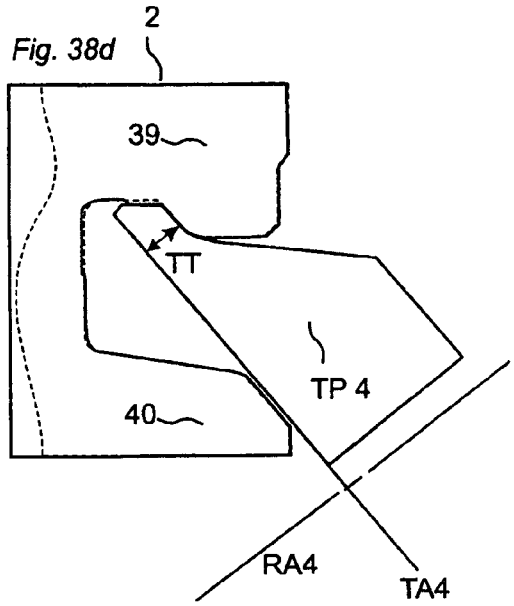

The tool angle TA, which in FIG. 38*d* is indicated by TA4, forms the locking surface 44 of the undercut 35 and operates with the same angle as the angle of the locking surface, and the part of this tool which is positioned inside the vertical plane towards the tongue groove has a width perpendicular to the tool angle TA which is indicated by TT. The angle TA and the width TT determine partly the possibilities of forming the outer parts 52 of the lower lip 40.

A plurality of ratios and angles are important for an optimal manufacturing method, function, cost and strength.

The extent of the contact surfaces should be minimized. This reduces friction and facilitates displacement in the locked position, inward angling and snapping in, simplifies manufacture and reduces the risk of swelling problems and creaking. In the preferred example, less than 30% of the surface parts of the tongue 38 constitute contact surfaces with the tongue groove 36. The contact surfaces of the locking surfaces 65, 45 are in this embodiment only 2% of the floor thickness T, and the lower supporting surfaces have a contact surface which is only 10% of the floor thickness T. As mentioned above, the locking system has in this embodiment a plurality of parts S1–S5 which constitute free surfaces without contact with each other. The space between these free surfaces and the rest of the joint system can within the scope of the invention be filled with glue, sealing agent, impregnation of different kinds, lubricant and the like. By free surfaces is here meant the form of the surfaces in the joint system that it obtains in connection with machining by means of the respective cutting tools.

If the joint has a tight fit, the locking surfaces 65, 45 can prevent horizontal separation even when they have an angle HLA to the horizontal plane HP which is greater than zero. The tensile strength of the joint system, however, increases significantly when this locking angle becomes greater and when there is a difference in angle between the locking angle HLA of the locking surfaces 45, 65 and the engaging angle VLA2 of the lower supporting surfaces 50, 71, provided that this angle is smaller. If high strength is not required, the locking surfaces can be formed with low angles and small differences in angle to the lower engaging surfaces.

For good joint quality in floating floors, the locking angle HLA and the difference in angle to lower supporting surfaces HLA-VLA2 must as a rule be about $20_C$. Still better strength is obtained if the locking angle HLA and the difference in angle HLA-VLA2 is, for instance $30_C$. In the preferred example according to FIG. 35, the locking angle is $50_C$ and the angle of the supporting surfaces $20_C$. As shown in previous embodiments, joint systems according to the invention can be formed with still greater locking angles and differences in angle.

A large number of tests have been made with different locking angles and engaging angles. These tests prove that it is possible to form a high-quality joint system with locking angles between $40_C$ and $55_C$ and with supporting surface angles between $0_C$ and $25_C$. It should be emphasized that also other ratios can result in a satisfactory function.

The horizontal extent PA of the tongue should exceed ⅓ of the thickness T of the floorboard, and it should preferably be about 0.5*T. As a rule, this is necessary for a strong locking element 8 with a guiding part to be formed and for sufficient material to be available in the upper lip 39 between the locking surface 65 and the vertical plane VP.

The horizontal extent PA of the tongue 38 should be divided into two essentially equal parts PA1 and PA2, where PA1 should constitute the locking element and the major part of PA2 should constitute the supporting surface 64. The horizontal extent PA1 of the locking element should not be less than 0.2 times the floor thickness. The upper supporting surface 64 should not be too great, above all on the long side of the floorboard. Otherwise, the friction in connection with lateral displacement can be too high. To enable rational manufacture, the depth G of the tongue groove should be 2% deeper than the projection of the tongue PA from the joint plane VP. The smallest distance of the upper lip to the floor surface adjacent to the locking groove 35 should be greater than the smallest distance of the lower lip between the lower supporting surface 71 and the rear side of the floorboard. The tool width TT should exceed 0.1 times the floor thickness T.

Figures 37A, 37B, 37C:
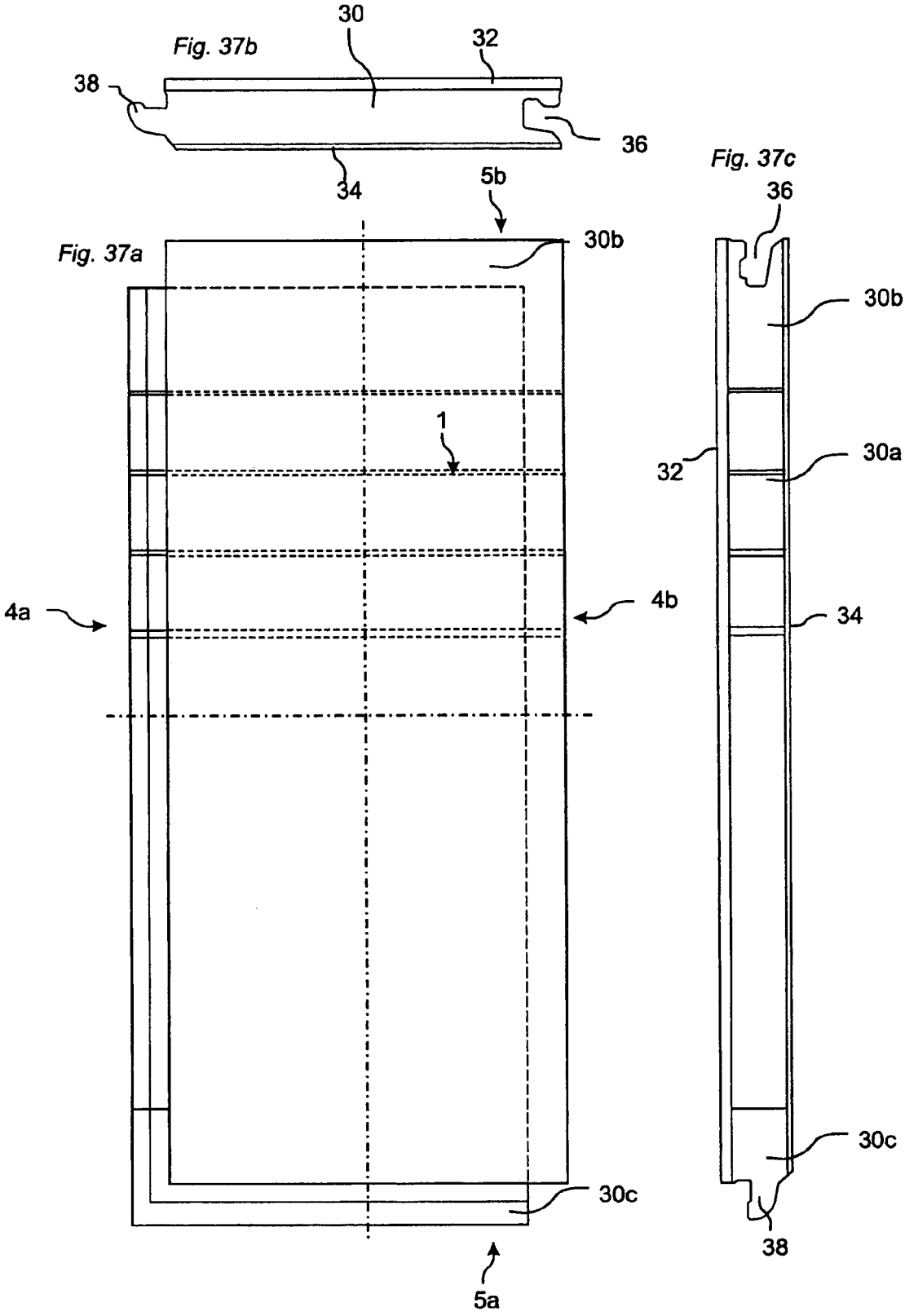
FIG. 37 shows a floorboard according to the invention.

FIGS. 37*a–c* illustrate a floorboard according to the invention. This embodiment shows specifically that the joint system on the short side may consist of different materials and material combinations 30*b* and 30*c* and that these can also differ from the joint material 30 of the long side. For instance, the tongue groove part 36 of the short sides may consist of a harder and more flexible wood material than, for instance, the tongue part 38 which can be hard and rigid and have other properties than the core of the long side. On the short side with the tongue groove 36, it is possible to select, for instance, a kind of wood 30*b* which is more flexible than the kind of wood 30*c* on the other short side where the tongue is formed. This is particularly convenient in parquet floors with a lamellar core where the upper and lower side consist of different kinds of wood and the core consists of blocks that have been glued together. This construction gives great possibilities of varying the composition of materials in order to optimize function, strength and production costs.

It is also possible to vary the material along the length of one side. Thus, for instance the blocks that are positioned between the two short sides can be of different kinds of wood or materials, so that some of them can be selected with regard to their contributing with suitable properties which improve laying, strength etc. Different properties can also be obtained with different fiber orientation on long and short side, and also plastic materials can be used on the short sides and, for instance, on different parts of the long side. If the floorboard or parts of its core consist of, for example, plywood with several layers, these layers can be selected so that the upper lip, the tongue and the lower lip on both long side and short side can all have parts with a different composition of materials, fiber orientation etc. which can give different properties as regards strength, flexibility, machinability etc.

FIGS. 38*a–d* show a manufacturing method according to the present invention. In the shown embodiment, the manufacture of the joint edge and the tongue groove occurs in four steps. The tools used have a tool diameter which exceeds the floor thickness. The tools are used to form an undercut groove with a high locking angle in a tongue groove with a lower lip, which extends beyond the undercut groove.

In order to simplify the understanding and the comparison with previously described joint systems, the edges of the boards are illustrated with the floor surface directed upwards. Normally, the boards are, however, positioned with their surface directed downwards during machining.

The first tool TP1 is a roughing cutter which operates at an angle TA1 to the horizontal plane. The second tool TP2 can operate horizontally and forms the upper and lower supporting surfaces. The third tool TA3 can operate essentially vertically but also at an angle and forms the upper joint edge.

The critical tool is the tool TP4 which forms the outer part of the locking groove and its locking surface. TA4 corresponds to TA in FIG. 35. As is evident from FIG. 38*d*, this tool removes only a minimum amount of the material and forms essentially the locking surface with a high angle. For the tool not to break, it should be formed with a wide part which is extended outside the vertical plane. Moreover, the amount of material to be removed should be as small as possible to reduce wear and strain on the tool. This is achieved with a suitable angle and design of the roughing cutter TP1.

Thus this manufacturing method is characterized especially in that it requires at least two cutting tools which operate at two different angles to form an undercut locking groove 35 in the upper part of the tongue groove 36. The tongue groove can be made using still more tools, the tools being used in a different order.

The description is now aimed in detail at the method of forming a tongue groove 36 in a floorboard, which has an upper side 2 in a surface plane HP and a joint edge portion 4*a* having a joint plane VP directed perpendicular to the upper side. The tongue groove extends from the joint plane 4*a* and is defined by two lips 39, 40 each having a free outer end. In at least one lip, the tongue groove has an undercut 35 which comprises a locking surface 45 and is positioned further away from the joint plane VP than is the free outer end 52 of the other lip. According to the method, machining is carried out by means of a plurality of rotating cutting tools which have a larger diameter than the thickness T of the floorboard. In the method, the cutting tools and the floorboard are made to perform a relative motion relative to each other and parallel to the joint edge of the floorboard. What characterizes the method is 1) that the undercut is formed by means of at least two such cutting tools, which have their rotatary shaft inclined at different angles to the upper side 2 of the floorboard; 2) that a first of these tools is driven to form portions of the undercut further away from the joint plane VP than the locking surface 45 of the intended undercut; and 3) that a second of these tools is driven to form the locking surface 45 of the undercut. The first of these tools is driven with its rotary shaft set at a greater angle to the upper side 2 of the floorboard than is said second of these tools. The lower lip 40 can be formed so as to extend beyond the joint plane VP. The lower lip 40 can also be formed so as to extend to the joint plane VP. Alternatively, the lower lip 40 can be formed so as to end at a distance from the joint plane VP.

The first of the tools can, according to an embodiment, be driven with its rotary shaft set at an angle of at most $85_C$ to the surface plane HP. The second of the tools can, according to an embodiment, be driven with its rotary shaft set at an angle of at most $60_C$ to the surface plane HP. Moreover the tools can be caused to engage the floorboard in order in dependence on the angle of their rotary shaft to the surface plane HP, so that tools with a greater angle of the rotary shaft are caused to machine the floorboard before tools with a smaller angle of the rotary shaft.

Moreover, a third of the tools can be driven to form the lower parts of the tongue groove 36. This third tool can be brought into contact with the floorboard between said first and said second of the tools. The third tool can further be driven with its rotary shaft set at an angle of about $90_C$ to the surface plane HP.

Further the first of the tools can be driven to machine a broader surface portion of the joint edge portion 4*a* of the floorboard than said second of the tools. The second of the tools can be formed so that its surface facing the surface plane HP is profiled for reduction of the thickness of the tool, seen parallel with the rotary shaft, within the radially outer portions of the tool. Moreover, at least three of the tools can be driven with different settings of their rotary shaft to form the undercut parts of the tongue groove. The tools can be used to machine a floorboard of wood or wood-fiber-based material.

Figure 39:
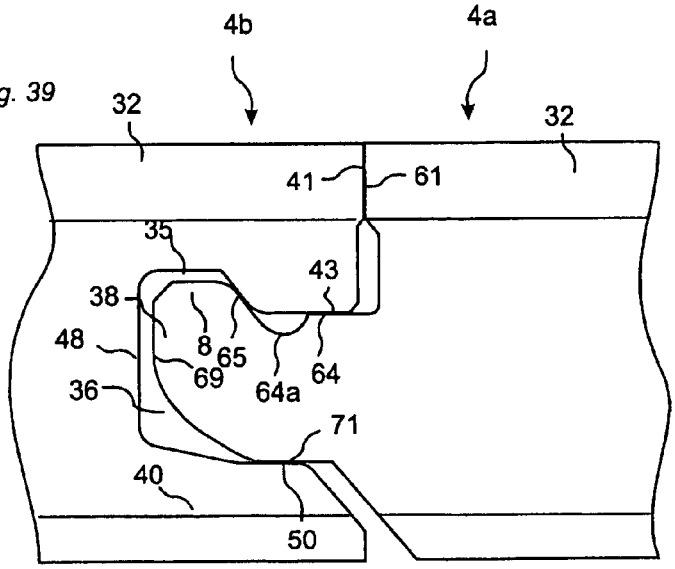
FIG. 39 shows a joint system which is suitable to compensate for swelling and shrinking of the surface layer of the floorboard.

FIG. 39 shows how a joint system can be formed to enable compensation for swelling. Since the relative humidity increases in the change between cold and warm weather, the surface layer 32 swells and the floorboards 4*a* and 4*b* are pressed apart. If the joint has no flexibility, the joint edges 41 and 61 can be crushed, or the locking element 8 can be broken. This problem can be solved by the joint system being constructed so as to obtain the following properties which each separately and in combination contribute to a reduction of the problem.

The joint system can be formed so that the floorboards can have a small play when the joint edges are pressed together horizontally, for instance, in connection with production and at normal relative humidity. A play of a few hundredths of a millimeter contributes to a reduction of the problem. A negative play, i.e. initial stress, can give the opposite effect.

If the contact surface between the locking surfaces 45, 65 is small, the joint system can be formed so that the locking surfaces are more easily compressed than the upper joint edges 41, 61. The locking element 8 can be formed with a grove 64*a* between the locking surface and the upper horizontal supporting surface 64. With a suitable design of the tongue 38 and the locking element 8, the outer part 69 of the tongue can be bent outwards to the inner part 48 of the tongue groove and operate as a resilient element in connection with swelling and shrinking of the surface layers.

In this embodiment, the lower supporting surfaces of the joint system are formed parallel with the horizontal plane for maximum locking vertically. It is also possible to obtain expansibility by applying a compressible material between, for instance, the two locking surfaces 45, 65 or selecting compressible materials as materials for the tongue or groove part.

Figure 40:
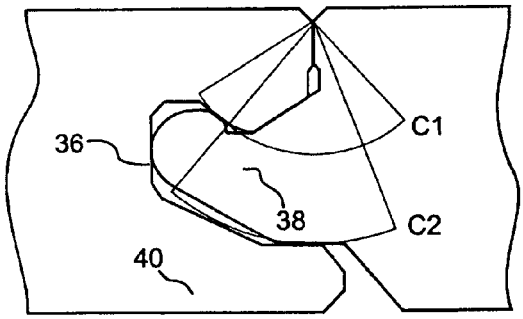
FIG. 40 shows a variant of the invention with a rigid tongue.

FIG. 40 shows a joint system according to the invention which has been optimized for high rigidity in the tongue 38. In this case, the outer part of the tongue is in contact with the inner part of the tongue groove. If this contact surface is small and if the contact occurs without very great compression, the joint system can be displaceable in the locked position.

Figure 41:
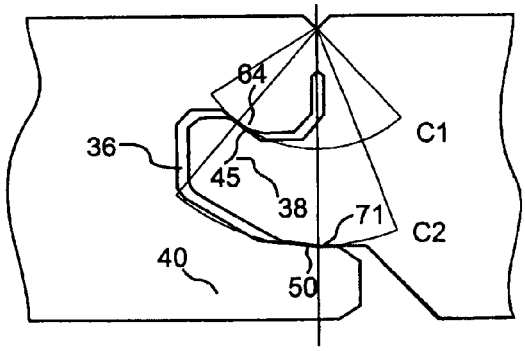
FIG. 41 shows a variant of the invention where the locking surfaces constitute upper contact surfaces.

FIG. 41 shows a joint system where the lower supporting surfaces 50, 71 have two angles. The portions of the supporting surfaces outside the joint plane are parallel with the horizontal plane. Inside the joint plane closest to the inner part of the tongue groove, they have an angle corresponding to the tangent to the circular arc 32 which is tangent to the innermost edge of the supporting surface parts engaging each other. The locking surfaces have a relatively low locking angle. The strength can still be sufficient since the lower lip 40 can be made hard and rigid and since the difference in angle is great to the parallel part of the lower supporting surfaces 50, 71. In this embodiment, the locking surfaces 45, 65 also serve as upper supporting surfaces. The joint system has no upper supporting surfaces in addition to the locking surfaces which thus also prevent vertical separation.

Figure 42A:
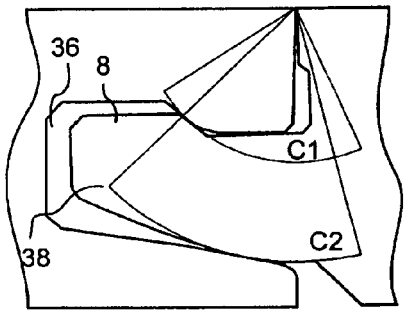
FIGS. 42*a–b* show a variant of the invention with a long tongue as well as angling and pulling out.
Figure 42B:
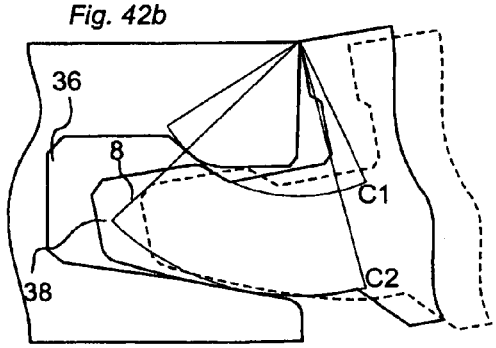

FIGS. 42*a* and 42*b* show a joint system which is convenient for short side locking and which can have high tensile strength also in softer materials since the locking element 8 has a large horizontal shear-absorbing surface. The tongue 38 has a lower part which is positioned outside the circular arc C2 and which thus does not follow the above-described basic principle of inward angling. As is apparent from FIG. 42*b*, the joint system can still be released by upward angling about the upper joint edges since the locking element 8 of the tongue 38, after the first upward angling operation has been carried out, can leave the tongue groove by being pulled out horizontally. The previously described principles for inward angling and upward angling about upper joint edges should thus be satisfied to enable upward angling until the joint system can be released in some other manner by, for instance, being pulled out or in combination with snapping out when the lower lip 40 is being bent.

Figure 43A:
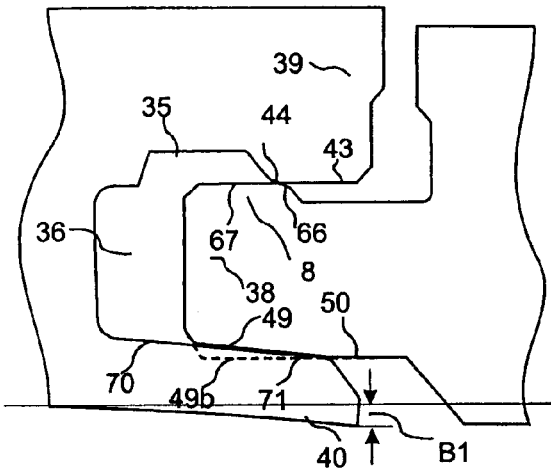
Figure 43B:
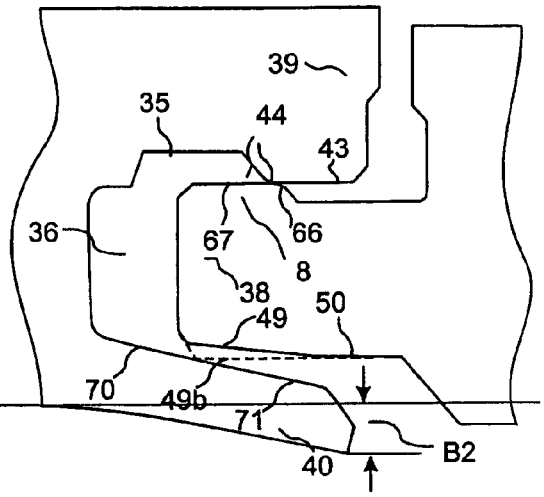
Figure 43C:
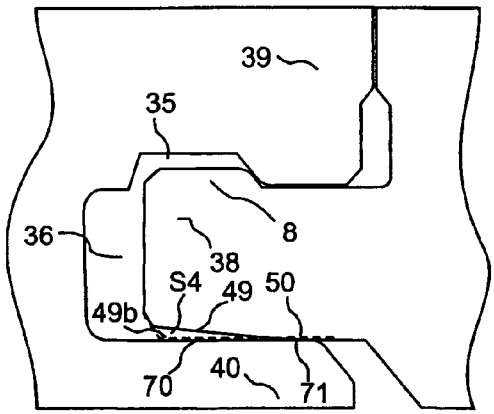

FIGS. 43*a*–*c* show the basic principle of how the lower part of the tongue is to be formed in relation to the lower lip 40 to facilitate horizontal snapping-in according to the invention in a joint system with locking grooves in a rigid upper lip 39 and with a flexible lower lip 40. In this embodiment, the upper lip 39 is significantly more rigid, inter alia owing to the fact that it may be thicker or that it may consist of harder and more rigid materials. The lower lip 40 can be thinner and softer, and in connection with snapping-in the essential bending will therefore take place in the lower lip 40. Snapping-in can be significantly facilitated, among other things, by the maximal bending of the lower lip 40 being limited as far as possible. FIG. 43*a* shows that the bending of the lower lip 40 will increase to a maximal bending level B1 which is characterized by the tongue 38 being inserted so far into the tongue groove 36 that the rounded guiding parts will come into contact with each other. When the tongue 38 is inserted still more, the lower lip 49 will be bent backwards until snapping-in is terminated and the locking element 8 is fully inserted in its final position in the locking groove 35. The lower and front part 49 of the tongue 38 should be designed so as not to bend down the lower lip 40 which instead should be forced downwards by the lower supporting surface 50. This part 49 of the tongue should have a shape which either touches or goes clear of the maximum bending level of the lower lip 40 when this lower lip 40 is bent round the outer part of the lower engaging surface 50 of the tongue 38. If the tongue 38 has a shape which in this position overlaps the lower lip 40, indicated by the dashed line 49*b*, the bending B2 according to FIG. 43*b* can be significantly greater. This may cause great friction in connection with snapping-in and a risk of the joint being damaged. FIG. 43*c* shows that the maximum bending can be limited by the tongue groove 36 and the tongue 38 being designed in such manner that there is a space S4 between the lower and outer part 49 of the tongue and the lower lip 40.

Figure 44:
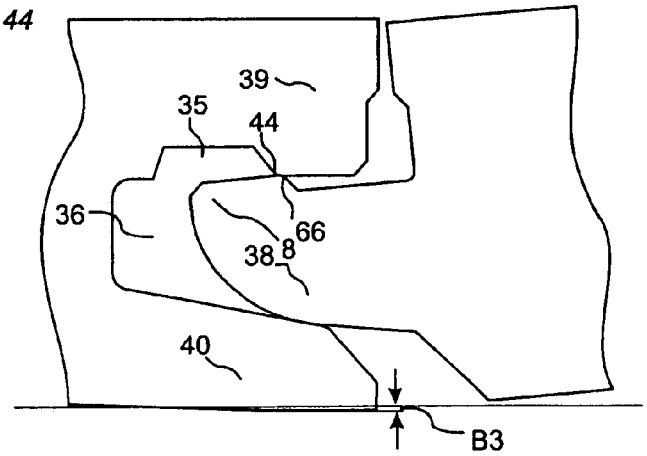
FIG. 44 shows snapping-in in the angled position.

Horizontal snapping-in is as a rule used in connection with snapping-in of the short side after locking of the long side. When snapping in the long side, it is also possible to snap the joint system according to the invention with one board in a slightly upwardly angled position. This upwardly angled snap position is shown in FIG. 44. Only a small bending B3 of the lower lip 40 is required for the guiding part 66 of the locking element to come into contact with the guiding part 44 of the locking groove, so that the locking element can then by downward angling be inserted into the locking groove 35.

FIGS. 45–50 show different variants of the invention which can be used on the long or short side and which can be manufactured using large rotating cutting tools. With modem manufacturing technology it is possible to form according to the invention complicated shapes by machining in board materials at a low cost. It should be pointed out that most of the shown geometries in these and previously preferred figures can, of course, be formed, for example, by extrusion, but this method is usually considerably more expensive than machining and is not convenient for forming of most board materials that are normally used in floors.

Figure 45A:
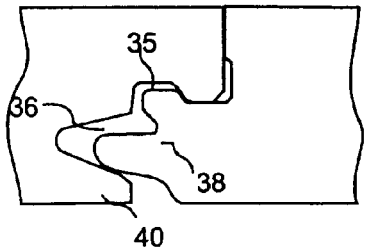
FIGS. 45*a–b* show a joint system according to the invention with a flexible tongue.
Figure 45B:
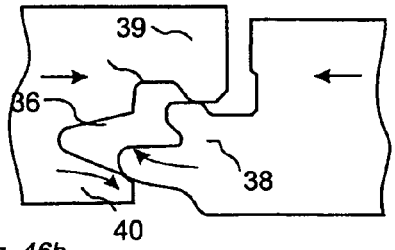

FIGS. 45*a* and 45*b* show a locking system according to the invention where the outer part of the tongue 38 has been formed so as to be bendable. This bendability has been obtained by the tip of the tongue being split. During snapping-in, the lower lip 40 bends downwards and the outer lower part of the tongue 38 bends upwards.

Figure 46A:
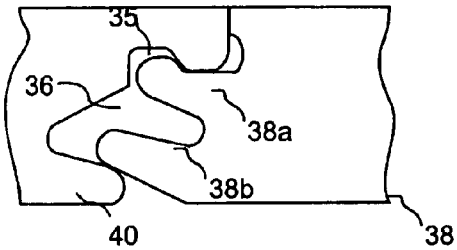
FIGS. 46*a–b* show a joint system according to the invention with a split and flexible tongue.
Figure 46B:
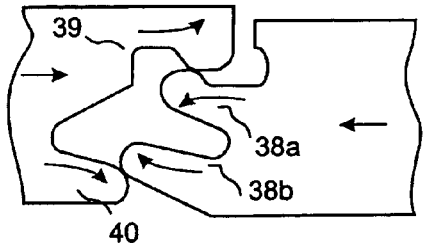

FIGS. 46*a* and 46*b* show a locking system according to the invention with a split tongue. During snapping-in, the two parts of the tongue bend towards each other while at the same time the two lips bend away from each other.

These two joint systems are such as to allow angling inwards and outwards, respectively, for locking and dismounting.

Figure 47A:
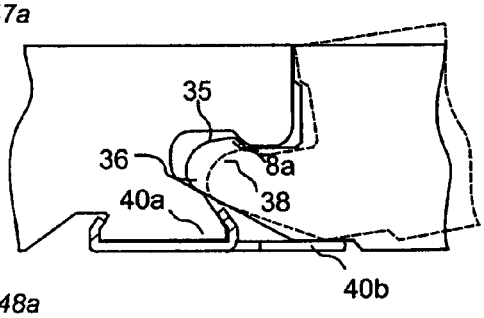
FIGS. 47*a–b* show a joint system according to the invention with a lower lip consisting partly of another material than the core.
Figure 47B:
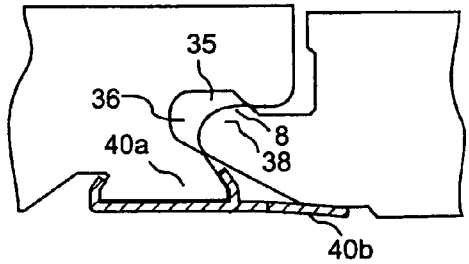

FIGS. 47*a* and 47*b* show a combination joint where a separate part 40*b* constitutes an extended part of the lower lip and where this part can be resilient. The joint system is angleable. The lower lip, which constitutes part of the core, is formed with its supporting surface in such a manner that snapping-in can take place without this lip needing to be bent. Merely the extended separate part, which can be made of aluminum sheet, is resilient. The joint system can also be formed so that both parts of the lip are resilient.

Figure 48A:
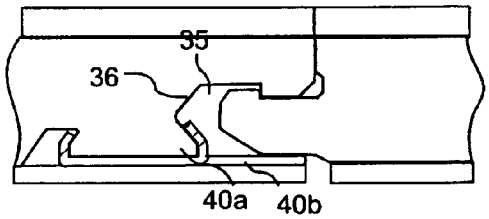
FIGS. 48*a–b* show a joint system which can be used as snap joint in a floorboard that is locked on all four sides.
Figure 48B:
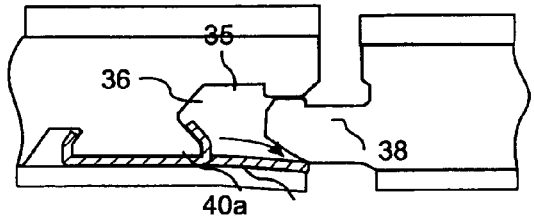

FIGS. 48*a* and 48*b* show snapping-in of a combination joint with a lower lip consisting of two parts, where merely the separate lip constitutes the supporting surface. This joint system can be used, for instance, on the short side together with some other joint system according to the invention. The advantage of this joint system is that, for instance, the locking groove 35 can be formed with great degrees of freedom rationally and using large cutting tools. After the machining, the outer lip 40*b* is attached, and its shape does not affect the possibilities of machining. The outer lip 40*b* is resilient and has in this embodiment no locking element. Another advantage is that the joint system enables joining of extremely thin core materials since the lower lip can be made very thin. The core material can be, for instance, a thin compact laminate, and the upper and the lower layer can be relatively thick layers of e.g. cork or soft plastic material, which can give a soft and sound-absorbing floor. Using this technology, it is possible to join core materials having a thickness of about 2 mm compared with normal core materials which as a rule are not thinner than 7 mm. The saving in thickness that can be achieved can be used to increase the thickness of the other layers. It is obvious that this joint can be used also in thicker materials.

Figure 49:
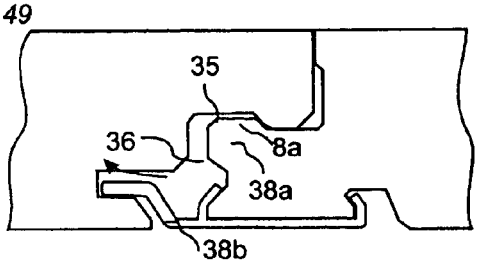
FIG. 49 shows a joint system that can be used, for instance, on the short side of a floorboard.
Figure 50:
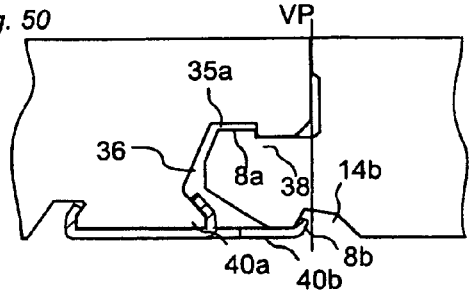
FIG. 50 shows another example of joint system which can be used, for instance, on the short side of a floorboard.

FIGS. 49 and 50 show two variants of combination joints which can be used, for example, in the short side in combination with other preferred systems. The combination joint according to FIG. 49 can be made in an embodiment where the strip constitutes an extended resilient part of the tongue, and the system will then have a function similar to the one in FIG. 45. FIG. 50 shows that this combination joint can be formed with a locking element 8*b* in the outer lower lip 40*b* which is positioned inside the joint plane.

FIGS. 51*a–f* show a laying method which is according to the invention and which can be used to join floorboards by a combination of horizontal bringing-together, upward angling, snapping in the upwardly angled position and downward angling. This laying method can be used for floorboards according to the invention, but it can also be used on optional mechanical joint systems in floors having such properties that the laying method can be applied. To simplify the description, the laying method is shown by one board, referred to as the groove board, being joined with the other board, referred to as the tongue board. The boards are in practice identical. It is obvious that the entire laying sequence can also be carried out by the tongue side being joined with the groove side in the same way.

Figure 51A:
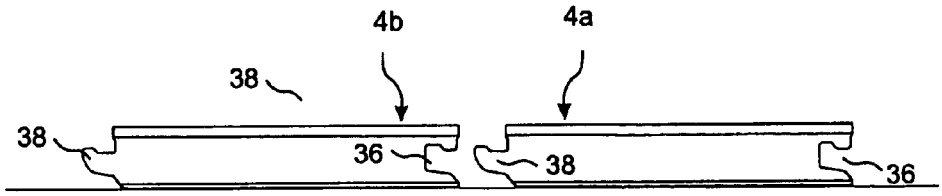
FIGS. 51*a–f* show a laying method.
Figure 51B:
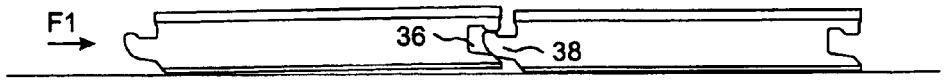
Figure 51C:
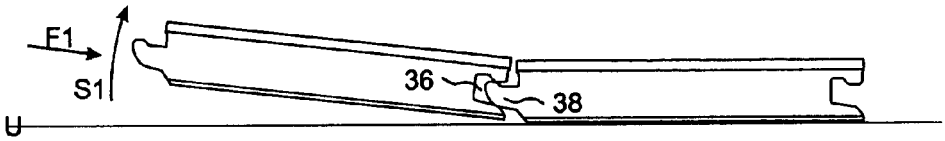
Figure 51D:
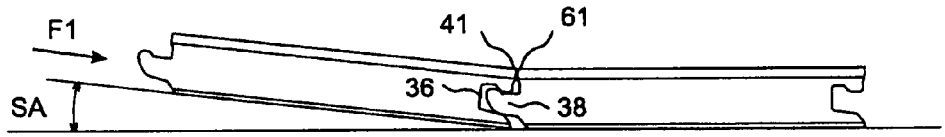
Figure 51E:
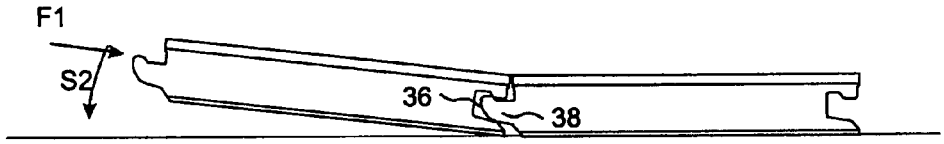

A tongue board 4*a* with a tongue 38 and a groove board 4*b* with a tongue groove 36 are in the starting position lying flat on a subfloor according to FIG. 51*a*. The tongue 38 and the tongue groove 36 have locking means which present vertical and horizontal separation. Subsequently the groove board 4*b* is displaced horizontally in the direction F1 towards the tongue board 4*a* until the tongue 38 is in contact with the tongue groove 36 and until the upper and lower parts of the tongue are partially inserted into the tongue groove according to FIG. 51*b*. This first operation forces the joint edge portions of the boards to take the same relative vertical position over the entire longitudinal extent of the board, and any differences in arcuate shape will therefore be straightened out.

If the groove board is moved towards the tongue board, the joint edge portion of the groove board will be slightly raised in this position. The groove board 4*b* is then angled upwards with an angular motion S1 while at the same time it is held in contact with the tongue board or alternatively is pressed in the direction F1 towards the tongue board 4*a* according to FIG. 51*c*. When the groove board 4*b* reaches an angle SA to the subfloor which corresponds to an upwardly angled snap position, according to the above description and as shown in FIG. 44, the groove board 4*b* can be moved towards the tongue board 4*a* so that the upper joint edges 41, 61 come into contact with each other and so that the locking means of the tongue are partially inserted into the locking means of the tongue groove by a snap function.

Figure 51F:
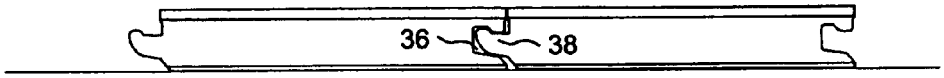

This snap function in the upwardly angled position is characterized in that the outer parts of the tongue groove widen and spring back. The widening is essentially smaller than is required in connection with snapping in in the horizontal position. The snap angle SA is dependent on the force by which the boards are pressed towards each other in connection with upward angling of the groove board 4*b*. If the press force in the direction F1 is high, the boards will snap in at a lower angle SA than if the force is low. The snapping-in position is also characterized in that the guiding parts of the locking means are in contact with each other so that they can perform their snapping-in function. If the boards are banana-shaped, they will be straightened out and locked in connection with the snapping-in. The groove board 4*b* can now, with an angular motion S2 combined with pressing towards the joint edge, be angled downwards according to FIG. 51*e* and locked against the tongue board in its final position. This is illustrated in FIG. 51*f*.

Depending on the construction of the joint, it is possible to determine with great accuracy the snap angle SA which gives the best function with regard to the requirement that the snapping-in should take place with a reasonable amount of force and that the guiding parts of the locking means should be in such engagement that they can hold together any banana shape, so that a final locking can take place without any risk of the joint system being damaged.

Figure 52A:
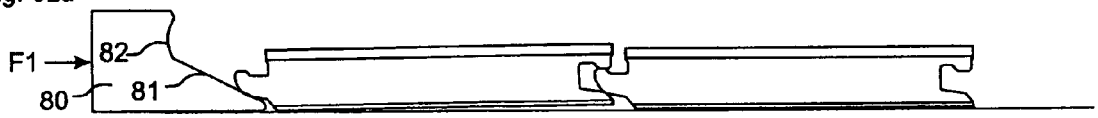
FIGS. 52*a–b* show laying by means of a specially designed tool.
Figure 52B:
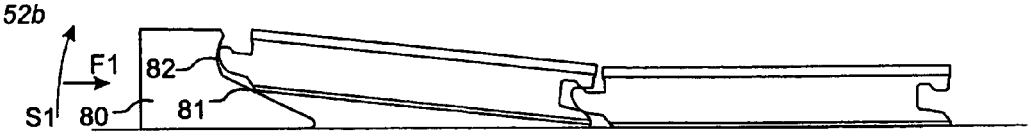

The floorboards can according to the preferred laying method be installed without any actual aids. In some cases, the installation can be facilitated if it is carried out with suitable aids according to FIGS. 52*a* and 52*b*. A preferred aid according to the present invention can be a striking or pressing block 80 which is designed so as to have a front and lower part 81 which angles the groove board upwards when it is inserted under the edge portion of the floorboard. It has an upper abutment edge 82 which in the upwardly angled position is in contact with the edge portion of the groove board. When the striking block 80 has been inserted under the groove board so that the abutment edge 82 is in contact with the floorboard, the groove board will have the predetermined snap angle. The tongue groove of the groove board 4*a* can now be snapped together with the tongue of the tongue board by pressing or striking against the striking block. Of course, the striking block can be moved to different parts of the board. It is obvious that this can take place in combination with other pressing against the other parts of the board, using a plurality of striking blocks and using different types of aids which give a similar result where, for instance, one aid angles the board up to the snapping-in angle and another is used for pressing together. The same method can be used if instead one wants to angle up the groove side of the new board and join it with the tongue side of the previously laid board.

The description will now be aimed at different aspects of a tool for laying of floorboards. Such a tool for laying of floorboards by interconnecting a tongue and groove joint thereof can be designed as a block 80 with an engaging surface 82 for engaging a joint edge 4*a*, 4*b* of the joint edge portion of the floorboard. The tool can be formed as a wedge for insertion under the floorboard and have its engaging surface 82 arranged close to the thick end of the wedge. The engaging surface 82 of the tool can be concavely curved for at least partial enclosure of the joint edge 4*a*, 4*b* of the floorboard. Moreover the wedge angle S1 of the wedge and the position of the engaging surface 82 on the thick portion of the wedge can be adjusted to obtain a predetermined lifting angle of a floorboard when it is being lifted with the wedge 80 and the joint edge of the floorboard contacts the engaging surface 82. The abutment surface 82 of the wedge 80 can be formed to abut against a joint edge portion 4*b* which has a tongue 38 directed obliquely upwards for joining an undercut tongue groove 36 formed at the opposite joint edge portion 4*a* of the floorboard with the tongue 38 of a previously laid floorboard. Alternatively, the abutment surface 82 of the wedge can be formed to abut against a joint edge portion 4*a*, which has an undercut groove 36, for joining a tongue 38 directed obliquely upwards and formed at the opposite joint edge portion 4*b* of the floorboard.

The tool described above can be used for mechanical joining of floorboards by lifting one floorboard relative to another and joining and locking of mechanical locking systems of the floorboards. The tool can also be used for mechanical joining of such a floorboard with another such floorboard by snapping together the mechanical locking systems of the floorboards while the floorboard is in its lifted state. Furthermore the tool can be used so that the engaging surface 82 of the wedge is made to abut against a joint edge portion 4*b* which has a tongue 38 directed obliquely upwards for joining an undercut groove 36 formed at the opposite joint edge portion 4*a* of the floorboard with the tongue 38 of a previously laid floorboard. Alternatively the tool can be used so that the engaging surface 82 of the wedge is made to abut against a joint edge portion 4*a* which has an undercut groove 36, for joining a tongue 38 which is directed obliquely upwards and formed at the opposite joint edge portion 4*b* of the floorboard with the undercut groove 38 of a previously laid floorboard.

Figure 53:
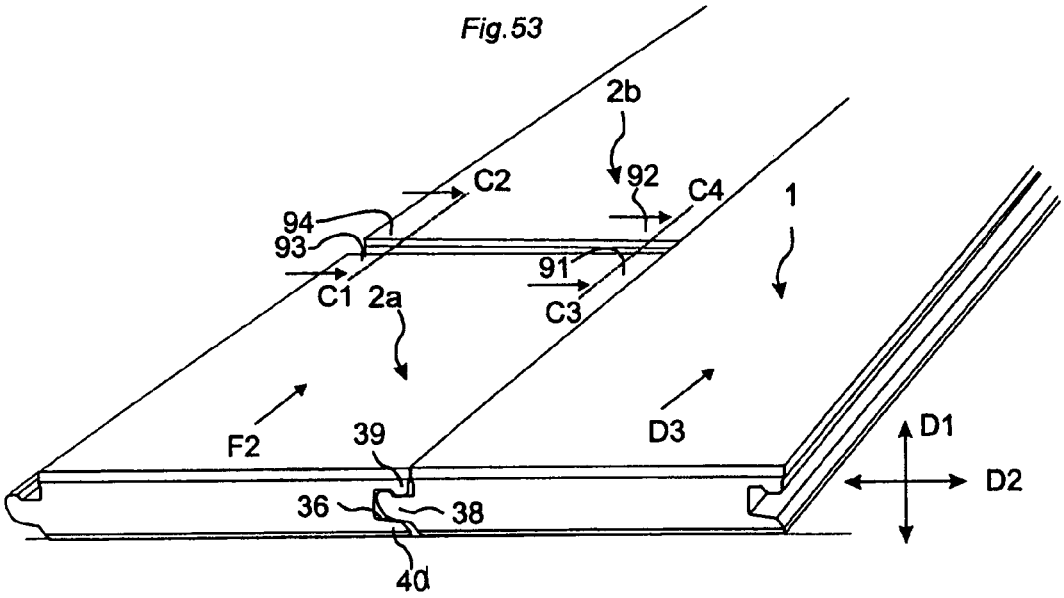
FIG. 53 shows joining of short sides.

FIG. 53 shows that the boards 2*a* and 2*b*, after being joined with adjoining boards along the long side edge, can be displaced in the locked position in the direction F2 so that joining of the other two sides can take place by a horizontal snapping together.

Snapping-in in the upwardly angled position can take place of long sides as well as short sides. If the short side of one board has first been joined, its long side can also be snapped in the upwardly angled position by this board with its locked short being angled up so that it takes its snap angle. Subsequently, snapping-in takes place in the upwardly angled position while at the same time displacement in the locked position takes place along the short side. After snapping-in, the board is angled down and it is locked on both long side and short side.

Figure 54A:
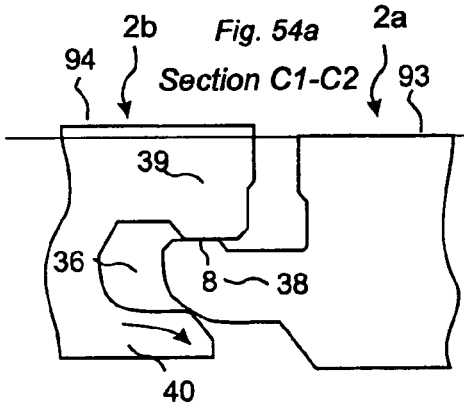
FIGS. 54*a–b* show snapping-in of the short side.
Figure 54B:
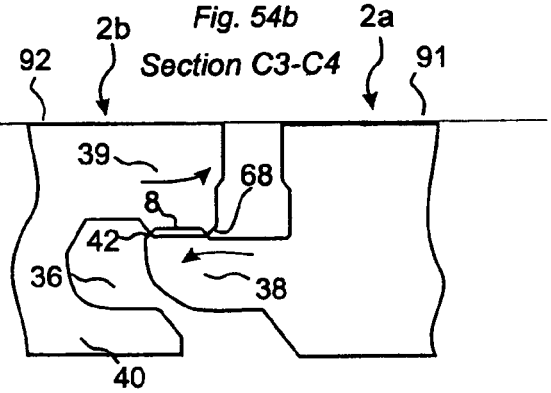

Moreover, FIGS. 53 and 54 describe a problem which can arise in connection with snapping-in of two short sides of two boards 2*a* and 2*b* which have already been joined on their long sides with another first board 1. When the floorboard 2*a* is to snap into the floorboard 2*b*, the inner corner portions 91 and 92, closest to the long side of the first board 1, are located in the same plane. This is due to the fact that the two boards 2*a* and 2*b* on their respective long sides are joined to the same floorboard 1. According to FIG. 54*b*, which shows the section C3–C4, the tongue 38 cannot be inserted into the tongue groove 36 to begin the downward bending of the lower lip 40. In the outer corner portions 93, 94 on the other long side, in the section C1–C2 shown in FIG. 54*a*, the tongue 38 can be inserted into the groove 36 to begin the downward bending of the lower lip 40 by the board 2*b* being automatically angled up corresponding to the height of the locking element 8.

Thus the inventor has discovered that there can be problems in connection with snapping-in of inner corner portions in lateral displacement in the same plane and that these problems may cause a high snapping-in resistance and a risk of cracking in the joint system. The problem can be solved by a suitable joint design and choice of materials which enable material deformation bending in a plurality of joint portions.

Figure 55:
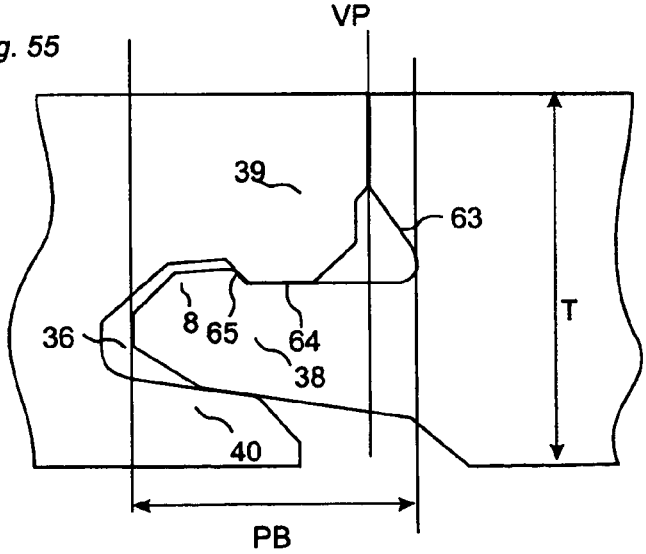
FIG. 55 shows a variant of the invention with a flexible tongue that facilitates snapping-in on the short side.

When snapping-in such a specially designed joint system, the following takes place. In lateral displacement, the outer guiding parts 42, 68 of the tongue and the upper lip coact and force the locking element 8 of the tongue under the outer part of the upper lip 39. The tongue bends downward and the upper lip bends upward. This is indicated by arrows in FIG. 54*b*. The corner portion 92 in FIG. 53 is pressed upward by the lower lip 40 on the long side of the board 2*b* being bent and the corner portion 91 being pressed downward by the upper lip on the long side of the board 2*a* being bent upward. The joint system should be constructed so that the sum of these four deformations is so great that the locking element can slide along the upper lip and snap into the locking groove. It is known that it should be possible for the tongue groove 36 to widen in connection with snapping-in. However, it is not known that it may be an advantage if the tongue, which normally should be rigid, should also be designed so as to be able to bend in connection with snapping-in. Such an embodiment is shown in FIG. 55. A groove or the like 63 can be made at the upper and inner part of the tongue inside the vertical plane VP. The entire extent PB of the tongue from its inner part to its outer part can be extended, and it can, for instance, be made greater than half the floor thickness T.

FIGS. 56 and 57 show how the parts of the joint system bend in connection with snapping-in at the inner corner portion 91, 92 (FIG. 57) and the outer corner portion 93, 94 (FIG. 56) of two floorboards 2*a* and 2*b*. To simplify manufacture, it is required that only the thin lip and the tongue bend. In practice, of course all parts that are subjected to pressure will be compressed and bent to a varying degree depending on thickness, bendability, composition of materials etc.

Figure 56A:
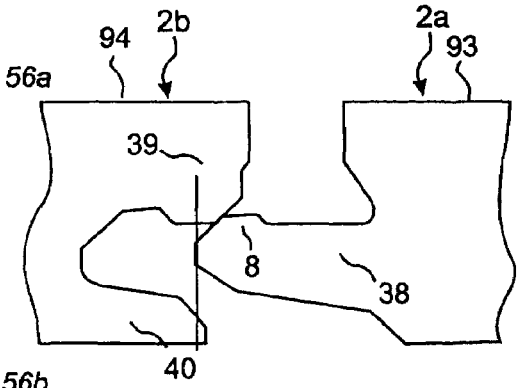
FIGS. 56*a–e* show snapping-in of the outer corner portion of the short side.
Figure 57A:
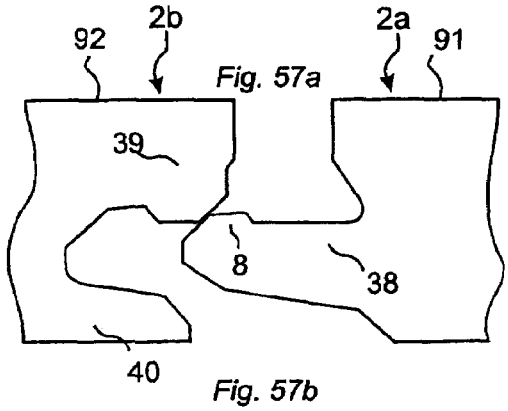
FIGS. 57*a–e* show snapping-in of the inner corner portion of the short side.
Figure 56B:
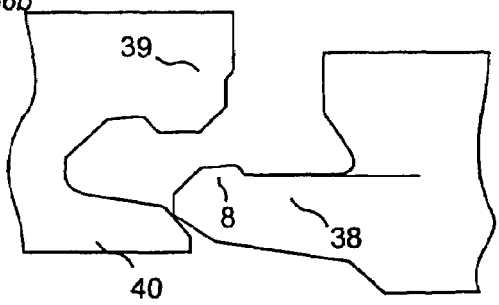
Figure 57B:
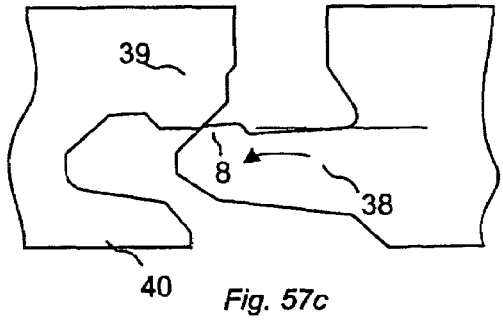
Figure 56C:
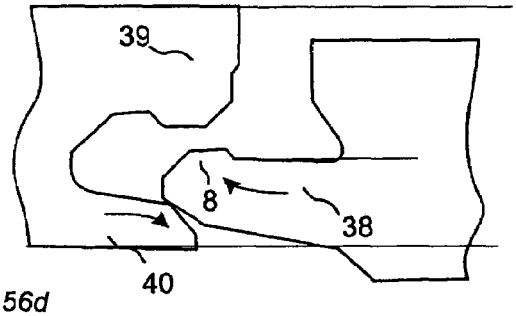
Figure 57C:
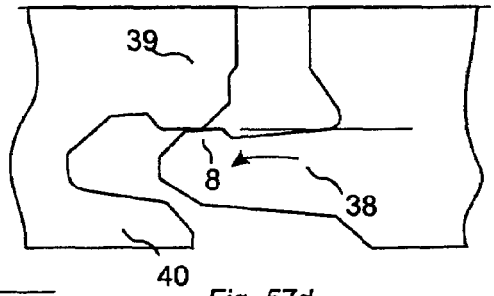
Figure 56D:
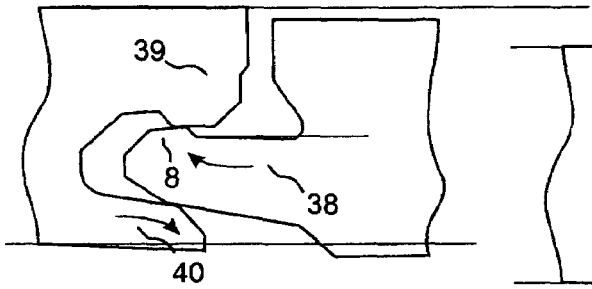
Figure 57D:
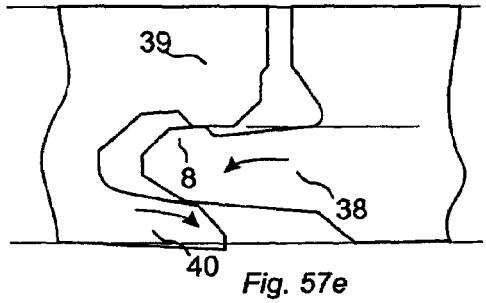
Figure 56E:
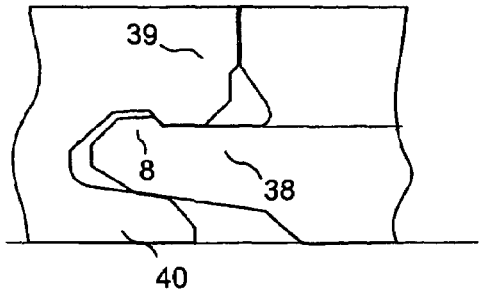
Figure 57E:
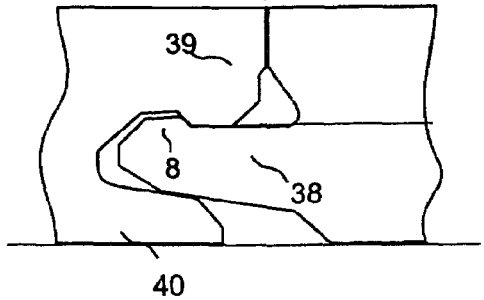

FIGS. 56*a* and 57*a* show the position when the edges of the boards come into contact with each other. The joint system is constructed in such manner that even in this position, the outermost tip of the tongue 38 will be located inside the outer part of the lower lip 40. When the boards are moved further towards each other, the tongue 38 in the inner corner 91, 92 will press the board 2*b* upward according to FIGS. 56*b*, 57*b*. The tongue will bend downward and the board 2*b* at the outer corner 93, 94 will be angled upward. FIG. 57*c* shows that the tongue 38 at the inner corner 91, 92 will be bent downward. At the outer corner 93, 94 according to FIG. 56*c*, the tongue 38 is bent upward and the lower lip 40 is bent downward. According to FIGS. 56*d*, 57*d*, this bending continues when the boards are moved further towards each other, and now also the lower lip 40 is bent at the inner corner 91, 92 according to FIG. 57*d*. FIGS. 56*e*, 57*e* show the snapped-in position. Snapping-in can thus be facilitated significantly if the tongue 38 is bendable and if the outer part of the tongue 38 is positioned inside the outer part of the lower lip 40 when tongue and groove come into contact with each other as the boards are located in the same plane in connection with snapping-in that takes place after the floorboard has already been locked along its two other sides.

Several variants can exist within the scope of the invention. The inventor has manufactured and evaluated a large number of variants where the different parts of the joint system have been manufactured with different widths, lengths, thicknesses, angles and radii of a number of different board materials and of homogeneous plastic and wooden panels. All joint systems have been tested in a position turned upside-down and with snapping and angling of groove and tongue boards relative to each other and with different combinations of the systems here described and also prior-art systems on long side and short side. Locking systems have been manufactured where locking surfaces are also upper engaging surfaces, where the tongue and groove have had a plurality of locking elements and locking grooves, and where also the lower lip and the lower part of the tongue have been formed with horizontal locking means in the form of locking element and locking groove.

What I claim and desire to secure by Letters Patent is:

1. A locking system for mechanical joining of floorboards at a joint plane, each of said floorboards having a core; a front side; a rear side; and opposite joint edge portions, the locking system comprising:

one of the joint edge portions is formed as a tongue groove which is defined by upper and lower lips and which has a bottom end, and the other of the joint edge portions is formed as a tongue and which includes an upwardly directed portion on an upper surface thereof, wherein the tongue groove, as seen from the joint plane, has an undercut groove, an opening, an inner portion, and an inner locking surface, and at least parts of the lower lip are formed integrally with the core of the floorboard, and the tongue has a locking surface which is formed on the upwardly directed portion to coact with the inner locking surface in the tongue groove of an adjoining floorboard, when two such floorboards are mechanically joined together, so that the front sides of each floorboard are positioned in a same surface plane and meet at the joint plane directed perpendicular thereto, at least a major part of the bottom end of the tongue groove, is positioned further away from the joint plane than is the outer end of the tongue when two such floorboards are mechanically joined together, the inner locking surface of the tongue groove is formed on the upper lip within the undercut portion of the tongue groove for coaction with the corresponding locking surface of the tongue, which locking surface is formed on the upwardly directed portion of the tongue to counteract pulling apart of two mechanically joined boards in a direction perpendicular to the joint plane, the inner locking surface and the locking surface defining a locking plane where said locking surfaces are most inclined relative to the surface plane when two such floorboards are mechanically joined together, that the lower lip has a supporting surface for coaction with a corresponding supporting surface on the tongue at a distance from the bottom end of the undercut groove, said supporting surfaces being intended to coact to counteract a relative displacement of two mechanically joined boards in a direction perpendicular to the surface plane, a second plane is defined as being parallel to the locking plane and being located further away from a point where the surface plane and the joint plane intersect than the locking plane, all parts of the portions of the lower lip which are connected with the core are located on a side of the second plane opposite the point, and the upper and lower lips and the tongue of the joint edge portions are designed to enable disconnection of two mechanically joined floorboards by upward pivoting of one floorboard relative to the other about a pivoting center close to the point of intersection between the surface plane and the joint plane for disconnection of the tongue of one floorboard and the tongue groove of the other floorboard.

2. A locking system as claimed in claim 1, wherein the upper and lower lips and tongue of the joint edge portions are designed to enable joining of two floorboards by one floorboard, while the two floorboards are essentially in contact with each other, being pivoted downward relative to the other floorboard about the pivoting center for joining the tongue of one floorboard with the tongue groove of the other floorboard.

3. A locking system as claimed in claim 1, wherein the undercut groove and the tongue have such a design that a floorboard which is mechanically joined with a similar board is displaceable in a direction along the joint plane.

4. A locking system as claimed in claim 1, wherein the tongue and the undercut groove are designed to enable connection and disconnection of one floorboard with and from another floorboard by pivoting one floorboard relative to the other floorboard while maintaining contact between the floorboards at a point on the joint edge portions of the floorboards close to the intersection between the surface plane and the joint plane.

5. A locking system as claimed in claim 1, wherein the tongue and the undercut groove are designed to enable connection and disconnection of floorboards by pivoting one floorboard relative to another floorboard while maintaining contact between the floorboards at a point on the joint edge portions of the floorboards close to the intersection between the surface plane and the joint plane essentially without contact between a side of the tongue facing away from the surface plane and the lower lip.

6. A locking system as claimed in claim 1, wherein the tongue and the undercut groove are designed to enable connection and disconnection of floorboards by pivoting one floorboard relative to another while maintaining contact between the floorboards at a point on the joint edge portions of the floorboards close to the intersection between the surface plane and the joint plane and in essentially line contact between sides of the tongue facing the surface plane and facing away from the surface plane and the upper and the lower lip, respectively.

7. A locking system as claimed in claim 1, wherein a distance between the locking plane and the second plane is at least 10% of a thickness of the floorboard.

8. A locking system as claimed in claim 1, wherein the locking plane forms an angle to the surface plane of below 90° but at least 20°.

9. A locking system as claimed in claim 8, wherein the angle is at least 30°.

10. A locking system as claimed in claim 1, wherein the edge portion with the tongue and the edge portion with the tongue groove are designed so that when two floorboards are joined there is surface contact between the edge portions along at most 30% of an edge surface of the edge portion supporting the tongue, measured from the front side of the floorboard to the rear side of the floorboard.

11. A locking system as claimed in claim 1, wherein the coacting supporting surfaces of the tongue and the lower lip are parallel with the surface plane or directed at an angle thereto which is equal to or smaller than a tangent to a circular arc which is tangent to the supporting surfaces engaging each other at a point closest to the bottom of the undercut groove and which has its center at the point where the surface plane and the joint plane intersect, seen in cross-section through the board.

12. A locking system as claimed in claim 1, wherein the upper lip has a guiding surface which is located closer to the opening of the tongue groove than is the locking surface of the upper lip and which has a smaller angle to the surface plane than does the locking plane.

13. A locking system as claimed in claim 1, characterized wherein the lower lip extends to the joint plane.

14. A locking system as claimed in claim 1, wherein the locking surface of the tongue is arranged at a distance from the free outer end of the tongue of at least 0.1 times a thickness of the floorboard.

15. A locking system as claimed in claim 1, wherein a vertical extent of the coacting locking surfaces is smaller than half a vertical extent of the undercut seen from the joint plane and parallel with the surface plane.

16. A locking system as claimed in claim 1, wherein the locking surfaces, seen in a vertical section through the floorboard, have an extent which is at most 10% of a thickness of the floorboard.

17. A locking system as claimed in claim 1, wherein a length of the tongue, seen perpendicular away from the joint plane, is at least 0.3 times a thickness of the floorboard.

18. A locking system as claimed in claim 1, wherein the joint edge portion supporting the tongue and/or the joint edge portion supporting the tongue groove have a recess which is positioned above the tongue and ends at a distance from the surface plane.

19. A locking system as claimed in claim 1, wherein the lower lip of the tongue groove is flexible.

20. A locking system as claimed in claim 1, wherein the locking system is formed as a snap lock which is openable by upward angling of one floorboard relative to the other floorboard.

21. A locking system as claimed in claim 1, wherein the locking system is formed for joining a previously laid floorboard with a new floorboard by a pushing-together motion essentially parallel with the surface plane of the previously laid floorboard for snapping together parts of the locking system.

22. A locking system as claimed in claim 1, wherein the undercut groove, seen in cross-section, has an outer opening portion that tapers inwards in the shape of a funnel.

23. A locking system as claimed in claim 22, wherein the upper lip has a bevel at its outer edge furthest away from the surface plane.

24. A locking system as claimed in claim 1, wherein the tongue, seen in cross-section, has a tip that tapers.

25. A locking system as claimed in claim 1, wherein the tongue groove and tongue are formed integrally with the floorboard.

26. A locking system as claimed in claim 1, wherein the locking plane is at a greater angle to the surface plane than a tangent to a circular arc which is tangent to the locking surfaces which engage each other at a point closest to the bottom of the undercut groove, and which has its center at the point where the surface plane and the joint plane intersect.

27. A locking system as claimed in claim 1, wherein the upper lip is thicker than the lower lip.

28. A locking system as claimed in claim 1, wherein a minimum thickness of the upper lip adjacent to the undercut is greater than a maximum thickness of the lower lip adjacent to the supporting surface.

29. A locking system as claimed in claim 1, wherein an extent of the supporting surfaces is at most 15% of a thickness of the floorboard.

30. A locking system as claimed in claim 1, wherein a vertical extent of the tongue groove between the upper and the lower lip, measured parallel with the joint plane and at an outer end of a supporting surface, is at least 30% of a thickness of the floorboard.

31. A locking system as claimed in claim 1, wherein a depth of the tongue groove, measured from the joint plane, is at least 2% greater than the corresponding extent of the tongue.

32. A locking system as claimed in claim 1, wherein the upper lip is more rigid than the lower lip.

33. A locking system as claimed in claim 1, wherein the locking system also comprises a second mechanical lock which is formed of a locking groove which is formed on the rear side of the floorboard of the joint edge portion supporting the tongue and extends parallel with the joint plane, and a locking strip which is integrally attached to the joint edge portion of the floorboard under the tongue groove and extends along essentially an entire length of the joint edge portion and has a locking component which projects from the locking strip and which, when two such floorboards are mechanically joined, is received in the locking groove of the adjoining board.

34. A locking system as claimed in claim 33, wherein the locking strip projects beyond the joint plane.

35. A locking system as claimed in claim 1, wherein the locking system is formed in a floorboard having a core of wood-fiber-based material.

36. A locking system as claimed in claim 1, wherein the locking system is formed in a floorboard having a core of wood.

37. A locking system as claimed in claim 1, wherein glue or a sealing agent is impregnated into a space between free surfaces of the joint system.

38. A locking system as claimed in claim 1, wherein glue is used as a complimentary locking means.

* * * * *